US005592270A

United States Patent [19]

Takai et al.

[11] Patent Number: 5,592,270

[45] Date of Patent: Jan. 7, 1997

[54] DEVELOPING DEVICE IN AN ELECTROPHOTOGRAPHIC APPARATUS CAPABLE OF CONTROLLING A DISCHARGE OF DETERIORATED DEVELOPER AND METHOD OF DISCHARGING DETERIORATED DEVELOPER

[75] Inventors: Yasuhiro Takai, Sakurai; Hideaki Hagihara, Nara; Hirokazu Tanaka, Osaka; Atsushi Ueda, Nara; Hideo Yamasa, Ikoma; Fumio Shimazu, Chiba, all of Japan

[73] Assignee: Sharp Kabushiki Kaisha, Osaka, Japan

[21] Appl. No.: 93,075

[22] Filed: Jul. 16, 1993

[30] Foreign Application Priority Data

| | | | |
|---|---|---|---|
| Jul. 21, 1992 | [JP] | Japan | 4-194056 |
| Feb. 16, 1993 | [JP] | Japan | 5-026796 |
| Feb. 25, 1993 | [JP] | Japan | 5-036456 |
| Feb. 25, 1993 | [JP] | Japan | 5-036460 |
| May 13, 1993 | [JP] | Japan | 5-111604 |
| May 24, 1993 | [JP] | Japan | 5-121698 |

[51] Int. Cl.[6] ..... G03G 15/06

[52] U.S. Cl. ..... 399/260; 355/208; 355/245; 355/298; 399/279; 399/61

[58] Field of Search ..... 355/246, 208, 355/245, 253, 298, 260, 200; 118/688, 691, 653; 222/DIG. 1

[56] References Cited

U.S. PATENT DOCUMENTS

| | | | |
|---|---|---|---|
| 4,614,165 | 9/1986 | Folkins et al. | 118/689 X |
| 4,913,087 | 4/1990 | Saita et al. | 355/260 X |
| 5,095,338 | 3/1992 | Hayes, Jr. et al. | 355/200 |
| 5,109,254 | 4/1992 | Oka et al. | 355/200 |
| 5,162,849 | 11/1992 | Yoshiro et al. | 355/246 X |
| 5,235,391 | 8/1993 | Aimoto | 355/208 X |
| 5,237,373 | 8/1993 | Aimoto et al. | 355/298 |
| 5,260,747 | 11/1993 | Uwagawa et al. | 355/246 |
| 5,430,532 | 7/1995 | Ueda et al. | 355/260 |
| 5,440,376 | 8/1995 | Hagihara | 355/260 X |
| 5,450,178 | 9/1995 | Kawashima et al. | 355/260 |

FOREIGN PATENT DOCUMENTS

| | | |
|---|---|---|
| 0295187 | 12/1988 | European Pat. Off. . |
| 0613064 | 8/1994 | European Pat. Off. . |
| 0615174 | 9/1994 | European Pat. Off. . |
| 4243096 | 6/1993 | Germany . |
| 59-100471 | 6/1984 | Japan . |
| 60-2596 | 1/1985 | Japan . |
| 60-107057 | 6/1985 | Japan . |
| 2-21591 | 5/1990 | Japan . |
| 04118675 | 4/1992 | Japan . |

*Primary Examiner*—Arthur T. Grimley
*Assistant Examiner*—Shuk Yin Lee
*Attorney, Agent, or Firm*—David G. Conlin; George W. Neuner; Brian L. Michaelis

[57] ABSTRACT

Deteriorating developer including toner and carrier in a developer container is replaced by supplying carrier developer including carrier from a developer supply unit and discharging an amount of the deteriorated developer corresponding to the amount of the supplied carrier developer through a discharge opening formed in the developer container by opening a cover. The cover is driven by a solenoid for discharging. With this structure, even when the amount of developer in the developer container is changed and the surface level of the developer is changed, a predetermined amount of deteriorated developer is accurately discharged according to the driving of the cover. It is thus possible to control in a desired manner the replacement ratio of deteriorated developer in the developer container to new developer to be supplied. With this configuration, it is possible to maintain the charge of developer substantially uniform and good image quality of copies.

42 Claims, 34 Drawing Sheets

FIG. 25

| | 0 | 1 | 2 | 3 | 4 | 5 | 6 | 7 | 8 | ····· |
|---|---|---|---|---|---|---|---|---|---|---|
| 0 | 500.00 | 0.00 | 0.00 | 0.00 | 0.00 | 0.00 | 0.00 | 0.00 | 0.00 | ····· |
| 1 | 5.00 | 495.00 | 0.00 | 0.00 | 0.00 | 0.00 | 0.00 | 0.00 | 0.00 | ····· |
| 2 | 5.00 | 4.95 | 490.05 | 0.00 | 0.00 | 0.00 | 0.00 | 0.00 | 0.00 | ····· |
| 3 | 5.00 | 4.95 | 4.90 | 485.15 | 0.00 | 0.00 | 0.00 | 0.00 | 0.00 | ····· |
| 4 | 5.00 | 4.95 | 4.90 | 4.85 | 480.30 | 0.00 | 0.00 | 0.00 | 0.00 | ····· |
| 5 | 5.00 | 4.95 | 4.90 | 4.85 | 4.80 | 475.50 | 0.00 | 0.00 | 0.00 | ····· |
| 6 | 5.00 | 4.95 | 4.90 | 4.85 | 4.80 | 4.75 | 470.74 | 0.00 | 0.00 | ····· |
| 7 | 5.00 | 4.95 | 4.90 | 4.85 | 4.80 | 4.75 | 4.71 | 466.03 | 0.00 | ····· |
| 8 | 5.00 | 4.95 | 4.90 | 4.85 | 4.80 | 4.75 | 4.71 | 4.66 | 461.37 | ····· |
| ⋮ | ⋮ | ⋮ | ⋮ | ⋮ | ⋮ | ⋮ | ⋮ | ⋮ | ⋮ | ⋮ |

DEVELOPING DEVICE IN AN ELECTROPHOTOGRAPHIC APPARATUS CAPABLE OF CONTROLLING A DISCHARGE OF DETERIORATED DEVELOPER AND METHOD OF DISCHARGING DETERIORATED DEVELOPER

FIELD OF THE INVENTION

The present invention relates to a developing device for use in an electrophotographic apparatus such as a copying machine, for storing a two-component developer including toner and carrier and supplying the toner to a photoreceptor surface so as to develop an electrostatic latent image formed on the photoreceptor surface into visible form.

BACKGROUND OF THE INVENTION

For example, dry-type copying machines often employ a developing device which develops an electrostatic latent image on a photoreceptor surface into visible form with a two-component developer including carrier and toner. In such a developing device, the toner is consumed during development, while the carrier is not consumed and remains in the developing device. Therefore, when the carrier and the toner are frequently agitated in the developing device, the resin coat layer on the carrier surface is removed and the carrier adheres to the toner surface. As the carrier deteriorates, the charge of the developer gradually decreases.

To avoid such a problem, developing devices, disclosed in Japanese Publication for Examined Patent Application No. 21591/1990 and for Examined Utility Model Application No. 2596/1985, restrain the decrease in the charge of developer by little by little supplying to the developing devices the carrier separately from the toner which is consumed during development. In these devices, when the carrier is supplied, the amount of developer in the developer container increases. Then, excess developer flows into the exit formed in a wall surface of the developer container and is discharged into the developer collecting container. By repeatedly performing supplying and discharging of developer, the deteriorated developer in the developer container is replaced with newly supplied toner and carrier. It is therefore possible to maintain the charge of developer and to restrain the image quality of copies from being degraded.

In these devices, however, since the discharge of the deteriorated developer is carried out in such a manner that the deteriorated developer flows from the exit formed in the wall surface of the developer container, the ratio of the discharged deteriorated developer to the newly supplied developer can not be maintained in a desired manner. As a result, the charge of developer varies and the image quality of copies is degraded. For example, when copies are repeatedly produced from an original with high density, the consumption of toner increases and the total amount of developer in the developer container decreases. In this state, even if the carrier is supplied to the developer, the level of the developer does not reach the exit, preventing the overflow or discharge of the developer. When the deteriorated developer is designed to be automatically discharged by the overflow structure, it is hard to discharge the deteriorated developer in a desired manner. It is therefore difficult to fully compensate for the degradation of the image quality of copies caused by a decrease in the charge of developer.

On the other hand, if the carrier is supplied when a great amount of developer is held in the developer container, the newly supplied carrier may soon flow out of or be discharged from the developer container. Thus, the replacement of the deteriorated developer with the newly supplied carrier can not be carried out in a desired manner, resulting in a decrease in the replacement efficiency. In order to compensate for the insufficient replacement, excessive carrier is needed to be supplied, causing an increase in the overall consumption of the developer.

In the case of the copying machine of a compact type for personal use, if the machine is easily and frequently moved by the user, it tilts or receives impact. Consequently, a great amount of developer is automatically discharged from the exit and the image quality of copies is significantly degraded.

SUMMARY OF THE INVENTION

It is an object of the present invention to provide a developing device capable of restraining a decrease in the charge of developer and of maintaining good image quality by supplying carrier developer including carrier, accurately discharging from a developer container an amount of developer corresponding to an amount of the carrier supplied, and by preventing a great amount of developer from being discharged in the event of the developing device being tilted or receiving external impact.

In order to achieve the object, a developing device of the present invention at least includes:

(a) a developer container for storing developer including toner and carrier, the developer container having a discharge opening for discharging deteriorated developer therefrom;

(b) a developing roller, mounted rotatably in the developer container, for supplying the developer to a photoreceptor so as to develop an electrostatic latent image formed in the surface of the photoreceptor into a toner image;

(c) an agitating member, mounted rotatably in the developer container, for agitating the developer so as to charge the toner by friction;

(d) developer supply means for supplying carrier developer including carrier to the developer container; and (e) shutter means for opening and closing the discharge opening so as to control the discharge of deteriorated developer from the developer container.

With this structure, by opening the discharge opening, the developer staying in the vicinity of the discharge opening is discharged by an amount corresponding to an opened state and time of the discharge opening. Therefore, even when the amount, i.e., the surface level of the developer in the developer container varies, an amount of deteriorated developer corresponding to the state of the slidable cover opened by the driving means is accurately discharged. It is thus possible to control the replacement ratio of the deteriorated developer to the newly supplied developer in the developer container in a desired manner. As a result, the charge of developer is maintained substantially uniform, and copies of good image quality are produced.

It is also possible to incorporate into the developing device the following means (f) and (g) instead of means (e), (f) developer accumulating means for storing a predetermined amount of the deteriorated developer discharged through the discharge opening, and (g) switching means for controlling the developer accumulating means to accumulate or discharge the deteriorated developer.

With this structure, a correct amount of the deteriorated developer is accurately discharged from the developer container. Thus, the replacement ratio of the deteriorated developer in the developer container to the newly supplied developer is accurately controlled.

It is another object of the present invention to provide a developing device capable of reducing the consumption of developer by improving the efficiency of replacement performed by supplying and discharging of developer.

In order to achieve the object, another developing device of the present invention includes at least the following means as well as means (a) through (e):

(h) supply and discharge control means for controlling the supply of carrier developer to the developer container and the discharge of deteriorated developer from the developer container by controlling the developer supply means and the shutter means.

The supply and discharge control means is constructed to control the developer supply means and the shutter means so that an amount of developer to be replaced by a single sequence of supplying carrier developer from the developer supply means and discharging deteriorated developer from the discharge opening is increased as the number of times replacement has been performed increases. With this control, it is possible to prevent the developer which has not deteriorated much and is still useful for development from being wastefully discharged. Additionally, even when the developer has deteriorated, a lowering of the charge of developer in the developer container is restrained. It is therefore possible to maintain good image quality. Moreover, as described above, since the replacement efficiency is improved by changing the amount of developer to be replaced depending on the degree of deterioration, the overall consumption of the developer is reduced.

When the supply and discharge control means controls the developer supply means and the shutter means such that the supply of carrier developer from the developer supply means and the discharge of deteriorated developer from the discharge opening are not performed simultaneously and that supplying of developer is delayed until discharging of developer is complete when the supply and discharge start signals are generated substantially at the same time, it is possible to prevent the newly supplied developer from being soon discharged. As a result, the replacement of deteriorated developer with new developer is efficiently carried out and the overall consumption of the developer is reduced. Besides, this control satisfactory restrains the degradation of image quality.

On the other hand, when the supply and discharge control means is constructed to control the developer supply means and the shutter means so that the replacement of the developer in the developer container is gradually performed by repeatedly supplying the carrier developer from the developer supply means and discharging the deteriorated developer from the discharge opening according to the total drive time of the rotary driving body including the developing roller or the agitating member, the supply of carrier developer and discharge of the developer are performed according to the total drive time of the rotary driving body which directly contributes to the deterioration of the developer in the developer container. With this control, for example, when warming up the copying machine after turning on the power, if the preliminary rotation of the rotary driving body causes the developer to deteriorate, replacement is performed according to the degree of the deterioration of the developer. With this structure, since the charge of developer is maintained, good image quality is maintained.

When the supply and discharge control means is constructed to control the developer supply means and the shutter means so that carrier developer is supplied by the developer supply means after the deteriorated developer is discharged from the discharge opening, it is possible to prevent the newly supplied developer from being soon discharged. With this control, since the replacement of the deteriorated developer with the new developer is efficiently performed, the overall consumption of developer is reduced, restraining the degradation of image quality.

In addition, when the supply and discharge control means is constructed to control the developer supply means and the shutter means so that the developer is discharged from the discharge opening by the rotation of the agitating member when the photoreceptor is charged to a uniform surface potential before imaging or after imaging, it is possible to prevent the deteriorated developer from staying at particular location in the developer container. As a result, a proper amount of developer is more efficiently discharged. Namely, since the replacement of the newly supplied developer with the deteriorated developer is efficiently performed, the overall consumption of the developer is reduced and the degradation of image quality is restrained. Moreover, it is possible to restrain the amount of developer from being changed during imaging by at least not discharging the developer from the developer container during imaging. This arrangement restrains the image quality from being varied by a change in the amount of developer.

When the supply and discharge control means is constructed to control the developer supply means and the shutter means so that an amount of developer which is greater than an amount, the developer amount in the developer container/(developer's useful life/developer replacement interval), is supplied to and discharged from the developer container. With this control, it is possible to restrain the charge of developer from being lowered and to maintain good image quality. The useful life of developer is a predetermined effective life of the developer indicated by the number of times imaging has been performed. The replacement interval is indicated by the number of times imaging has been performed between a sequence of supplying and discharging of developer and the next sequence.

When the developer supply means is constructed to supply carrier developer whose life expectancy is shorter than that of developer stored in the developer container to the developer container and when the supply and discharge control means is constructed to control the developer supply means and the shutter means so that the supply of the carrier developer to the developer container and the discharge of the deteriorated developer from the developer container are performed according to the life expectancy of the carrier developer supplied from the developer supply means, it is possible to prevent the developer in the developer container which has approached the end of its expected life, i.e., its ability as developer has greatly deteriorated from its initial state from being used. This structure prevents the image quality from being degraded, thereby enabling good image quality to be maintained.

Furthermore, when a copying machine is provided with mode selection means for selecting a mode at least from an improved image-quality mode and a developer saving mode and when the supply and discharge control means is constructed to control the developer supply means and the shutter means so that a relatively large amount of carrier developer is supplied to the developer container and a relatively large amount of deteriorated developer is discharged from the developer container in a single replacement operation at the time the improved image-quality mode is selected and that a relatively small amount of carrier developer is supplied to the developer container and a relatively small amount of deteriorated developer is discharged from the developer container in a single replacement operation at the time the developer saving mode is selected, a copying operation in which image quality is a top priority or a copying operation in which economical efficiency is a top priority is freely selected by the user.

For a fuller understanding of the nature and advantages of the invention, reference should be made to the ensuing detailed description taken in conjunction with the accompanying drawings.

BRIEF DESCRIPTION OF THE DRAWINGS

FIG. 25 is a table showing an alternative example of the changes in the life of developer of FIG. 24, wherein Mg is equal to 500 g and the developer replacement ratio $\alpha$ is 1%.

DESCRIPTION OF PREFERRED EMBODIMENTS

[EMBODIMENT 1]

Figure 1:
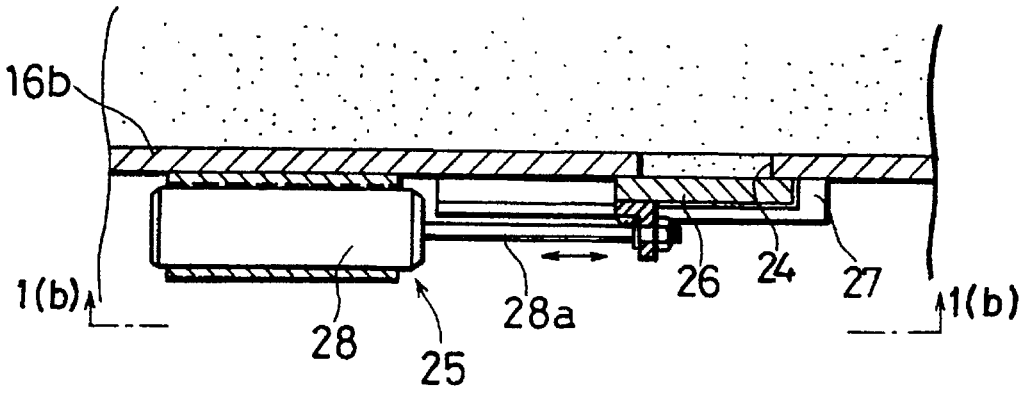
FIG. 1(*a*) and FIG. 1(*b*) illustrate essential components of a developing device according to one embodiment of the present invention, wherein FIG. 1(*a*) is a vertical section of the device and FIG. 1(*b*) is a view thereof cut across the 1(*b*)—1(*b*) line of FIG. 1(*a*).
Figure 1:
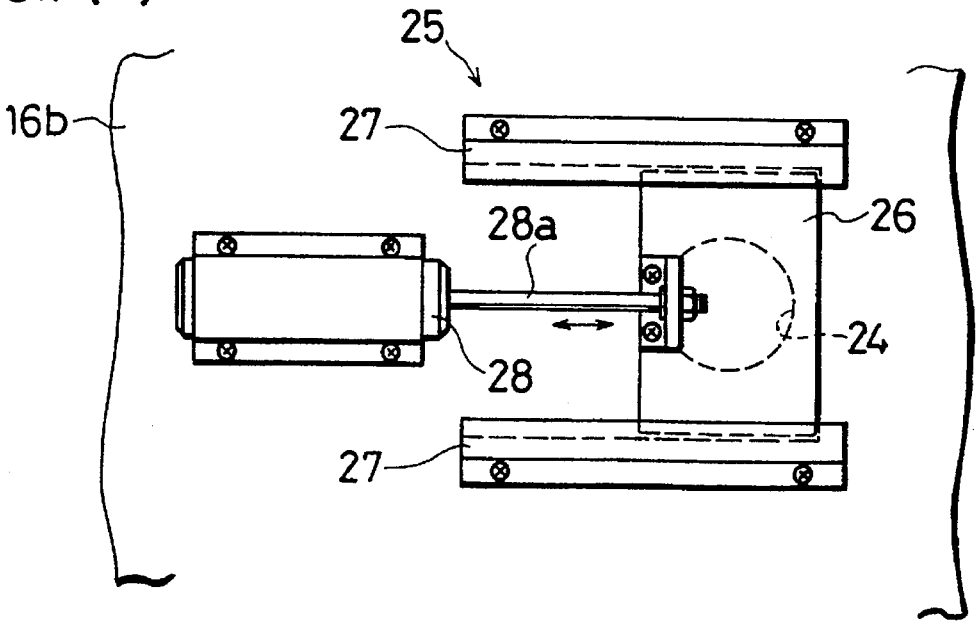

The following description discusses one embodiment of the present invention with reference to FIGS. 1(*a*) and 1(*b*) through 7(*a*) and 7(*b*).

Figure 2:
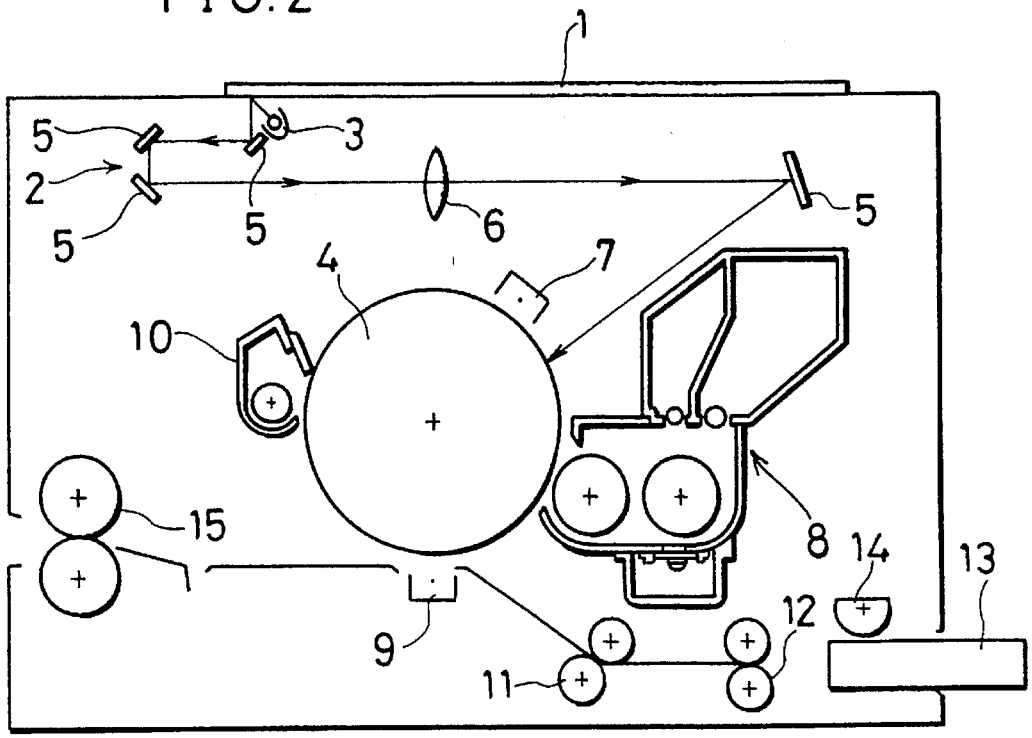
FIG. 2 is a depiction illustrating the entire structure of a copying machine incorporating the developing device.

As illustrated in FIG. 2, a copying machine constructed according to the present invention has a document platen 1 at the top thereof and an exposure optical system 2 under the document platen. The exposure optical system 2 includes a lamp 3 as a light source, a plurality of reflecting mirrors 5, and a lens unit 6. The lamp 3 scans a document, not shown, placed on the document platen 1 while projecting light onto the document. The reflecting mirrors 5 direct reflected light from the document to a photoreceptor 4. The lens unit 6 is disposed on the light path of the reflected light.

Disposed around the photoreceptor 4 are a charger 7 for charging the surface of the photoreceptor 4 to a predetermined potential, an image spacing eraser, not shown, a developing device 8 for developing an electrostatic latent image formed on the surface of the photoreceptor 4, a transfer charger 9 for transferring a toner image on the surface of the photoreceptor 4 to a sheet, a cleaning device 10 for collecting a residual toner on the surface of the photoreceptor 4, and a discharger, not shown. A paper cassette 13 is disposed on a feeding side of the copying machine. And, disposed between the paper cassette 13 and the photoreceptor 4 are timing rollers 11 for feeding a sheet at a predetermined point in the cycle of operation, a transport rollers 12, and a feed roller 14. On the other hand, a fixing device 15 for fusing the transferred toner image onto the sheet is disposed on the other side of the photoreceptor 4 near the discharging port.

Figure 3:
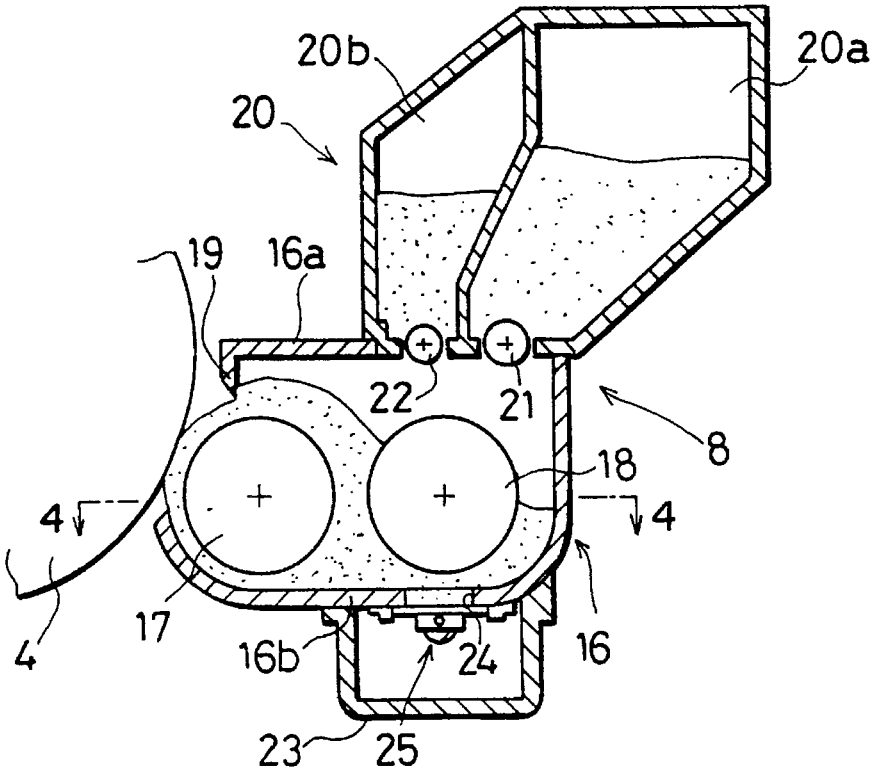
FIG. 3 is an enlarged vertical section of the developing device in the copying machine.

As illustrated in FIG. 3, the developing device 8 includes a developer container 16 having therein a rotatable developing roller 17 formed by a magnet roller, and a rotatable agitating roller (agitating member) 18. Developer held in the developer container 16 is composed of carrier and toner. The carrier formed by a magnetic substance includes a resin coat layer for restraining the toner from adhering to the carrier surface. When the carrier and the toner are agitated by the agitating roller 18, the toner is charged by friction. The developing roller 17 transports the carrier to the photoreceptor 4 by attracting the carrier with magnetic force and forming a magnetic brush. The toner attracted to the carrier by Coulomb force is supplied to the photoreceptor 4 and attracted to the electrostatic latent image on the photoreceptor 4, thereby developing the image. The length of the magnetic brush is regulated by a doctor 19.

An opening for the supply of the developer is formed in a top wall 16*a* of the developer container 16. A developer supply unit (developer supply means) 20 is placed above the opening to fit into the opening. The developer supply unit 20 is separated into two rooms, a toner storage 20*a* and a carrier-developer storage 20*b*. The toner storage 20*a* stores toner, and the carrier-developer storage 20*b* stores developer composed only of carrier, or developer composed of carrier and toner mixed at a predetermined ratio (hereinafter referred to as carrier developer).

Disposed at the bottom of the storages 20*a* and 20*b* are a toner supply roller 21 and a carrier-developer supply roller 22. As the toner supply roller 21 and the carrier-developer supply roller 22 are driven and rotate, the toner and the carrier developer in the toner storage 20*a* and the carrier-developer storage 20*b* flow downward into the developer container 16 for the time within which the rollers 21 and 22 are driven.

Figure 4:
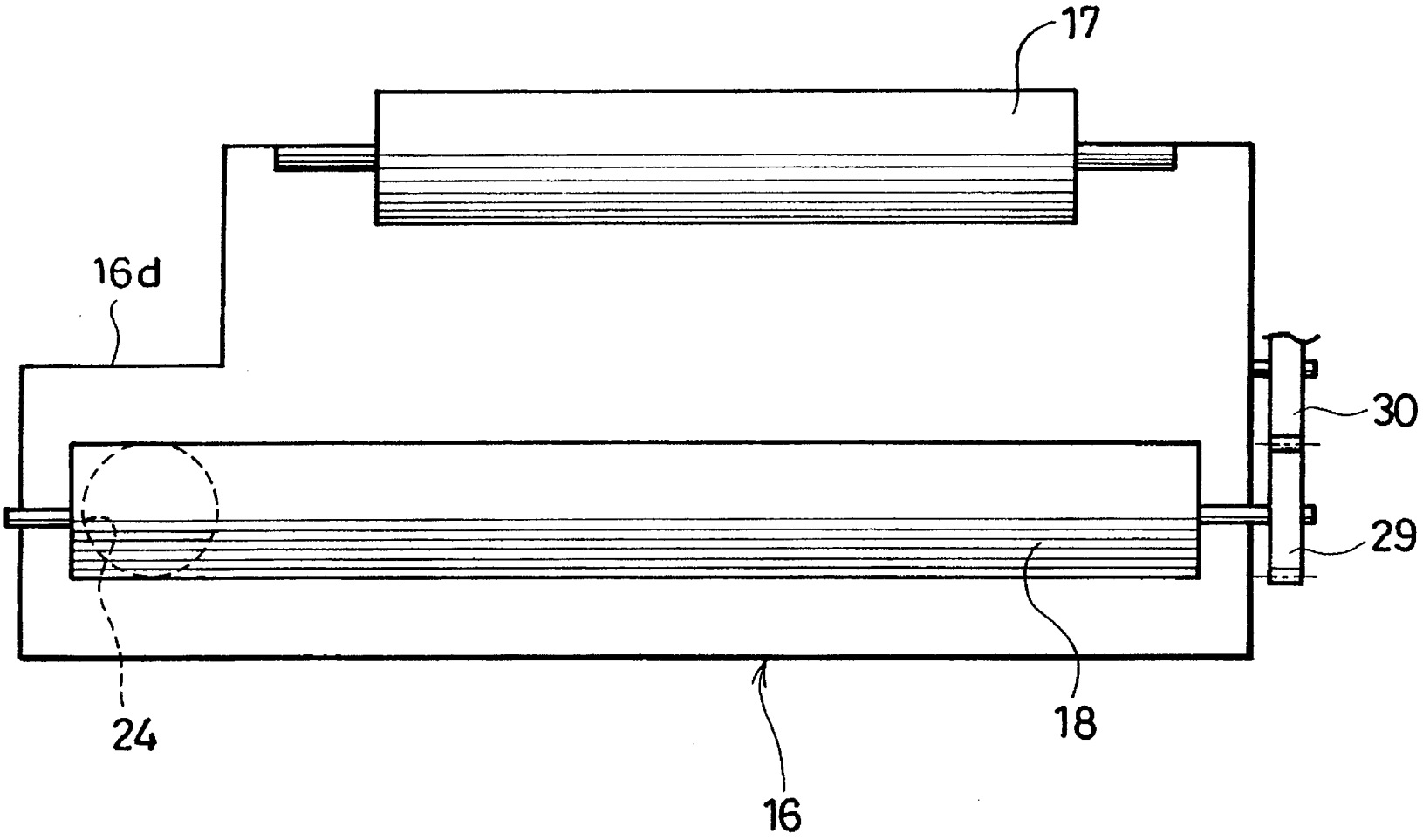
FIG. 4 is a vertical section of the developing device cut across the 4—4 line of FIG. 3 and indicates a position where a discharge opening shown in FIG. 1 is to be formed.

A collecting container 23 with an open top is attached to a bottom wall 16*b* of the developer container 16. The collecting container 23 is freely attachable to and detachable from the bottom wall 16*b*. The bottom wall 16*b* has a discharge opening 24 for letting the developer flowing downward from developer container 16 to the collecting container 23. As illustrated in FIG. 4 which is a schematic sectional view of FIG. 3 cut across the 4—4 line, the discharge opening 24 is placed in a position near the end of the bottom wall 16*b* on a non-driving side where gears 29 and 30 for driving the agitating roller 18 are not located so as to face the agitating roller 18. With this arrangement, the developer in the developer container 16 is started to flow and discharged with the rotation of the agitating roller 18.

If the discharge opening 24 is placed in a position located at an end of the bottom wall 16*b* and along the axis of the agitating roller 18 and if the agitating roller 18 is made to reach this position, the deteriorated developer residing at this end is discharged, enabling the developer in the developer container 16 to properly flow. Thus, the developer in the developer container 16 is used efficiently on the whole. In this embodiment, in order to ensure the area for the discharge opening 24, as illustrated in FIG. 4, the developer container 16 has a protruding section 16*d* extending in the axis direction of the agitating roller 18.

A shutter mechanism (shutter means) 25 for opening and closing the discharge opening 24 is mounted on the lower surface of the bottom wall 16*b* at the position corresponding to the discharge opening 24. As illustrated in FIGS. 1(*a*) and 1(*b*), the shutter mechanism 25 includes a slidable cover 26 in the shape of a plate which is freely slidable over the lower surface of the bottom wall 16*b*, guide plates 27 mounted on both sides of the slidable cover 26 for guiding the sliding movement of the slidable cover 26, and a discharge solenoid (driving means) 28 having a plunger 28*a* whose end is connected to the slidable cover 26. When the solenoid 28 is off, the plunger 28*a* is held in an advanced position and the slidable cover 26 covers up the discharge opening 24. On the other hand, when the solenoid 28 is on, the plunger 28*a* is retracted and the slidable cover 26 uncovers the discharge opening 24. When the discharge opening 24 is open, the developer in the developer container 16 flows downward due to its own weight and is discharged into the collecting container 23 through the discharge opening 24.

The following description discusses a copying operation of a copying machine having the above-mentioned structure.

When the power switch, not shown, is turned on, the copying machine is warmed up. After warming up the copying machine, when a copying start switch 31, to be described later, is turned on, the lump 3 in the exposure optical system 2 scans the document on the document platen 1. The reflected light from the document is projected through the reflecting mirrors 5 and the lens unit 6 onto the photoreceptor 4, and an electrostatic latent image is formed on the surface of the photoreceptor 4 which has been charged to a predetermined potential by the charger 7. Next, the electrostatic latent image is developed with the toner supplied by the developing device 8. The toner image formed on the surface of the photoreceptor 4 is transferred by the transfer charger 9 to a sheet supplied by the paper cassette 13 and is fused onto the sheet by the fixing device 15. Consequently, a copy of the image on the document is produced on the sheet.

Figure 5:
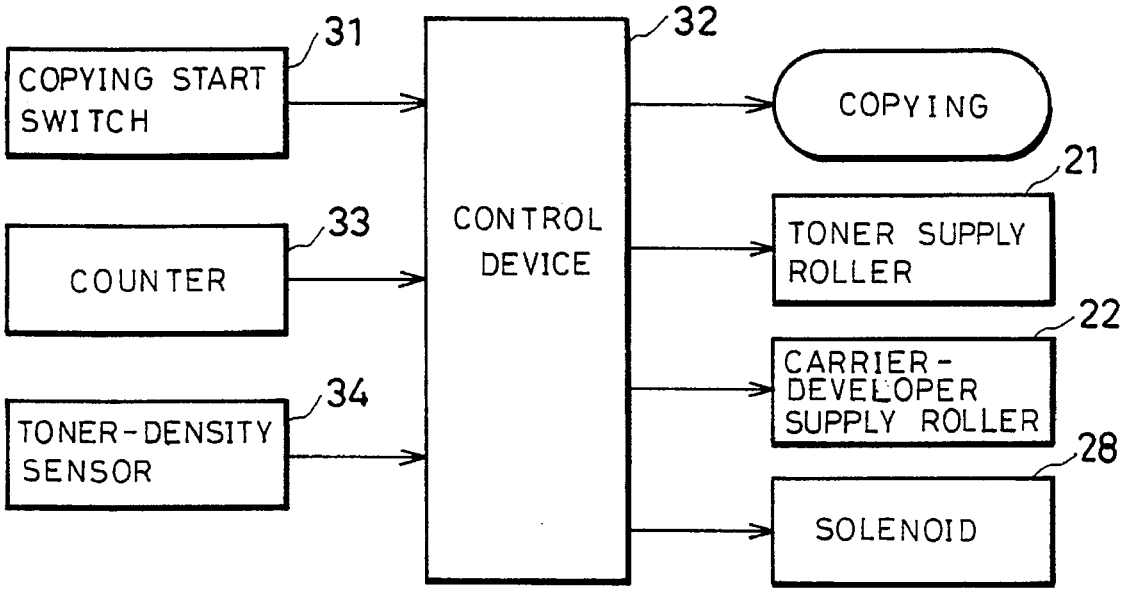
FIG. 5 is a block diagram of a control system of the copying machine.

In order to control such a series of copying processes, the copying machine has a control device 32 formed by a microcomputer as shown in FIG. 5. A signal for turning on the copying start switch 31 is designed to be input to the control device 32. The copying machine has also a counter 33 for counting the total number of copies produced, and a count (hereinafter referred to as copy count) n is input to the control device 32.

When such a copying operation is repeatedly performed, the toner in the developer stored in the developer container 16 is gradually consumed, and the ratio of the toner to the carrier, i.e., the toner density is lowered. A toner-density sensor 34 for detecting a change in the toner density is disposed in the developer container 16. The control device 32 controls the toner supply roller 21 to be driven according to an output of the toner-density sensor 34. More specifically, when the detection signal of the toner-density sensor 34 is lowered to the lower limit within a range of values optimum for development, the toner supply roller 21 is driven. Then, the toner is supplied from the toner storage 21*a* to the developer container 16, and the toner density in the developer container 16 increases. On the other hand, when the toner density increases to the higher limit within the range of values, the toner supply roller 21 is stopped. Such a control enables the toner density in the developer container 16 to be maintained within the optimum range.

The toner supplied in such a manner is mixed with the developer in the developer container 16, controlled to be charged to a predetermined level, supplied to the photoreceptor 4, and used for development. On the other hand, the carrier in the developer does not decrease, and is repeatedly used. Therefore, the carrier gradually deteriorates as they are agitated by the developer roller 17 and the agitating roller 18 and as they make contact with the photoreceptor 4. The deterioration of the carrier prevents the toner from being charged to a predetermined level, thereby degrading the image quality. A decrease in the charge of developer is diminished by supplying new carrier to the developer container 16 to replace the deteriorating carrier. The control device 32 controls the supply of the carrier developer from the carrier-developer storage 20*b* and the discharge of the developer from the developer container 16. Namely, the control device 32 functions as supply and discharge control means. With reference to the flow chart of FIG. 6, the control processes of the supply and discharge means are explained.

Every time a copy is produced, the copy count n of the counter 33 is compared with a set-value changing figure n(i) (Step 1). The figure n(i) is obtained by determining in advance totals of the number of copies produced at which set values for discharge cycle $X_C$, discharge time $t_{XC}$, supply cycle $Y_C$, and supply time $t_{YC}$ are to be changed. A plurality of figures n(1), n(2), . . . are recorded in the memory section in the control device 32, and they are sequentially read out according to a parameter i during Step 1. In the memory section, discharge cycle $X_C(i)$, discharge time $t_{XC}(i)$, supply cycle $Y_C(i)$ and supply time $t_{YC}(i)$ are stored to correspond to the respective set-value changing figures n(i) (where i is equal to 1, 2, . . . ) on a data table.

In Step 1, when the copy count n reaches the set-value changing figure n(i), $X_C(i)$, $t_{XC}(i)$, $Y_C(i)$ and $t_{YC}(i)$ are set as $X_C$, $t_{XC}$, $Y_C$ and $t_{YC}$ (Step 2). Then, 1 is added to the parameter i (Step 3).

After performing Steps 1 to 3 to change the set values, the copy count n is compared with discharge timing value $M_X$ (Step 4). If n reaches $M_X$, the solenoid 28 is turned on (Step 5). As a result, the slidable cover 26 which closes the discharge opening 24 is moved to open it, and the discharge of the developer from the developer container 16 is started. At this time, a discharge-time supervising timer starts measuring time, and the developer is discharged until the time $t_X$ measured by the timer reaches the discharge time $t_{XC}$ (Step 6). When $t_X$ reaches $t_{XC}$, the solenoid 28 is turned off (Step 7). Consequently, the slidable cover 26 is moved to close the discharge opening 24, and the discharge of the developer is stopped. Then, discharge cycle $X_C$ is added to the discharge timing $M_X$ (Step 8). This causes the discharge timing $M_X$ to be updated to a total of the number of produced copies at which the next discharge of the developer is to be performed.

When discharging of developer is complete or when the copy count n does not reach the discharge timing value $M_X$ in Step 4, the copy count n is compared with the supply timing value $M_Y$ (Step 9). When n does not reach the $M_Y$, the operation returns to Step 1. On the other hand, when n reaches the value $M_Y$, the carrier-developer supply roller 22 is turned on (Step 10). Consequently, the supply of the carrier developer from the carrier-developer storage 20*b* to the developer container 16 is started. This causes the supply-time supervising timer to start measuring time. The supply of the carrier developer continues until the measured time $t_Y$ reaches the supply time $t_{YC}$ (Step 11). When $t_Y$ reaches $t_{YC}$, the carrier-developer supply roller 22 is turned off (Step 12) to stop the supply of the carrier developer. Then, the supply cycle $Y_C$ is added to the supply timing value $M_Y$ (Step 13), and the operation goes back to Step 1. As a result, the supply timing value $M_Y$ is updated to a total of the number of produced copies at which the next supply is to be performed.

By repeating the above-mentioned control operation, the solenoid 28 is driven for the time $t_{XC}$ every $X_C$ times copying is performed, and an amount of the developer corresponding to the drive time is discharged from the developer container 16 into the collecting container 23. Moreover, every $Y_C$ times copying is performed, the carrier-developer supply roller 22 is driven for the time $t_{YC}$, and an amount of the carrier developer corresponding to the drive time is supplied to the developer container 16. Thus, by repeating the supply of the carrier developer and the discharge of the developer from the developer container 16, the deteriorated developer in the developer container 16 is consecutively replaced with new developer.

In this embodiment, by opening the discharge opening 24 formed in the bottom wall surface of the developer container 16, the developer staying at the bottom is discharged through the discharge opening 24 by an amount corresponding to an opened state and time of the discharge opening 24. Therefore, even when the total amount, i.e., the surface level of the developer in the developer container 16 varies, an amount of the developer corresponding to the movement of the slidable cover 26 driven by the solenoid 28 is accurately discharged from the bottom of the developer container 16. It is thus possible to control the replacement ratio of the deteriorated developer to the newly supplied developer in the developer container 16 in a desired manner. As a result, the charge of developer is maintained substantially uniform, and copies of good image quality are produced.

Figure 7:
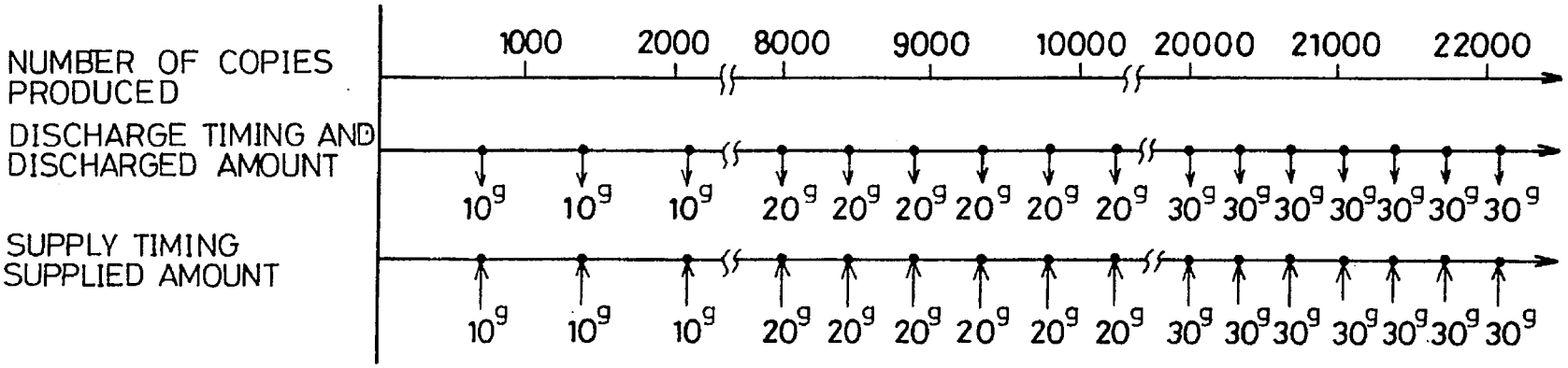
FIG. 7(*a*) and FIG. 7(*b*) illustrate one example of a supply and discharge control cycle, wherein FIG. 7(*a*) is a timing chart of the copying machine and FIG. 7(*b*) is a timing chart of a conventional copying machine.
Figure 7:
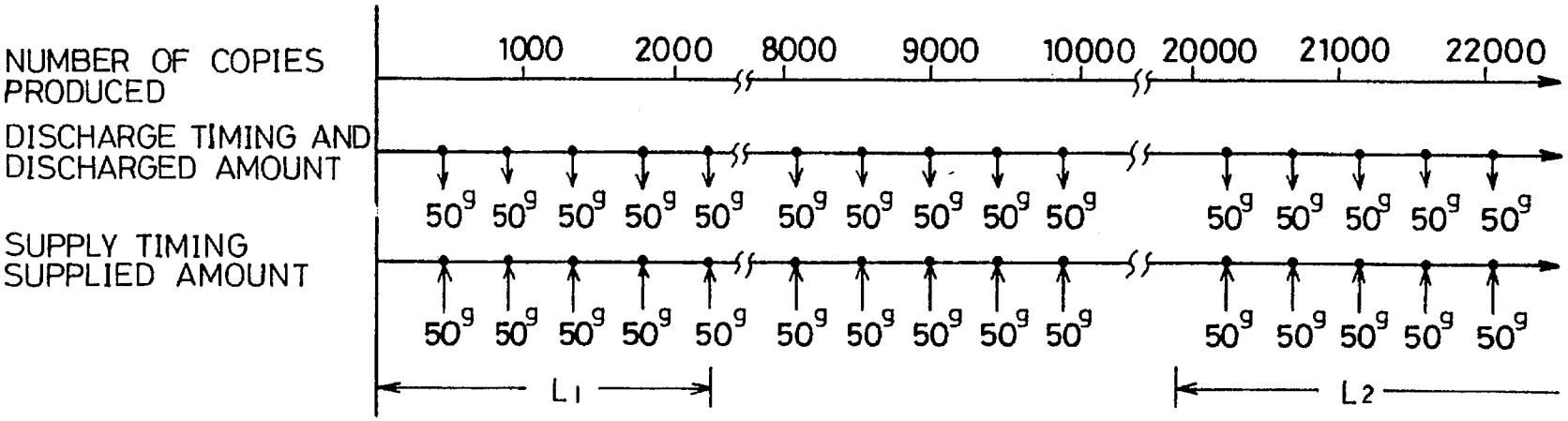

The discharge cycle $X_C$, discharge time $t_{XC}$, supply cycle $Y_C$ and supply time $t_{YC}$ are changed every time the copy count n reaches the set figure n(i). For example, as shown in FIG. 7(*b*), if the discharge cycle and the supply cycle are uniformly set to 400 times and if the operation is controlled such that 50 g developer is discharged and the same amount of the carrier developer is supplied every time 400 copies are produced, a great amount of developer which has not deteriorated much (period $L_1$ in the drawing) and is still usable for development is also discharged from the developer container 16. Moreover, when the total number of copies produced becomes greater and when the developer deteriorates significantly (period $L_2$ in the drawing), the replacement ratio of the deteriorated developer to the new developer becomes inappropriate. As a result, the charge of developer is lowered and the image quality of copies is gradually degraded.

However, such drawbacks are solved by changing the discharge cycle $X_C$, discharge time $t_{XC}$, supply cycle $Y_C$ and supply time $t_{YC}$ consecutively when the total number of copies produced has changed. For example, FIG. 7(*a*) shows a timing chart wherein the initial values $X_C(\mathbf{0})$ and $Y_C(\mathbf{0})$ for the supply cycle are set to 700 times, respectively, the initial values $t_{XC}(\mathbf{0})$ and $t_{YC}(\mathbf{0})$ for the discharge time and the supply time are set such that 10 g of toner is discharged and supplied respectively, the initial set-value changing figure n(1) is set to 8000 times, the discharge cycle and supply cycle $X_C(\mathbf{1})$ and $Y_C(\mathbf{1})$ are set around 400 times so as to correspond to the initial set-value changing figure n(1), and the initial values $t_{XC}(\mathbf{1})$ and $t_{YC}(\mathbf{1})$ for the discharge time and the supply time are set such that 20 g of toner is discharged and supplied respectively.

In this case, 10 g of the carrier developer is replaced every 700 copying operations until the total number of copies produced reaches 8000. After producing 8000 copies, for example, 20 g of the carrier developer is replaced every 400 copying operations until the total number of copies produced reaches 20000. After producing 20000 copies, for example, 30 g of the carrier developer is replaced every 300 copying operations.

The ratio of the deteriorated developer to the new developer is maintained substantially uniform by increasing the frequency of supplying and discharging of developer or the amounts of the carrier developer to be supplied and of the developer to be discharged as the total number of copies produced increases. As a result, the lowering of the charge of the developer in the developer container 16 is diminished, enabling the formation of good-quality image for a longer time. Furthermore, with this arrangement, the overall consumption of the developer is minimized.

[EMBODIMENT 2]

Figure 8:
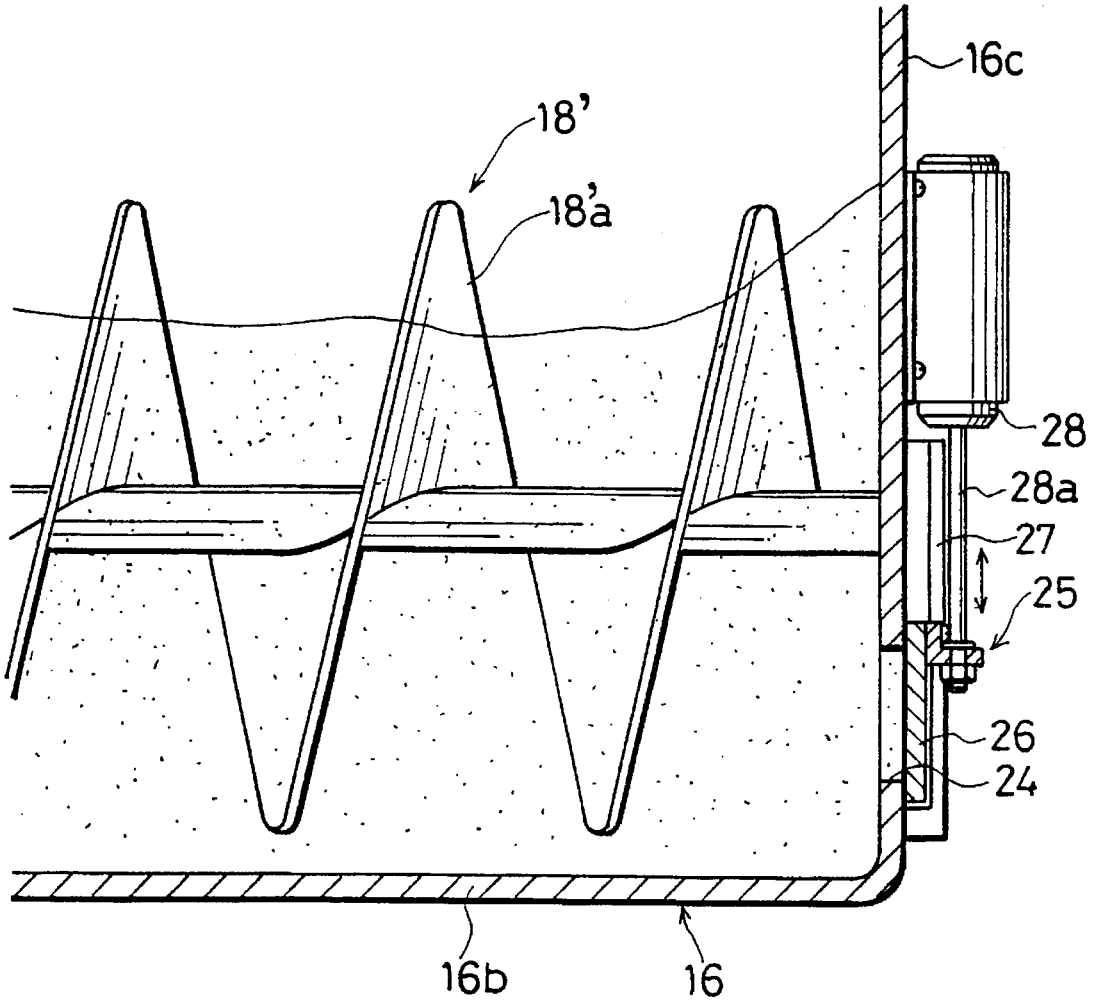
FIG. 8 is a vertical section of essential components of a developing device according to alternative embodiment of the present invention.
Figure 9:
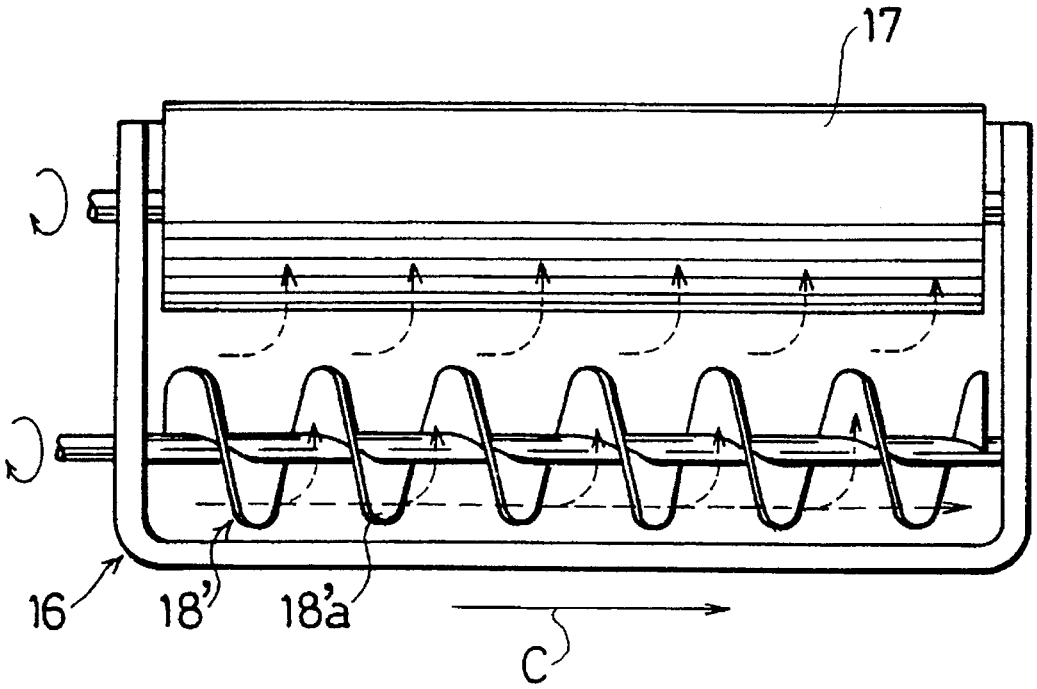
FIG. 9(*a*) and FIG. 9(*b*) explain how developer in a developer container flows with the rotation of an agitator in the developing device, wherein FIG. 9(*a*) is a top plan depiction and FIG. 9(*b*) is a depiction of a vertical section thereof.
Figure 9:
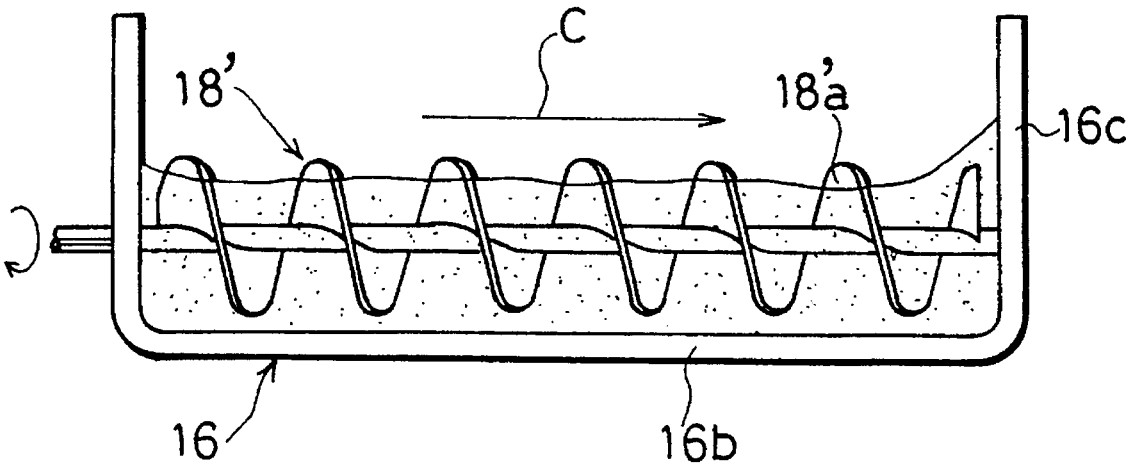

The following description discusses a second embodiment of the present invention with reference to FIGS. 8, 9(*a*) and 9(*b*). The members having the same function as in the first embodiment will be designated by the same code and their description will be omitted.

In the first embodiment, the shutter mechanism 25 is placed on the bottom wall 16*b* of the developer container 16. However, it is possible to place the shutter mechanism 25 on the side wall 16*c* of the developer container 16 as shown in FIG. 8. As illustrated in FIG. 8, the agitating member is formed by an agitating screw 18' having a spiral agitating blade 18'*a* around its axis. The agitating screw 18' is rotated to mix the toner and the carrier. As illustrated in FIGS. 9(*a*) and 9(*b*), the mixed developer is fed toward the developing roller 17 as shown with the broken arrows by the transport movement of the agitating screw 18' in the direction of arrow C along the axis direction. As shown in FIG. 9(*b*), since the developer is transported by the agitating screw 18' in the axis direction, the level of the developer becomes higher against the side wall surface 16*c* to which an end of the agitating screw 18' is attached. More specifically, even when the entire amount of developer in the developer container 16 decreases to some degree, some developer always remains against the side wall surface 16*c* at the bottom. Therefore, even if the discharge opening 24 is placed in this location as shown in FIG. 8, the developer is surely discharged whent the slidable cover 26 is opened. In particular, if the slidable cover 26 is opened in an interlocked manner with the driving of the agitating screw 18', the discharge of the developer is performed more accurately.

[EMBODIMENT 3]

Figure 10:
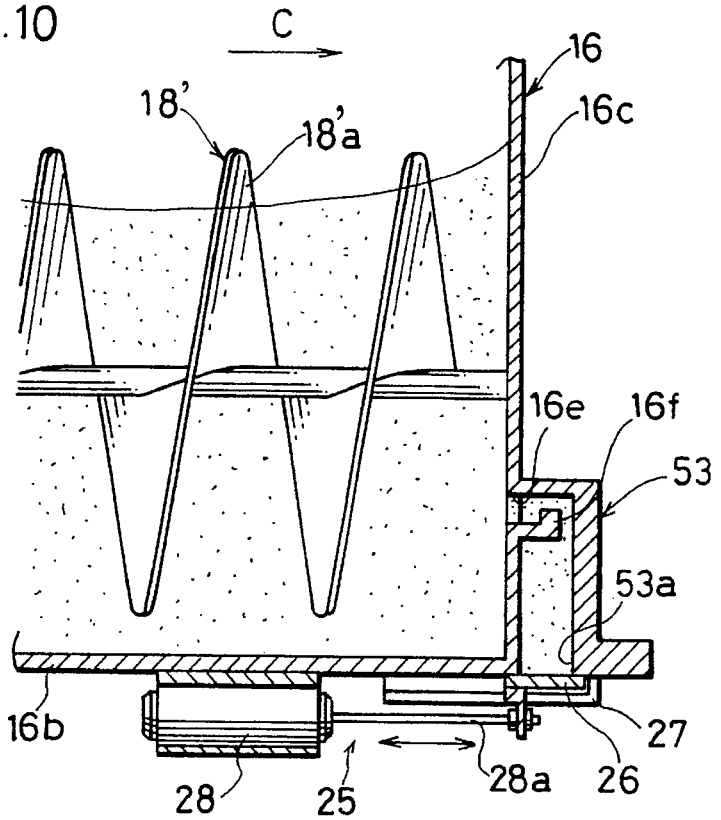
FIG. 10 is a vertical section of essential components of a developing device according to another embodiment of the present invention.

The following description discusses a third embodiment of the present invention with reference to FIG. 10. The members having the same function as in the first and second embodiments will be designated by the same code and their description will be omitted.

In the second embodiment, the agitating member is constituted by the agitating screw 18' having the agitating blade 18'*a*, and the shutter mechanism 25 is mounted on the side wall 16*c* of the developer container 16. However, for example, as shown in FIG. 10, it is possible to form the agitating member with the agitating screw 18' and to mount the shutter mechanism 25 on the lower surface of the bottom wall 16*b* of the developer container 16. A more detail description of this structure is given below.

As illustrated in FIG. 10, a developer-container's discharge opening 16*e* is formed in a portion of the side wall 16*c* which is in contact with the developer in the developer container 16 and toward which the developer is fed by the agitating screw 18'. Formed at the lower edge of the developer-container's discharge opening 16*e* is a discharge restricting section 16*f* for restricting an automatic discharge of the developer from the developer container 16. The discharge restricting section 16*f* sticks out from the lower edge of the developer-container's discharge opening 16*e* and has an end which is slightly bent upward.

A discharged-developer storage 53 for storing a predetermined amount of the developer discharged from the developer-container's discharge opening 16*e* is placed outside the side wall 16*c* to enclose the discharge opening 16*e*. Formed at the bottom wall of the discharged-developer storage 53 is a discharge opening 53*a* for discharging the developer accumulated in the discharged-developer storage 53. The collecting container 23 shown in FIG. 3, for example, is disposed below the discharged-developer storage 53 to cover the discharge opening 53*a*. The shutter mechanism 25 for closing and opening the discharge opening 53*a* is attached against the lower surface of the bottom wall 16*b*.

[EMBODIMENT 4]

Figure 11:
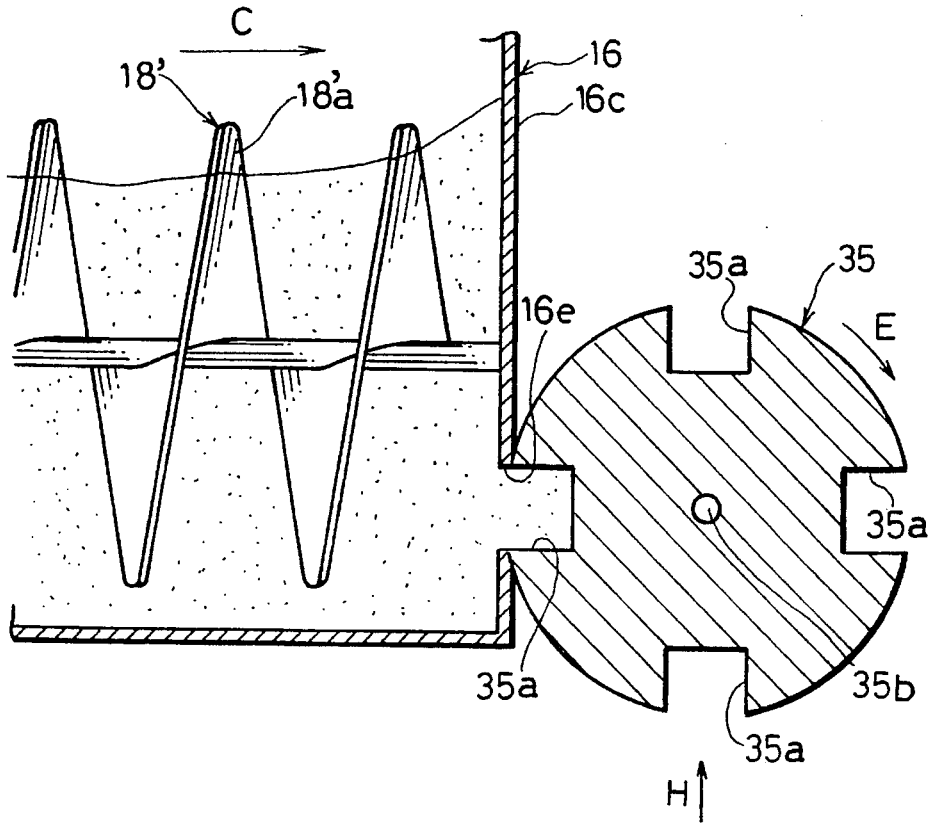
FIG. 11 is a vertical section of essential components of a developing device according to still another embodiment of the present invention.
Figure 12:
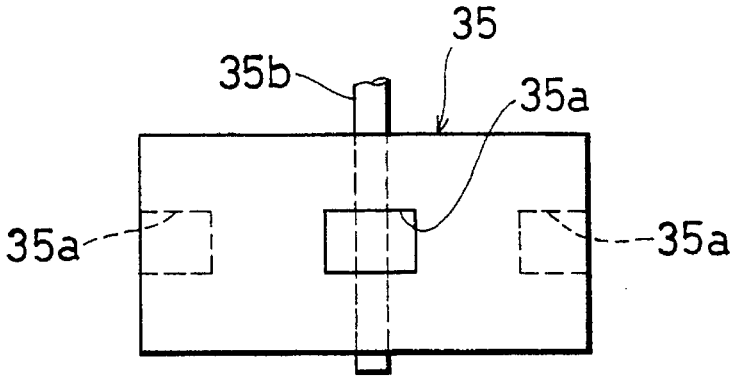
FIG. 12 is a view of a cylindrical rotating body of FIG. 11 seen from the direction of arrow H.
Figure 13:
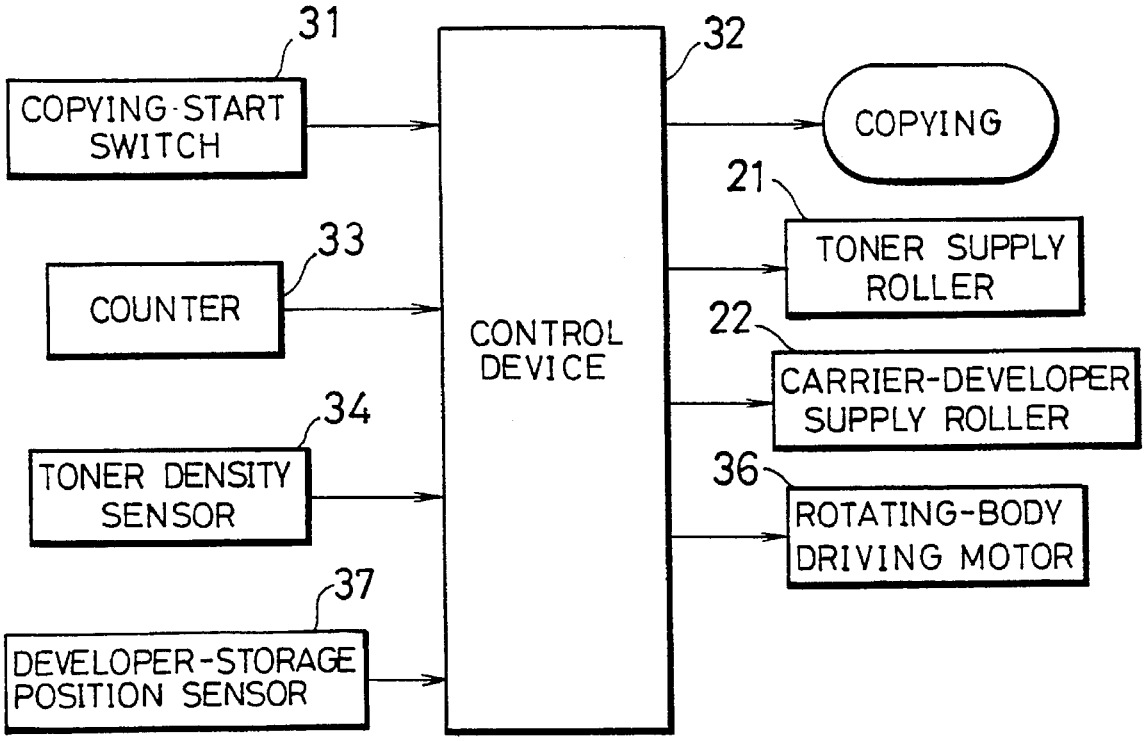
FIG. 13 is a block diagram of a control system of the copying machine incorporating the developing device.

The following description discusses a fourth embodiment of the present invention with reference to FIGS. 11 through 13. The members having the same function as in the first through third embodiments will be designated by the same code and their description will be omitted.

As illustrated in FIG. 11, the developing device of this embodiment has a cylindrical rotating body 35 and a rotating mechanism, not shown, instead of the discharged-developer storage 53 and the shutter mechanism 25 in the third embodiment, but does not have the automatic-discharge restricting section 16*f* at the developer-container's discharge opening 16*e*.

As shown in FIG. 12, the cylindrical rotating body 35 includes, for example, four recessed developer storages (developer accumulating means) 35*a* formed at equal intervals in the outer surface thereof. The length and width of each developer storage 35*a* is equal to those of the developer container's discharge opening 16*e*. The cylindrical rotating body 35 is disposed such that it is rotated on a rotation shaft 35*b*, the developer storages 35*a* are in turn connected to the discharge opening 16*e*, and that it covers the discharge opening 16*e* from outside as shown in FIG. 11.

The rotating mechanism rotates the cylindrical rotating body 35 in the E direction so that the developer storage 35*a* connected to the discharge opening 16*e* is moved upward. The rotating mechanism includes a rotating-body driving motor 36 shown in FIG. 13 and a developer-storage position sensor (driving control means) 37 for detecting if a developer storage 35*a* reaches the developer accumulating position. The rotating-body driving motor 36 is activated according to a detection signal of the developer-storage position sensor 37 under the control of the control device 32.

As for the discharge of the developer from the developer container 16 through the cylindrical rotating body 35, as illustrated in FIG. 11, when the control device 32 controls a developer storage 35*a* to be placed in the developer accumulating position, the developer in the developer container 16 is caused to flow through the developer-container's discharge opening 16*e* by the rotation of the agitating screw 18', and gradually but surely accumulated in the developer storage 35. Then, when the developer storage 35*a* is filled up with the developer, the cylindrical rotating body 35 is rotated so that the next developer storage 35*a* is placed in the developer accumulating position. Since the discharge opening 16*e* is covered with the outer wall of the cylindrical rotating body 35 when the cylindrical rotating body 35 is rotated, the developer is not discharged from the discharge opening 16*e*. Subsequently, when the cylindrical rotating body 35 is rotated and the developer storage 35*a* faces downward, the developer stored in the developer storage 35*a* is completely discharged and collected by a collecting container 23.

During the supply and discharge of the developer, similar to the structure of the first embodiment, the carrier-developer supply roller 22 and the rotating-body driving motor 36 are controlled so that a uniform amount of developer is always held in the developer container 16. The supply and discharge of the developer is performed every time the copy counter counts n. A copy count n at which supplying and discharging of developer is performed is varied according to the capacity of the developer storage 35*a*. In order to prevent the developer from being excessively discharged, it is desirable to rotate the cylindrical rotating body 35 and bring the next developer storage 35*a* to the developer accumulating position when the agitating screw 18' is stopped.

As described above, in the developing device of this embodiment, the cylindrical rotating body 35 is rotated to locate a developer storage 35*a* in the developer accumulating position, the developer is accumulated in the developer storage 35*a*, the cylindrical rotating body 35 is rotated to locate the next developer storage 35*a* in the developer accumulating position so as to discharge the developer. With this structure, it is possible to control a correct amount of developer to be discharged. Since the deteriorated developer in the developer container 16 is consecutively replaced with new developer, the ratio of the deteriorated developer to the newly supplied developer is controlled in a desired manner. Additionally, this structure prevents a great amount of developer from being discharged from the developer container 16 even in the event of the copying machine receiving impact or being tilted when moved. It is thus possible to restrain the charge of the developer in the developer container 16 from decreasing, to maintain good image quality for a long time, and to minimize the overall consumption of developer.

In this embodiment, the developer in the developer container 16 is discharged from the developer-container's discharge opening 16*e* by the rotation of the agitating screw 18' and is accumulated into the developer storages 35*a*. However, it is also possible to automatically discharge the developer from the discharge opening 16*e* and accumulate it into the developer storages 35*a*. In this case, it is not necessary to place the discharge opening 16*e* in the side wall 16*c* shown in FIG. 11 toward which the developer in the developer container 16 is moved. Namely, the discharge opening 16*e* is formed in any side walls 16*c* if it is in contact with the developer in the developer container 16.

[EMBODIMENT 5]

Figure 14:
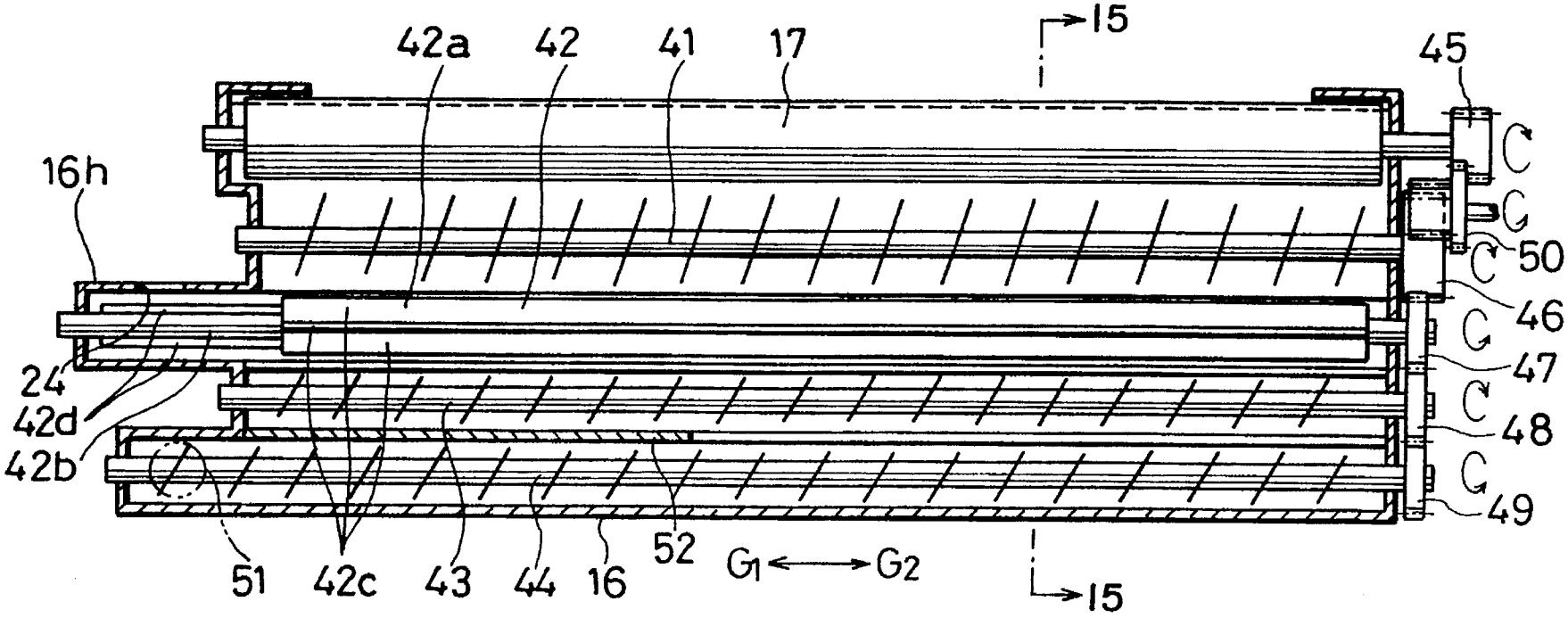
FIG. 14 is a transverse cross section of a developing device according to still another embodiment of the present invention.
Figure 15:
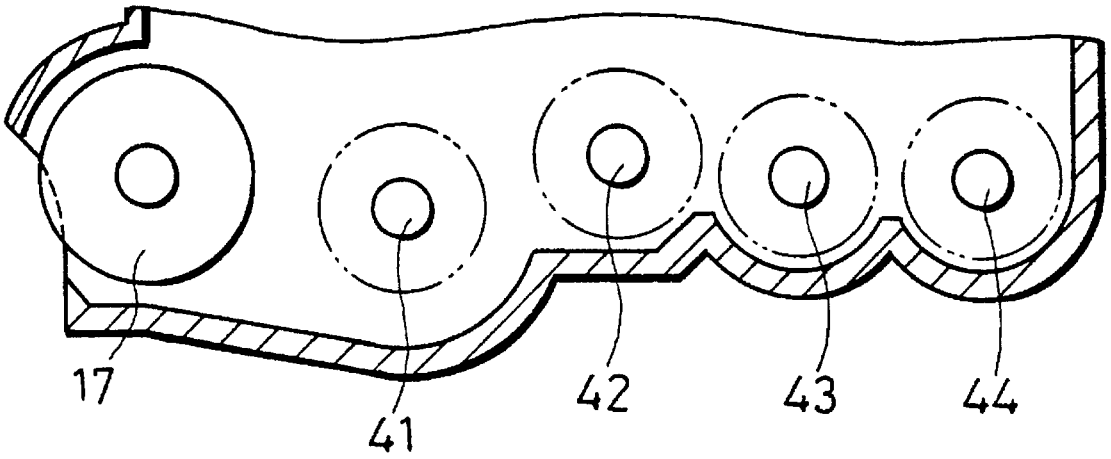
FIG. 15 is a vertical section of the developing device cut across the 15—15 line of FIG. 14.

The following description discusses a fifth embodiment of the present invention with reference to FIGS. 14 and 15. The members having the same function as in the first through third embodiments will be designated by the same code and their description will be omitted.

As illustrated in FIG. 14 and FIG. 15 that is the cross section of FIG. 14 cut along the 15—15 line, the developing device of this embodiment includes the developing roller 17, an agitating screw 41, a paddle roller 42 as an agitating member, a transport screw 43 for transporting developer in the $G_1$ direction, and a transport screw 44 for transporting developer supplied to a carrier-developer supply point 51 in the $G_2$ direction.

In FIG. 14, a separating plate 52 is disposed on a left portion of the developing container 16 between the transport screws 43 and 44. The separating plate 52 prevents the developer supplied to the carrier-developer supply point 51 from being fed to the transport screw 43 before being agitated sufficiently by the transport screw 44. When driving force is transmitted to gears 45 to 49 mounted on an end of the developing container 16 on the driving side by a gear 50 connected to a motor, not shown, the rotating members 17 and 41 to 44 are rotated.

A portion on the other end of the developer container 16 opposite to the driving side where the puddle roller 42 is located protrudes in the axis direction to form a protruding section 16*h*. The discharge opening 24 is placed in a portion of the side wall of the protruding section facing the puddle roller 42. The shutter mechanism 25 shown in FIGS. 1(*a*) and 1(*b*) is placed in this portion.

An agitating section 42*a* having four pieces of blades 42*c* arranged substantially in the shape of a cross is formed on a portion of the puddle roller 42 located on the right side of the protruding section 16*h* shown in FIG. 14. And a discharging section 42*b* having two pieces of blades 42*d* is formed on a portion of the puddle roller 42 located in the protruding section 16*h*. The puddle roller 42 having such an agitating section 42*a* performs an agitating operation efficiently. Moreover, this configuration prevents a great amount of developer from being discharged from the discharge opening when the puddle roller 42 is rotated at a speed required for agitation, and enables the discharging section 42*b* to discharge a suitable amount of developer. The number of pieces of blades 42*d* is not necessarily two, and can be varied suitably.

In this embodiment, it is not necessary to place the discharge opening 24 in the side wall and it may be formed in the bottom wall. The slidable cover 26 is opened when the puddle roller 42 is rotated. The operation and function of the developing device are the same as those described in the first embodiment.

[EMBODIMENT 6]

Figure 16:
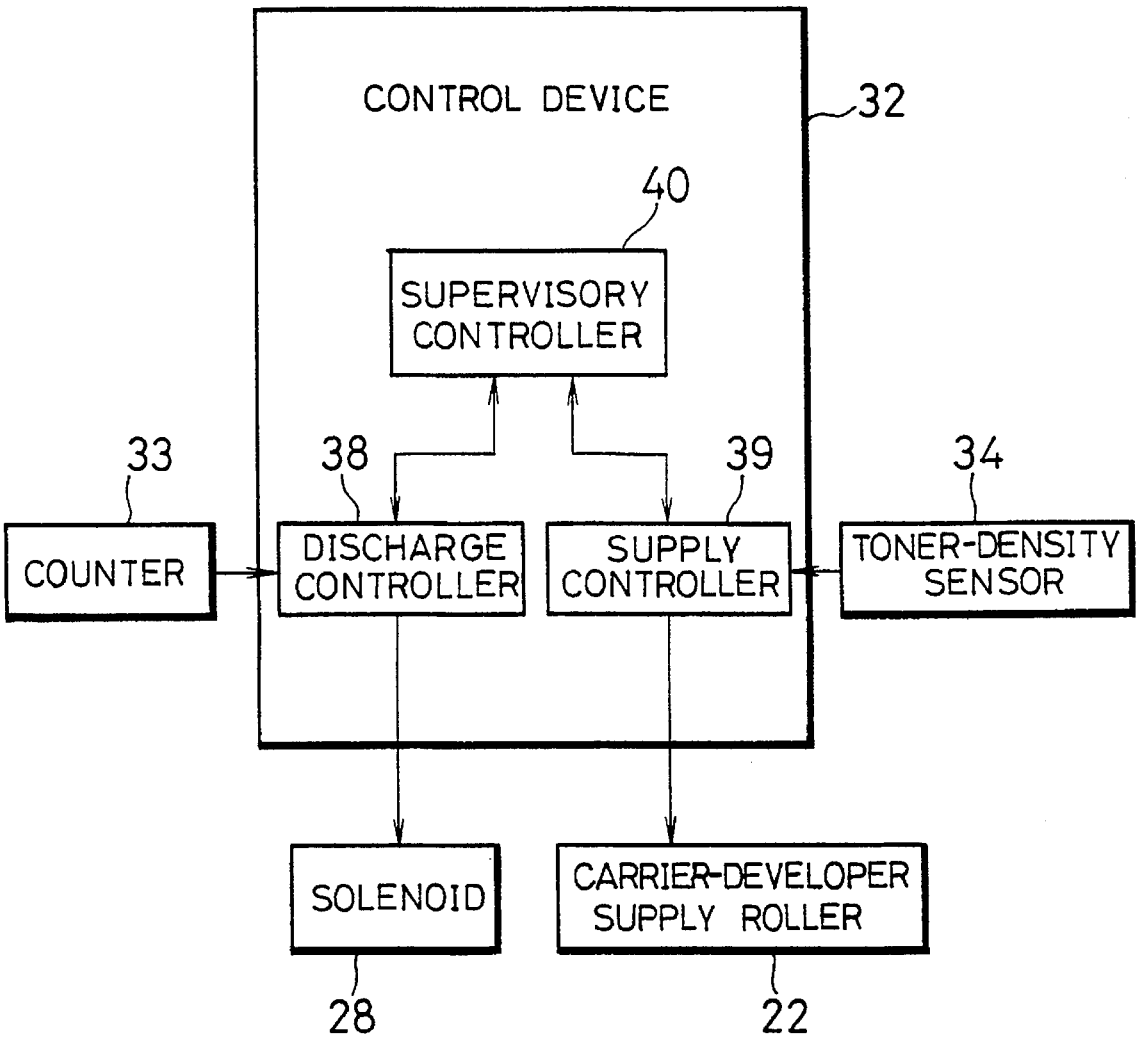
FIG. 16 is a block diagram of a control system of a developing device according to still another embodiment of the present invention.
Figure 17A:
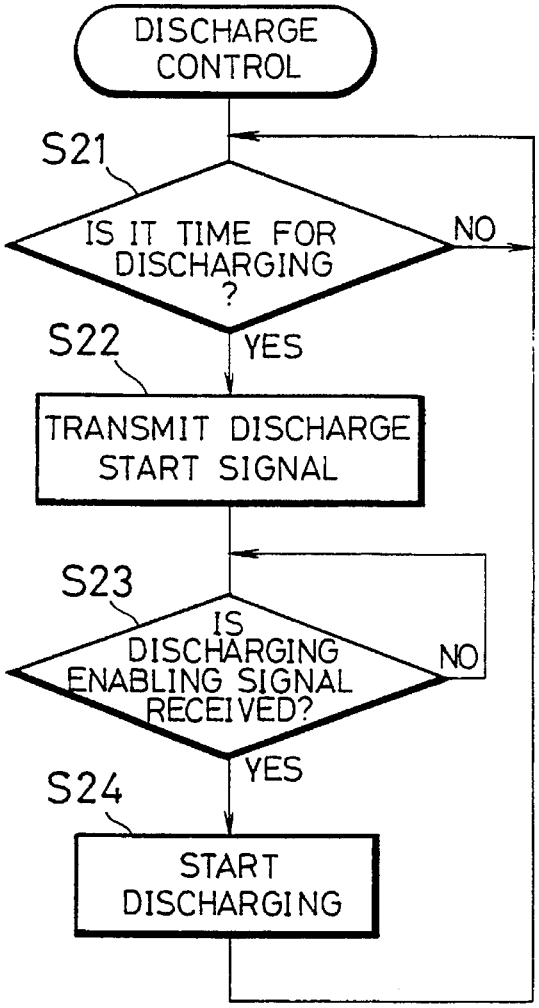
FIG. 17(*a*) and FIG. 17(*b*) illustrate control processes in a control device of FIG. 16, wherein FIG. 17(*a*) is a flow chart of discharge process and FIG. 17(*b*) is a flow chart of supply process.
Figure 17B:
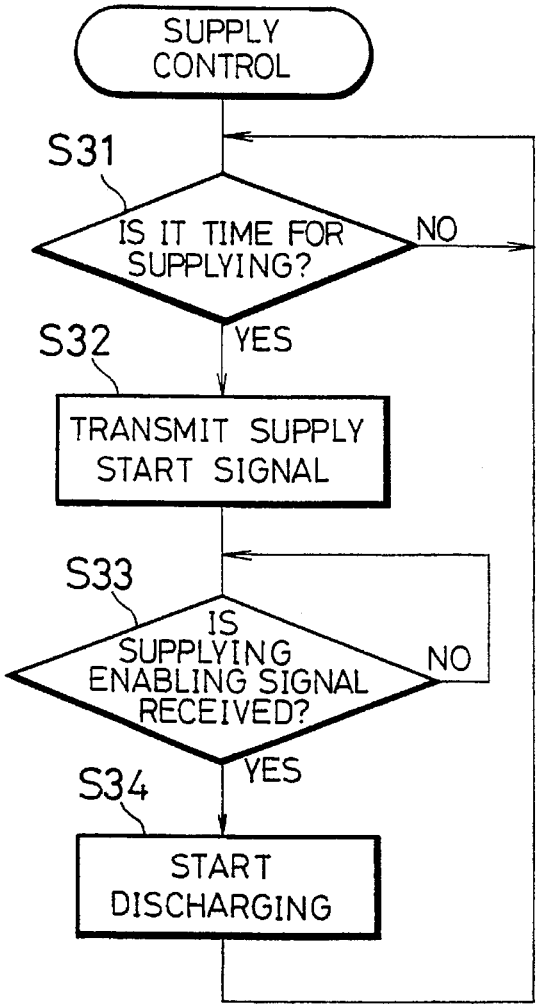
Figure 18:
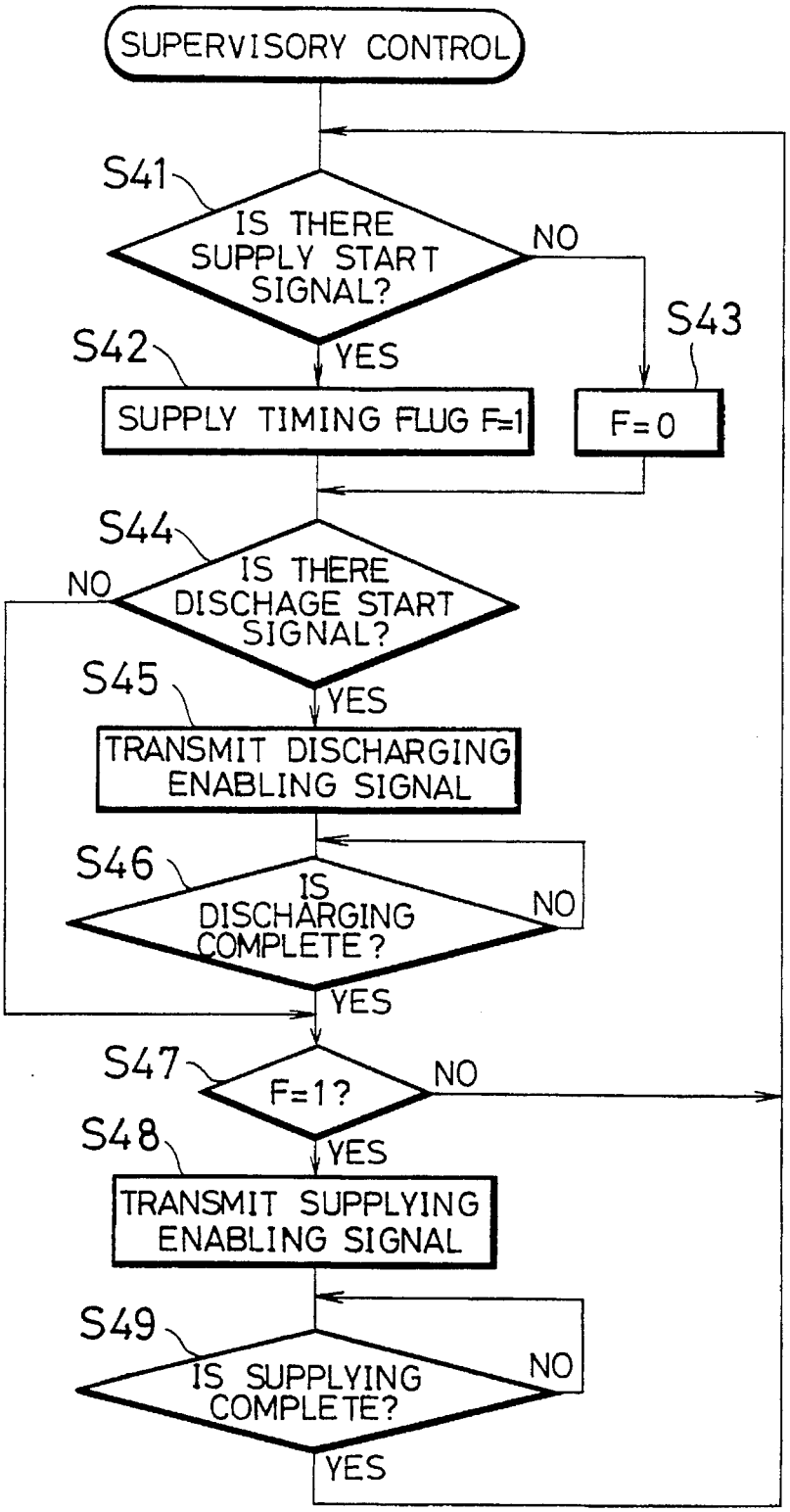
FIG. 18 is a flow chart of a supervisory control process in the control device of FIG. 16.

The following description discusses a sixth embodiment of the present invention with reference to FIGS. 16 through 18. The members having the same function as in the first through third embodiments will be designated by the same code and their description will be omitted.

In the first embodiment, the supply of the carrier developer and the discharge of the developer from the developer container 16 are performed when the copy count n reaches predetermined figures. However, it is also possible to control the discharge of the developer based on the copy count n and the supply of the carrier developer to be executed in synchronism with the supply of the toner which is performed according to the detection signal of the toner density sensor 34. In this case, if discharging of developer and supplying of developer are separately controlled and carried out at the same time, there is a possibility that the newly supplied developer is soon discharged.

In order to overcome such a drawback, the device of this embodiment is constructed such that discharging of developer and supplying of developer are not performed at the same time on the premises that the supply of the carrier developer and the discharge of the developer from the developer container 16 are controlled separately. More specifically, as illustrated in FIG. 16, the control device 32 includes a supervisory controller 40, and separately provided discharge controller 38 and supply controller 39. The solenoid 28, shown in FIGS. 1(*a*) and 1(*b*), 8 or 10, is driven when the copying counter 33 counts a predetermined count n under the control of the discharge controller 38. The carrier-developer supply roller 22, shown in FIG. 3, is driven based on, for example, a detection signal from the toner density sensor 34 under the control of the supply controller 39. A signal from the controller 38 and a signal from the controller 39 communicate with each other through the supervisory controller 40.

In the discharge controller 38, as illustrated in FIG. 17(*a*), the time to start discharging developer is determined when the copy count n reaches a set figure (Step 21). A discharge start signal is transmitted to the supervisory controller 40 (Step 22). The discharge controller 38 is kept in the standby state until it receives a discharge enabling signal from the supervisory controller 40 (Step 23). Upon the reception of the signal, discharging of developer is carried out in the same manner as in Steps 5 to 8 shown in FIG. 6 (Step 24).

In the supply controller 39, as illustrated in FIG. 17(*b*), for example, the time to start supplying the carrier developer is determined (Step 31) when the toner density sensor 34 detects the lowest value in the optimum range, and the toner is supplied. At this time, the supervisory controller 40 transmits the supply start signal (Step 32). The supply controller 39 goes into the standby state until it receives a supply enabling signal from the supervisory controller 40 (Step 33). Upon the reception of the signal, supplying is carried out in the same manner as in Steps 10 to 12 shown in FIG. 6 (Step 34).

As illustrated in FIG. 18, the supervisory controller 40 detects whether the supply controller 39 generates the supply start signal (Step 41). The supervisory controller 40 sets 1 as a supply timing flag F when the signal is generated (Step 42), or it sets 0 as F when the signal is not generated (Step 43). Subsequently, the supervisory controller 40 detects whether the discharge controller 38 generates the discharge start signal (Step 44). When the signal is generated, a discharge enabling signal is transmitted to the discharge controller 38 (Step 45). Consequently, discharging of developer is carried out under the control of the discharge controller 38, and the supervisory controller 40 becomes in the standby state until the discharging of developer is complete (Step 46).

When the discharging of developer is complete, the supervisory controller 40 detects if F is 1 or 0 (Step 47), and returns to Step 41 when F is 0 or transmits the supply enabling signal to the supply controller 39 when F is 1 (Step 48). The supply controller 39 then executes the supplying. When the supplying is complete (Step 49), the supervisory controller 40 returns to Step 41. When the supervisory controller 40 detects that no discharge start signal is generated, it returns to Step 47. Thus, when the supply start signal is generated (F=1), only the supplying is performed.

With this control, when the carrier developer is being supplied, the supervisory controller 40 does not accept a signal asking for discharging developer. Similarly, it does not accept a signal asking for supplying when the toner is being discharged. Namely, when one of the operations is complete, a signal enabling the other operation is transmitted to the discharge controller 38 or the supply controller 39 which is not performing operation. Since discharging of developer and supplying thereof are never carried out simultaneously, it is possible to prevent the newly supplied developer from being soon discharged. Thus, more efficient replacement is achieved, and good image quality of copies is maintained.

In this embodiment, even when the time to start supplying the developer comes, the supplying is not started right away, and it is detected whether it is the time for discharging developer. When the time to perform supplying developer and the time to perform discharging developer are substantially the same, discharging developer is performed prior to supplying developer. The reason for this is that, when the time to perform supplying developer and the time to perform discharging developer are substantially the same, if the supplying is performed just before discharging developer, the newly supplied developer which has not yet used much is also discharged. However, such a drawback is overcome by the above-mentioned control.

[EMBODIMENT 7]

Figure 19:
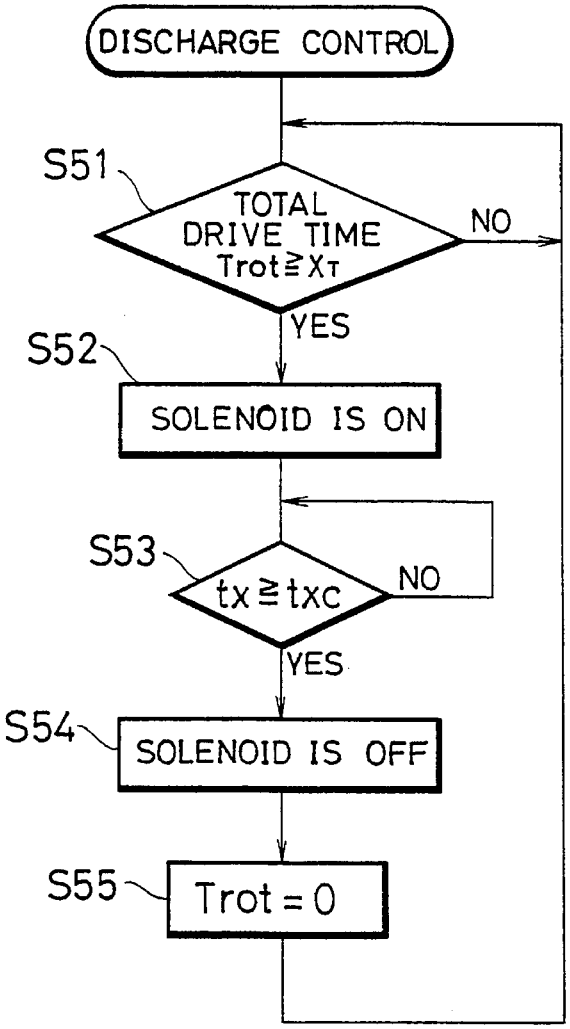
FIG. 19 is a flow chart of discharge process in a developing device according to still another embodiment of the present invention.
Figure 20:
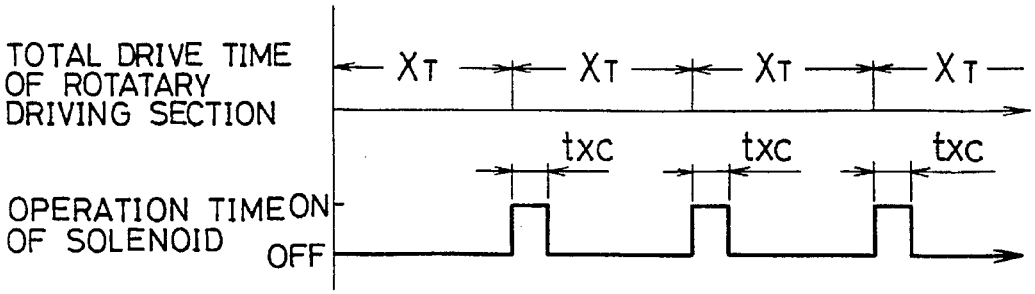
FIG. 20 is a timing chart of a discharge control cycle according to the embodiment of FIG. 19.

The following description discusses a seventh embodiment of the present invention with reference to FIGS. 19 and 20. The members having the same function as in the first through third embodiments will be designated by the same code and their description will be omitted.

In the first embodiment, the total number n of produced copies which is counted by the copy counter 33 is supervised. And when the number n reaches the set discharge and supply timing values $M_X$ and $M_Y$, the discharge of developer and the supply thereof are performed, respectively.

In a personal-type copying machine where the frequency of producing copies is relatively low and the power is turned on and off every time a small number of copies are made, the developer deteriorates faster compared to that in a high-speed copying machine in which a greater number of copies are made once the power is turned on. This is because that the developer roller 17 and the agitating roller 18 are preparatory rotated when warming up the copying machine after the power is switched on, and that the agitation of the toner and the carrier in the developer container 16 causes the developer to deteriorate. In such a copying machine, if the carrier developer is simply supplied and discharged when the total number of produced copies reaches the set-value changing figure, the replacement condition corresponding to the deterioration of developer can not be maintained, causing the image quality of copies to be degraded.

In this embodiment, the time to supply and the time to discharge the carrier developer are determined according to the total drive time of the developing roller 17 or the agitating roller as the rotary driving body in the developing device. FIG. 19 illustrates such a control of the discharge of the developer. In this case, if the developing roller 17 is driven when the power is on or during a copying operation, the total drive time $T_{rot}$ is read out and whether $T_{rot}$ reaches the discharge cycle set time $X_T$ is detected (Step 51). If $T_{rot}$ reaches $X_T$, the solenoid 28 is turned on (Step 52). This causes the discharge of the developer from the developer container 16 to be started, the discharge-time supervising timer to start measuring time, and the discharge of the developer to continue until the measured time $t_X$ reaches the set time $t_{XC}$ (Step 53). When $t_X$ reaches $t_{XC}$, the solenoid 28, shown in FIGS. 1(*a*) and 1(*b*) or FIGS. 8 or 10, is turned off (Step 54) to stop the discharge of the developer and to change the total drive time $T_{rot}$ to 0 (Step 55). Then, the control device 32, shown in FIG. 5, returns to Step 51.

Such an operation is performed under the control of device 32. Namely, with this control, as illustrated in FIG. 20, for example, every time the total drive time of the developing roller 17 reaches $X_T$, the solenoid 28 is activated and the discharge opening 24 is opened for the period of $T_{XC}$. As a result, an amount of developer corresponding to the time in which the discharge opening 24 is opened is discharged from the developer container 16 into the collecting container 23.

Thus, by supplying the carrier developer and discharging the developer while supervising the total drive time of the developing roller 17, the replacement of developer is performed according to the deterioration of the developer. It is therefore possible to maintain good image quality of copies for a long time. This structure is also suitable for a personal-type copying machine in which the frequency of performing copying is relatively low.

[EMBODIMENT 8]

Figure 21:
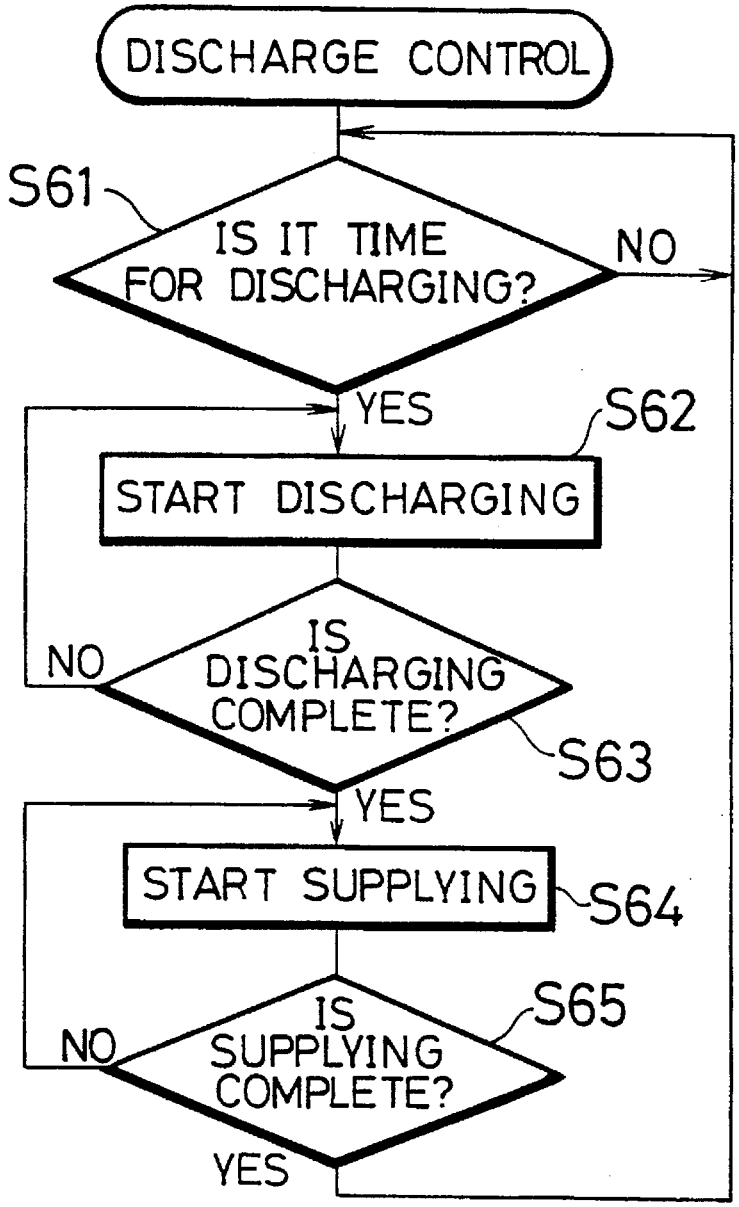
FIG. 21 is a flow chart of supply and discharge control processes in a control device according to still another embodiment of the present invention.

The following description discusses an eighth embodiment of the present invention with reference to FIG. 21. The members having the same function as in the first through third embodiments will be designated by the same code and their description will be omitted.

Similar to the first embodiment, the developing device of this embodiment discharges the developer from the developer container 16 according to the copy count n, and supplies the developer to the developer container 16 after discharging the developer. The control device 32, shown in FIG. 5, controls the discharge and supply of the developer in the manner shown in FIG. 21.

More specifically, as illustrated in FIG. 21, for example, the time to start discharging developer is detected when the copy count n reaches the set figure (Step 61). Then, the solenoid 28 shown in FIGS. 1(*a*) and 1(*b*), FIGS. 8 or 10 is activated to execute the discharging of developer (Step 62) in the same manner as in Steps 5 to 8 shown in FIG. 6. When the discharging of developer is complete (Step 63), the carrier-developer supply roller 22, shown in FIG. 3, is activated to start supplying carrier developer (Step 64) in the same manner as in Steps 10 to 12 of FIG. 6. When the supplying is complete (Step 65), the control device 32 returns to Step 61.

With this control, since the newly supplied developer is not soon discharged, more efficient replacement is achieved. As a result, the consumption of the developer is reduced and good image quality of copies are maintained.

In the case when discharging the developer and supplying the carrier developer are not controlled in the above-mentioned manner, in order to prevent the newly supplied developer from being soon discharged, it is necessary to restrict the locations where the carrier developer is supplied and the discharge opening 24 is placed. For instance, the location at which the carrier developer is supplied from the developer supply unit 20 is arranged on one side of the developer container 16, and the discharge opening 24 is placed on the other side thereof. On the other hand, if discharging the developer and supplying the carrier developer are controlled in the above-mentioned manner, it is possible to prevent the newly supplied developer from been soon discharged without restricting the location for suppling the carrier-developer and the location of the discharge opening 24. Therefore, the positions of the developer supply unit 20 and the .collecting container 23 are relatively freely determined, allowing a more compact and simplified developing device.

[EMBODIMENT 9]

Figure 22:
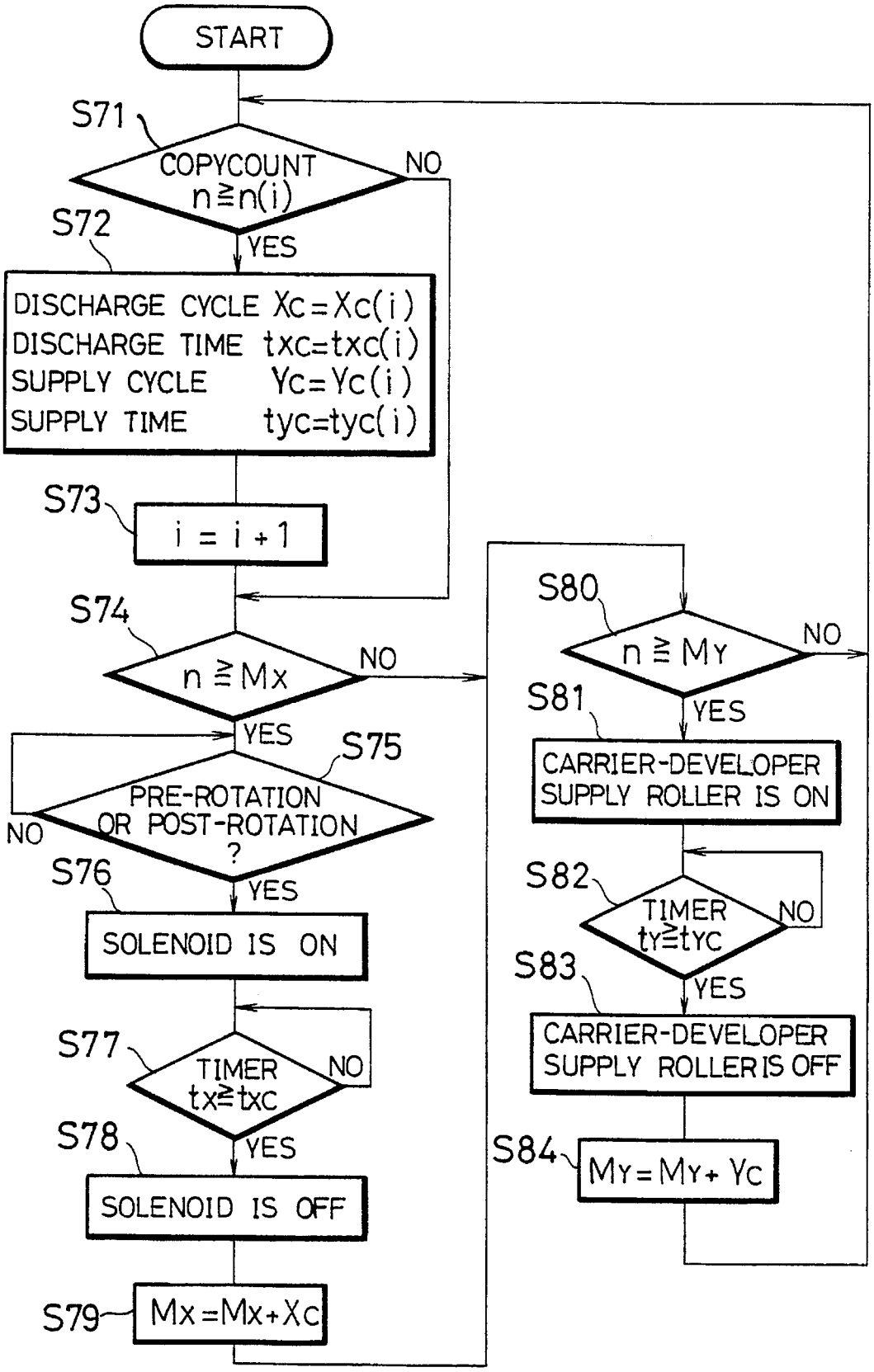
FIG. 22 is a flow chart of supply and discharge control processes in a control device according to still another embodiment of the present invention.
Figure 23:
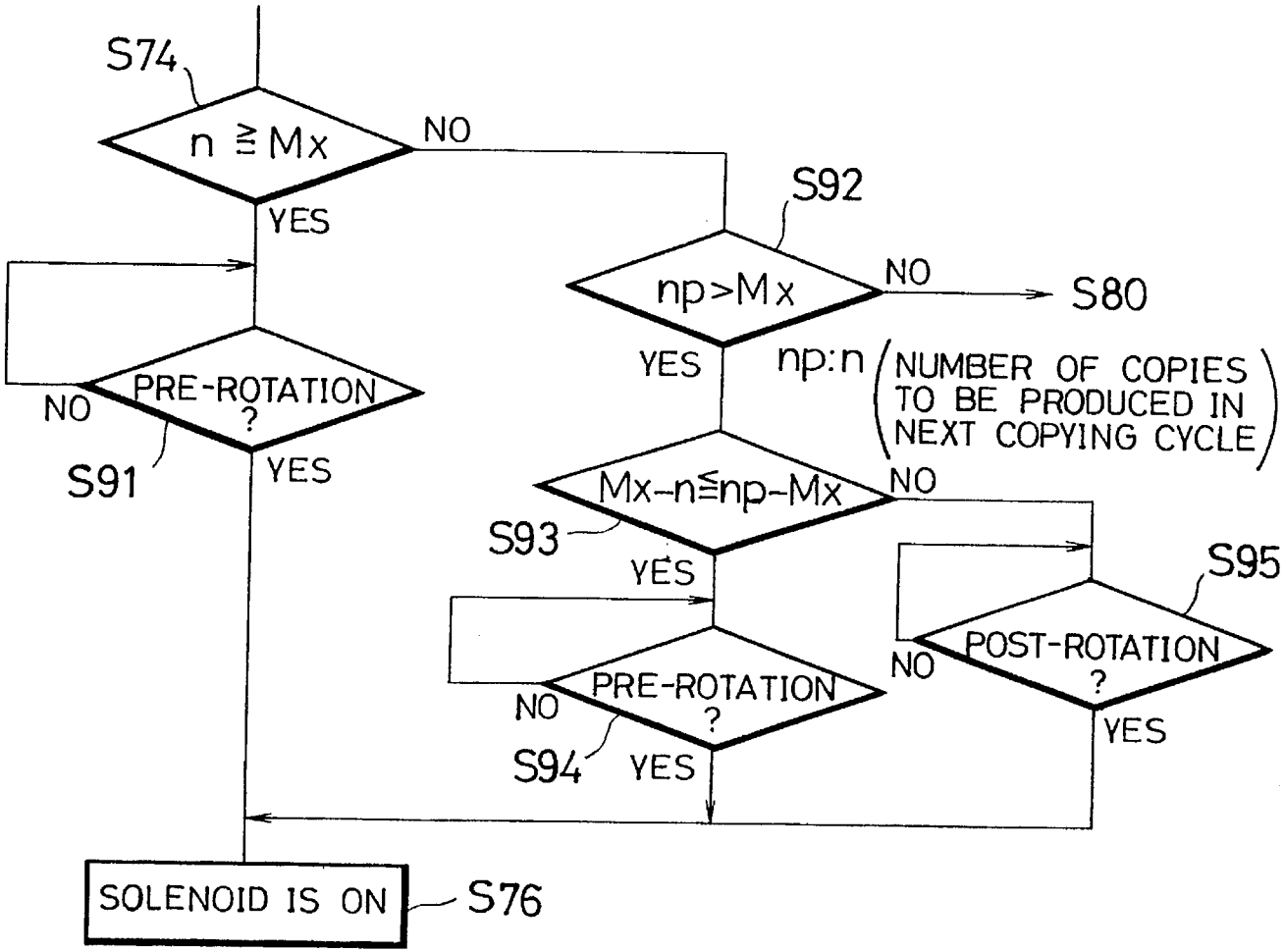
FIG. 23 is a flow chart of an alternative example of the discharge process of FIG. 22.

The following description discusses a ninth embodiment of the present invention with reference to FIGS. 22 and 23. The members having the same function as in the first through third embodiments will be designated by the same code and their description will be omitted.

In the developing device of this embodiment, like the developing device of the first embodiment, the supply of the carrier developer to the developer container 16 is carried out according to a copy count n, and the discharge of the developer from the developer container 16 is performed during a pre-rotation or post-rotation of a photoreceptor 4, shown in FIG. 2, at the time the copy count n reaches a predetermined figure.

The pre-rotation or post-rotation is performed to make the surface potential of the photoreceptor 4 uniform by charging and discharging the photoreceptor 4 because variations in the surface potential cause variations in image quality. The pre-rotation is performed before the photoreceptor 4 starts an image forming operation when the copying start switch 31 is turned on. The post-rotation is performed after the photoreceptor 4 completes the image forming operation. Here, the post-rotation does not refer to rotations of the photoreceptor 4 performed after each copying operation when a plurality of copies are consecutively produced, but refers to a rotation of the photoreceptor 4 carried out after a predetermined number of consecutive copying operations are performed. During the pre-rotation and post-rotation of the photoreceptor 4, the developing roller 17 and the agitating member (the agitating roller 18 or agitating screw 18') in the developer container 16 rotate.

In order to perform the above operations, the control device 32 operates as shown in FIG. 22. As illustrated in FIG. 22, for example, the time to start discharging developer is detected when the copy count reaches a set figure (Step 74). The control device 32 is kept in a stand-by state until the pre-rotation or post-rotation is started. During the pre-rotation or post-rotation (Step 75), the solenoid 28 shown in FIGS. 1(*a*) and 1(*b*), FIGS. 8 or 10 is activated to discharge the developer (Steps 76 to 79). Subsequently, the time for supplying developer is detected when the copy count n reaches a set figure (Step 80). The control device 32 activates the carrier-developer supply roller 22 of FIG. 3 to execute the discharging of developer (Steps 81 to 84). The control device 32 then returns to Step 71. The operations in Steps 71 to 74 of FIG. 22 and of Steps 76 to 84 are the same as those performed in Steps 1 to 4 of FIG. 6 and of Steps 5 to 13.

With this control, the discharging of developer is performed either in the course of the pre-rotation or the post-rotation so that discharging is performed when the copy count n becomes closest to the set value $M_X$. In this case, as illustrated in FIG. 23, for example, when the time to start discharging developer is detected at the time copy count n reaches the set value $M_X$ (Step 74), the control device 32 is kept in the stand-by state until the pre-rotation is started and executes discharging during the pre-rotation (Step 91). The following description discusses the case where the copy count n does not reach the set value $M_X$ in Step 74, the number of copies to be produced in the next sequence of copying operations is more than one and the copy count $n_p$ to be obtained after making those copies exceeds the set value $M_X$ (Step 92). In this case, when $M_X-n \leqq n_p-M_X$ (Step 93), i.e., when the difference between the set value $M_X$ and the copy count n becomes smaller than the difference between the copy count $n_p$ and the set value $M_X$, the developer is discharged during the pre-rotation at the present copy count n. In Step 93, when the difference between the copy count n and the set value $M_X$ becomes greater the difference between the copy count $n_p$ and the set value $M_X$, i.e., $M_X-n>n_p-M_X$, the developer is discharged during the post-rotation after the copying operation (Step 95). With this control, for example, in the case when the set value $M_X$, the present copy count n and the number of copies to be produced in the next series of copying operations are 1000, 999 and 100, respectively, if the discharge of developer is arranged to be performed during the post-rotation after the copying operations, the developer is discharged after the 1099th copying operation which greatly exceeds the set value $M_X$. On the other hand, if the discharge of developer is arranged to be performed during the pre-rotation before the copying operations, the developer is discharged at a copy count n which is almost equal to the set value $M_X$.

By controlling the developer to be discharged during the pre-rotation or the post-rotation, the developer in the developer container 16 is agitated by the agitating member when being discharged. This control prevents the deteriorated developer from staying in one location, thereby allowing a necessary amount of developer to be efficiently discharged. Since the replacement of the deteriorated developer with the supplied carrier developer is efficiently carried out, the overall consumption of the developer is reduced. In addition, since the developer is not discharged from the developer container 16 at least during copying but is discharged during the pre-rotation or post-rotation, a change in the amount of the developer in the developer container 16 is restricted during the copying operation. As a result, a change in image quality such as a variation in the density due to the change in the developer amount is minimized, restraining the image quality from being degraded.

[EMBODIMENT 10]

The following description discusses a tenth embodiment of the present invention with reference to FIGS. 24 through 30. The members having the same function as in the first through third embodiments will be designated by the same code and their description will be omitted.

In the developing device of this embodiment, developer in the developer container 16 whose life has expired is not used for development since such developer is consecutively replaced by supplying new carrier developer from the developer supply unit 20 to the developer container 16 shown in FIG. 3 and discharging the deteriorated developer from the developer container 16. Assuming that the predetermined effective life of the developer indicated by a copy count n is a useful life of developer and that an interval between a series of suppling and discharging developer and the next series which is indicated by a copy count is a developer replacement interval, the carrier-developer supply roller 22 and the shutter mechanism 25 are activated under the control of the control device 32 shown in FIG. 5 so that an amount of developer which is greater than the amount of developer in the developer container 16/(developer's useful life/developer replacement interval) is supplied to and discharged from the developer container 16. The replacement amount is determined as follows.

When supplying the carrier developer from the developer supply unit 20 to replace the deteriorated developer in the developer container 16, assuming that the newly supplied developer is evenly filled in the developer container 16 within an extremely short time, the useful life of the developer in the developer container 16 is given by the following equation.

$$A=P\{(1-\alpha)-(1-\alpha)^{n/P+1}\}/\alpha \quad (1)$$

where A is the life expectancy of the developer in the developer container 16 (hereinafter referred to as developer's life), α is the ratio of the deteriorated developer in the developer container 16 to be replaced with new developer to the developer in the developer container 16 by weight (hereinafter referred to as developer replacement ratio), P is the copy count at which the deteriorated developer in the developer container 16 is replaced with the new developer (hereinafter referred to as a replacement interval), and n is a copy count, and where each symbol is represented by a unit defining the copy count 1000 as 1k.

How the equation (1) is obtained is explained below. The toner density of the developer in the developer container 16 is uniform.

Firstly, assuming that the life of arbitrary developer in the developer container 16 is Li and that the ratio of developer with the life Li to the entire developer in the developer container 16 by weight is βi, the developer's life A is $$A=\sum_{i=0}^{n} Li\cdot\beta i \quad (2)$$

Figure 24:
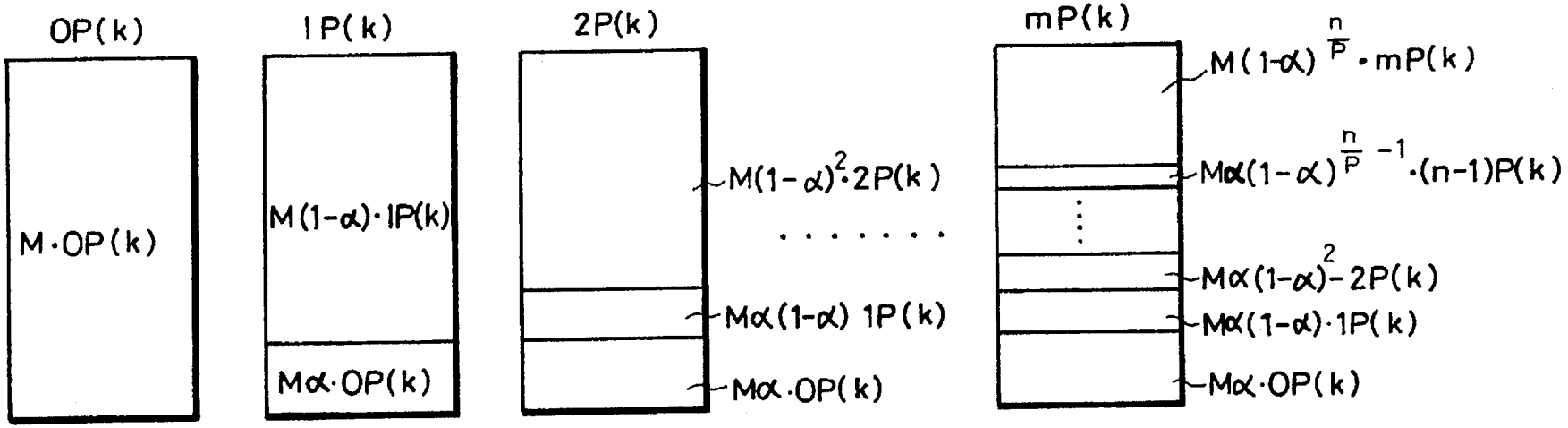
FIG. 24 is an explanatory view of still another embodiment of the present invention explaining changes in the life of developer in the developer container when the entire amount, Mg, of developer in the developer container is replaced at 100 $\alpha$% ratio every Pk, wherein k=1000 copies.

When Mg that is the total amount of developer in the developer container 16 is replaced at 100 α% ratio every Pk, the developer's life changes as shown in FIG. 24. For example, in the case where Mg is 500 g and the developer replacement ratio α is 1% or 5 g, changes in the developer's life are shown in FIG. 25. 0P(k) in FIG. 24 represents the initial state where the developer in the developer container 16 has not deteriorated at all, 1P(k), 2P(k) . . . represent the number of times replacement is performed, such as a first replacement and a second replacement. The numeric numbers such as 1 and 2 on the left and the top of the table in FIG. 25 correspond to the number of times replacement is performed such as 1P(k), 2P(k) . . . , while the horizontal rows indicate the amount of developer held in the developer container 16 after replacement.

The developer's life was calculated from FIGS. 24 and 25, and the results are given below.

$$\begin{aligned}
0P(k): A &= (1/M)\,(0P \times M) \qquad (3)\\
1P(k): A &= (1/M)\,\{0P \times M\alpha + 1P \times M(1-\alpha)\}\\
2P(k): A &= (1/M)\,\{0P \times M\alpha + 1P \times M\alpha(1-\alpha) + 2P \times M(1-\alpha)^2\}\\
\ldots & \quad \ldots\\
nP(k): A &= (1/M)\,\{0P \times M\alpha + 1P \times M\alpha(1-\alpha) + 2P \times M\alpha(1-\alpha)^2 + \ldots + (n-1)P \times M\alpha(1-\alpha)^{n/P-1} + mP \times M(1-\alpha)^{n/P}\} \quad (mP = n)
\end{aligned}$$

Therefore, if the equation (3) showing the developer's life A after nP(k) is given by the general formula, when $0<\alpha\leqq 1$, $$A=P\{(1-\alpha)-(1-\alpha)^{n/P+1}\}/\alpha \qquad (1)$$

and when $\alpha=0$,

A=n

The following description explains in more detail how the equation (1) is obtained. According to the equation (3), $$A=1P\cdot\alpha(1-\alpha)+2P\cdot\alpha(1-\alpha)^2+\ldots+(m-1)P\cdot\alpha(1-\alpha)^{n/P-1}+mP(1-\alpha)^{n/P}\} \qquad \text{(i)}$$

and $$(1-\alpha)A = 1P\cdot\alpha(1-\alpha)^2+\ldots+(m-2)P\cdot\alpha(1-\alpha)^{n/P-1}+(m-1)P\cdot\alpha(1-\alpha)^{n/P}+mP(1-\alpha)^{n/P+1}\} \qquad \text{(ii)}$$

By (i)–(ii), $$\alpha A=P\alpha(1-\alpha)+P\alpha(1-\alpha)^2+\ldots+P\alpha(1-\alpha)^{n/P-1}+P\alpha(1-\alpha)^{n/P}$$

(a) When $\alpha\neq 0$, $$A=P(1-\alpha)+P(1-\alpha)^2+\ldots+P(1-\alpha)^{n/P-1}+P(1-\alpha)^{n/P} \qquad \text{(iii)}$$

$$(1-\alpha)A=P(1-\alpha)^2+\ldots+P(1-\alpha)^{n/P-1}+P(1-\alpha)^{n/P}+P(1-\alpha)^{n/P+1} \qquad \text{(ix)}$$

By (iii)–(ix)

$$\alpha A=P\{(1-\alpha)-(1-\alpha)^{n/P+1}\}A=P\{(1-\alpha)-(1-\alpha)^{n/P+1}\}/\alpha \qquad (1)$$

(b) When $\alpha=0$, according to the equation (3)

A=n and when $\alpha\rightarrow 0$, according to equation (1),

A=n

The equation (1) thus obtained shows the relationship between the developer replacement ratio and replacement interval (copy count n) and the developer's life.

Figure 26:
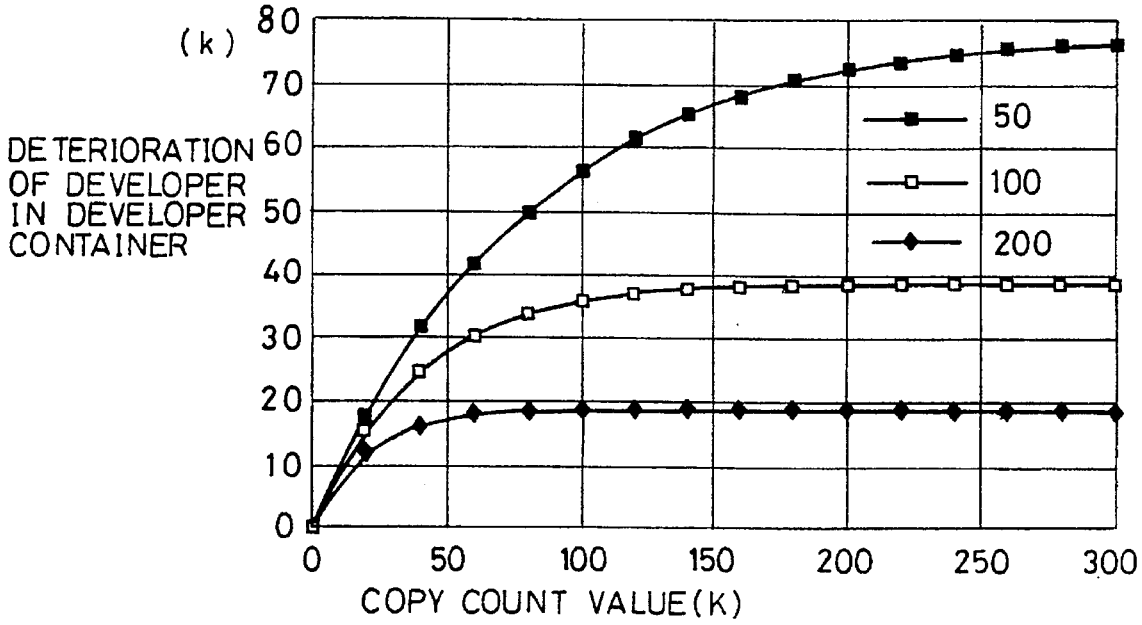
FIG. 26 is a graph showing the relationship between the copy count and the deterioration of developer in the developer container when an amount of developer supplied to the developer container and an amount of developer discharged from the developer container are the same, the useful life of the developer is 40k, the replacement interval is 1k, the amount of developer in the developer container is 500 g, and the amount of developer to be replaced is 12.5 g which is indexed as 100.

The relationship between the copy count n and the deterioration of the developer in the developer container 16 is examined under the condition where the same amount of developer is supplied to and discharged from the developer container 16. For example, the developer's useful life, the replacement interval and the amount of developer in the developer container 16 are set to 40k, 1k and 500 g, respectively, and a replacement amount of 12.5 g is indexed at 100. As shown in FIG. 26, according to the results, when the copy count n becomes extremely large at the time 50 g, 100 g and 200 g of developer is replaced, the deterioration of the developer in the developer container 16 stops at certain levels. Thus, by determining the replacement amount of developer to prevent the deterioration of the developer in the developer container 16, i.e., the developer's life A from exceeding its useful life, the developer has a life as long as or longer than the life of the copying machine. This is achieved by satisfying the following requirement.

$$A_L \geqq A \qquad (4)$$

where $A_L$ is the developer's useful life.

The following equation (5) is derived from the equations (1) and (4).

$$M\alpha \geqq M/(A_L/P) \qquad (5)$$

According to the equation (5), it is possible to give to the developer a life as long as or longer than the useful life of the electrophotographic apparatus by supplying and discharging an amount of developer which is not less than an amount, the developer in the developer container 16/(developer's useful life/developer replacement interval). This arrangement enables the developing device in this embodiment to prevent the charge of the developer from being lowered and to maintain good image quality.

As for the structure of such a developing device, for instance, in the developing device of the first embodiment, the control device 32, shown in FIG. 5, controls the solenoid 28 shown in FIGS. 1(*a*) and 1(*b*), FIGS. 8 or 10 and the carrier-developer supply roller 22 shown in FIG. 3 to replace the above-mentioned amount of the developer every time replacement is performed.

Also, the following results are obtained from the examination of the replacement interval and the replacement amount of the developer in the developer container 16.

When the interval between the supply of a predetermined amount of the carrier developer to the developer container 16 and the discharge of the developer from the developer container 16 is made longer, a great amount of developer is replaced. This causes the developing properties of developer in the developer container 16 greately changes before and after replacement, resuting in a significant change in the image quality of copies. Additionally, the possibility of discharging the newly supplied developer together with the deteriorated developer becomes higher. As a result, the deterioration of the developer in the developer container 16 tends to increase. Such problems are prevented by shortening the developer replacement interval and by supplying and discharging a predetermined amount of developer over a plurality of times. The reasons for this are discussed below.

The life expectancy of the developer in the developer container 16 after replacement is given by the equation (1)

$$A=P\{(1-\alpha)-(1-\alpha)^{n/P+1}\}/\alpha \qquad (1)$$

Based on the equation (1), the life expectancy B of the developer in the developer container 16 before replacement is given by the equation (6).

$$B=P\{(1-\alpha)-(1-\alpha)^{n/P+1}\}/\alpha+P \qquad (6)$$

Based on the equations (1) and (6), a change D in the life expectancy of the developer in the developer container 16 before and after replacement is given by the equation (7)

$$D = B - A = P \times \{1 - (1 - \alpha)^{n/P}\} \quad (7)$$

The equation (7) represents the relationship between the developer replacement ratio α, replacement interval P and copy count n and the change D in the life expectancy of the developer in the developer container 16. According to the equation (7), as the copy count n increases, the change D in the life expectancy of the developer becomes greater, causing saturation at the replacement interval P. Namely, the maximum value of the change D in the life expectancy of the developer is equal to a replacement interval.

Figure 27:
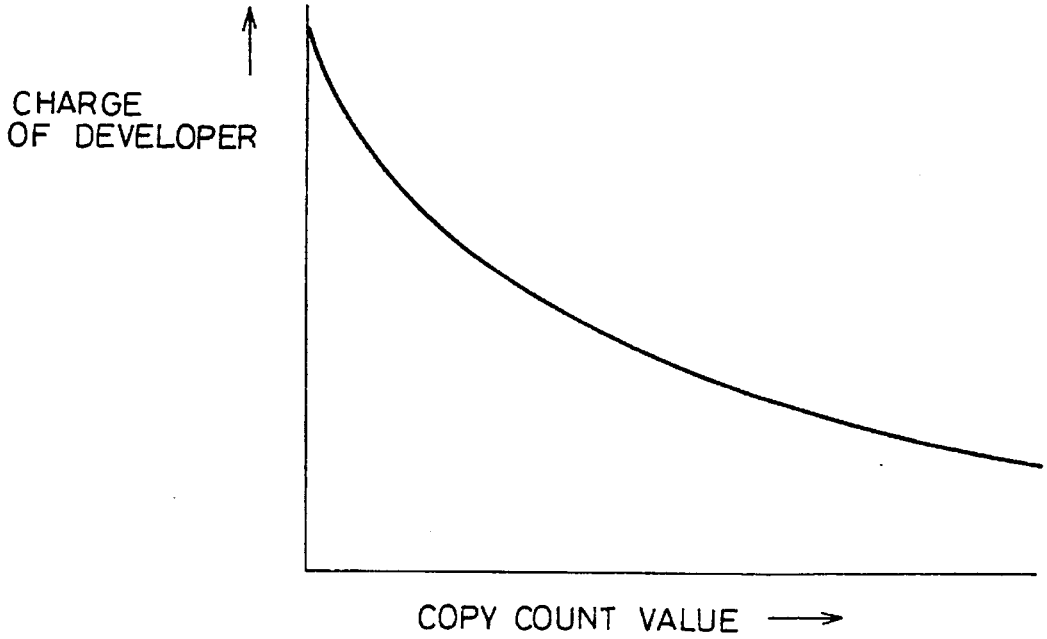
FIG. 27 is a graph showing the general relationship between the copy count and a charge of developer.

The general relationship between the copy count n and the charge of the developer is shown in FIG. 27. It is well known that a variation in the charge causes a change in the density of the copied images. In addition, experiments show that, a 1k or 1000 difference in the copy count n causes a change in the charge of the developer. Therefore, by setting P≦1k, the difference in the density of the copied images before and after replacement is eliminated, so that the user of the copying machine does not feel any differences in the image quality.

Figure 28:
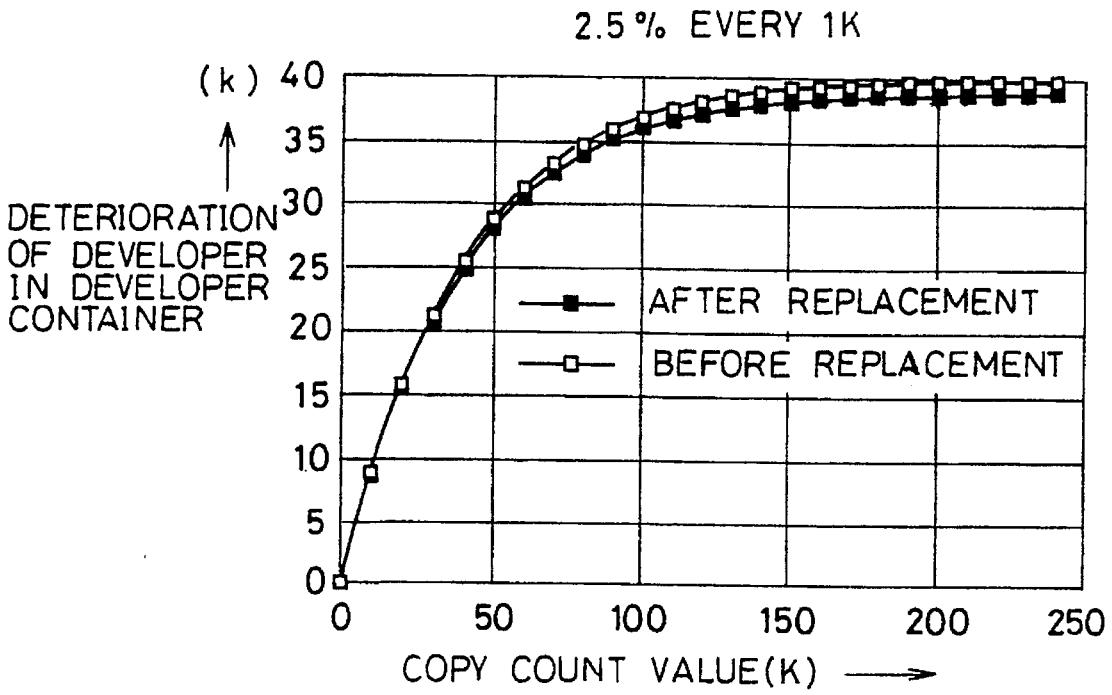
FIG. 28 is a graph showing the relationship between the copy count and the deterioration of developer in the developer container when 2.5% of developer in the developer container is replaced every 1k.
Figure 29:
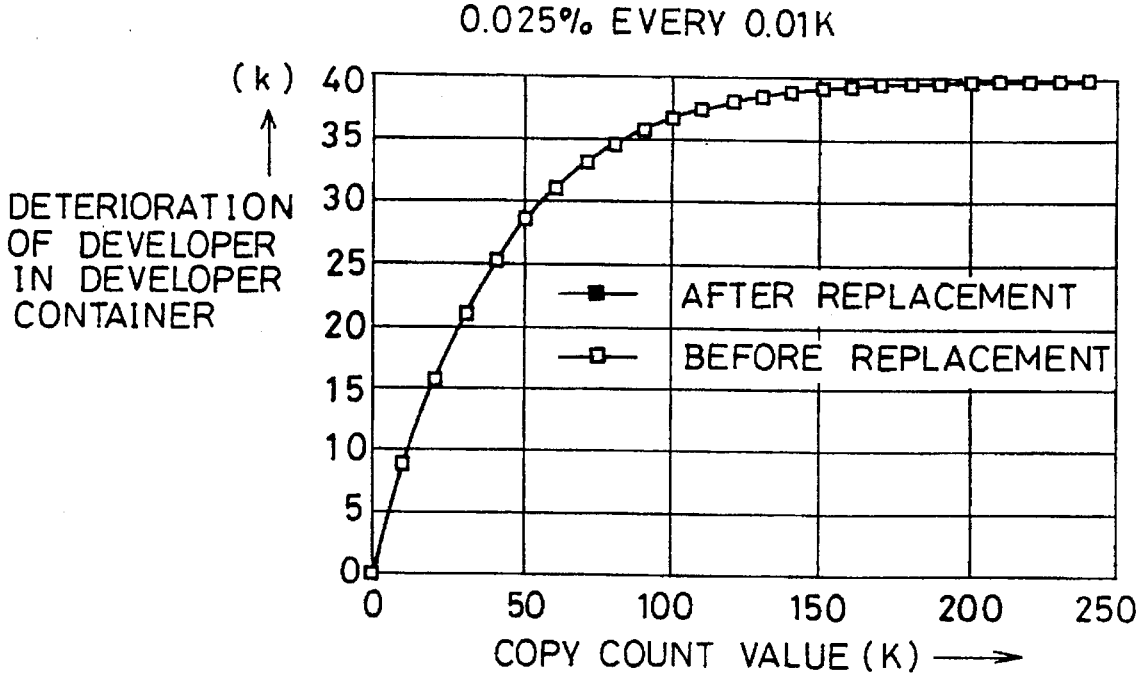
FIG. 29 is a graph showing the relationship between the copy count and the deterioration of developer in the developer container when 0.025% of developer in the developer container is replaced every 1k.

For example, the deterioration of the developer in the developer container 16 before and after replacement was measured by replacing an equal amount of developer at an every predetermined copy count up to 240k. When 2.5% of the developer was replaced every 1k, the results shown in FIG. 28 were obtained. When 0.025% of the developer was replaced every 0.01k, the results shown in FIG. 29 were obtained. A change in the degree of the deterioration of the developer before and after replacement is shown in FIG. 28, while no change is seen in FIG. 29.

Figure 30:
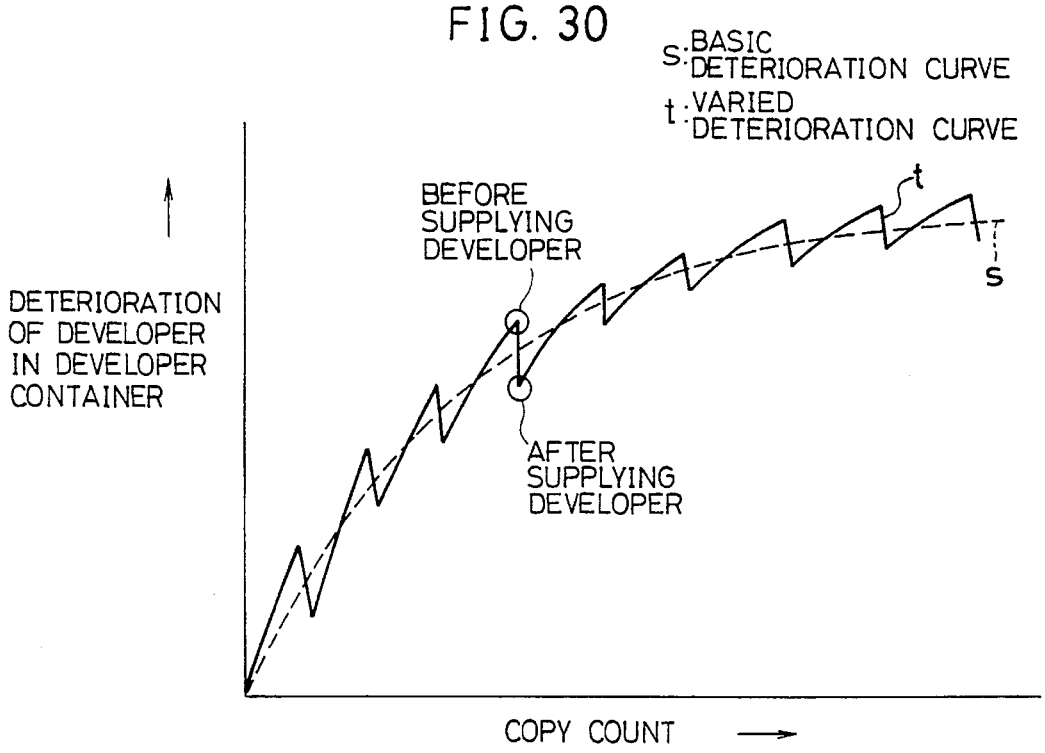
FIG. 30 is a graph showing the relationship between varied deterioration curve t and basic deterioration curve s before and after replacement of developer in the developer container.

As described above, within the life of the copying machine, when a predetermined amount of developer is replaced over a greater number of times, the difference between the basic deterioration curve s of FIG. 30 and the varied deterioration curve t representing changes in the degree of deterioration of developer in the developer container 16 before and after replacement is minimized. It is therefore possible to restrict the change in the developing properties of the developer before and after replacement, diminishing variations in the image quality of copies.

[EMBODIMENT 11]

Figure 31:
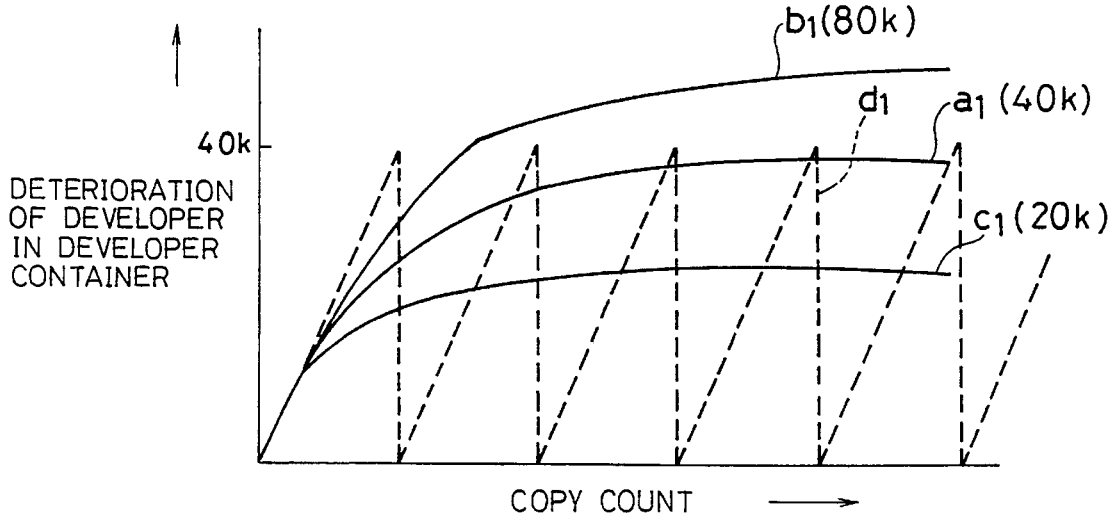
FIG. 31 is a graph showing the relationship between the copy count and the deterioration of developer in the developer container when two types of developer having different life expectancies are supplied.
Figure 32:
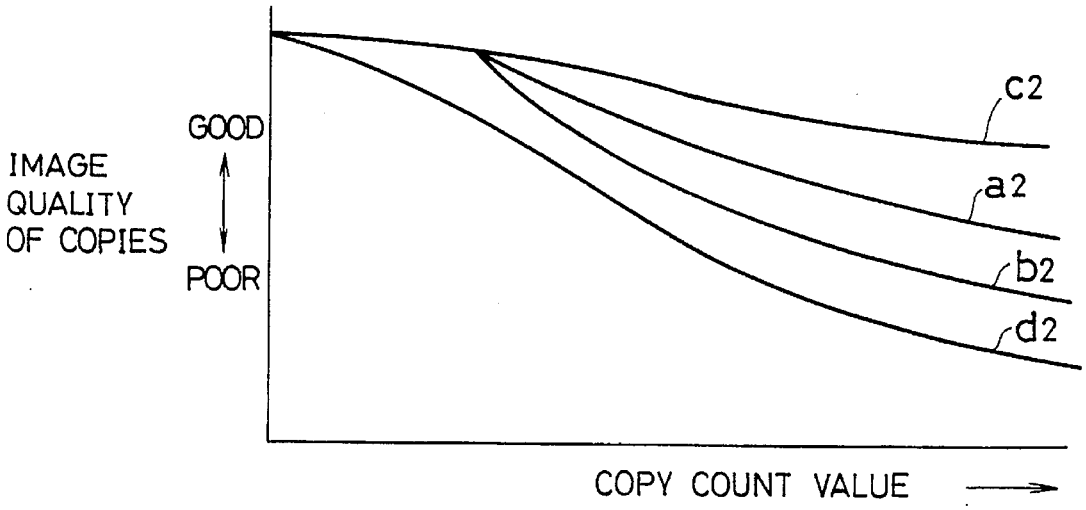
FIG. 32 is a graph showing the relationship between the copy count and the image quality of copies.

The following description discusses an eleventh embodiment of the present invention with reference to FIGS. 31 and 32. The members having the same function as in the above-mentioned embodiments will be designated by the same code and their description will be omitted.

In the developing device of this embodiment, the carrier-developer storage **20*b* of the developer supply unit 20 shown in FIG. 3 stores carrier developer whose life expectancy is shorter than that of the developer initially stored in the developer container 16. Namely, the carrier developer having a shorter life expectancy is supplied from the carrier-developer storage 20*b* to the developer container 16. The supply of the carrier developer from the carrier-developer storage 20*b* to the developer container 16 and the discharge of the developer from the developer container 16 are controlled by the control device 32, shown in FIG. 5, according to the life of the carrier developer. More specifically, the control device 32 controls the entire developer in the developer container 16 to be replaced before the life of the carrier developer ends. Or the supply and discharge of the developer is controlled so that the deterioration of the developer in the developer container 16, which is calculated by assuming that the life of the developer initially stored in the developer container 16** is equal to that of the carrier developer, does not exceed the life expectancy of the carrier developer.

Figure 6:
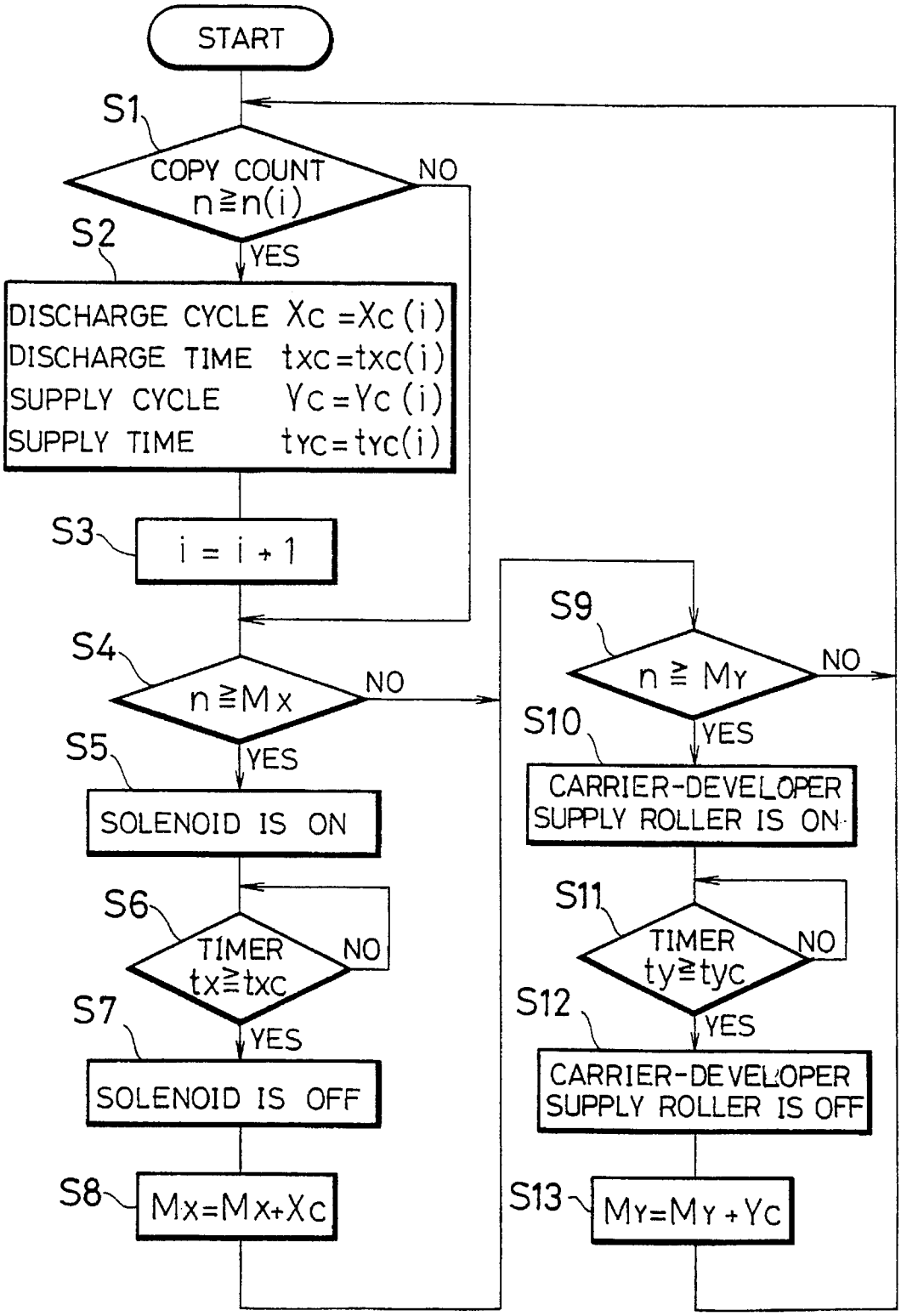
FIG. 6 is a flow chart of supply and discharge control processes in a control device of the copying machine.

The supply of the carrier developer from the carrier-developer storage **20*b* and the discharge of the developer from the developer container 16 are controlled in the manner shown in FIGS. 6, 7**(*a*) and 7(*b*) of the first embodiment, FIGS. 16 through 18 of the sixth embodiment, or in FIGS. 19 and 20 of the seventh embodiment.

With this control, in the developing device, it is possible to prevent the developer in the developer container 16 approaching the end of its expected life from being used. Namely, this control prevents the developer which has considerably deteriorated from being used. Since the degradation of image quality is prevented, it is possible to maintain initial good image quality.

The following description discusses the above-mentioned function.

In the case when the supply of the carrier developer to the developer container 16 and the discharge of the developer from the developer container 16 are controlled according to the life expectancy of the carrier developer, the relationship between the deterioration of the developer in the developer container 16 calculated from the life expectancy of developer in the developer container 16 and a copy count varies depending on the life expectancy of the carrier developer supplied as shown in FIG. 31. In FIG. 31, the curved line $a_1$ shows their relationship when the life expectancy of the developer in the developer container 16 and that of the carrier developer to be supplied are both 40k, the curved line $b_1$ shows the relationship when the life expectancy of the developer in the developer container 16 is 40k and that of the carrier developer to be supplied is 80k, the curved line $c_1$ shows the relationship when the life expectancy of the developer in the developer container 16 is 40k and that of the carrier developer to be supplied is 20k, and the curved line $d_1$ shows the relationship when the developer with the life expectancy of 40k is stored in the developer container 16 and the entire developer in the developer container 16 is replaced at every copy count n without gradually supplying and discharging the developer. The following facts are found from FIG. 31.

When the carrier developer whose life expectancy is the same as that of the developer in the developer container 16 is supplied (curved line $a_1$), as the copy count increases, the developer which has deteriorated to the level near 40k is used for a long time. In the case when the carrier developer whose life expectancy is longer than that of the developer in the developer container 16 is supplied (curved line $b_1$), as the copy count increases, the developer deteriorates to a level exceeding 40k that is the life expectancy of the developer stored initially in the developer container 16 and is used in this state. In the case when the carrier developer whose life expectancy is shorter than that of the developer in the developer container 16 is supplied (curved line $c_1$), although the condition of the developer in the developer container 16 becomes worse as the copy count increases, the deterioration of the developer is far below the level of the life expectancy of 40k of the developer in the developer container 16. In the case when the entire amount of developer is replaced every predetermined copy count n (curved line $d_1$), the developer deteriorates substantially tangentially from 0 level which is the level during replacement to 40k and returns to 0 level after replacement. The relationship between the image quality of copies and the copy count is shown in FIG. 32. Curved lines $a_2$, $b_2$ and $c_2$ of FIG. 32 correspond to the curved lines $a_1$, $b_1$ and $c_1$, respectively, and the curved line $d_2$ represents changes in the image quality of copies when the developer having a life expectancy 40k in the developer container 16 is not replaced. It is understood from this figure that, when the carrier developer whose life expectancy is shorter than that of the developer in the developer container 16 is chosen to be supplied, good image quality is maintained.

Moreover, the cost of developer having a shorter life expectancy is lower than the cost of developer having a longer life expectancy. Therefore, the use of developer having a shorter life as carrier developer to be supplied and increasing the frequency of replacement do not simply lead to an increase in costs.

[EMBODIMENT 12]

Figure 33:
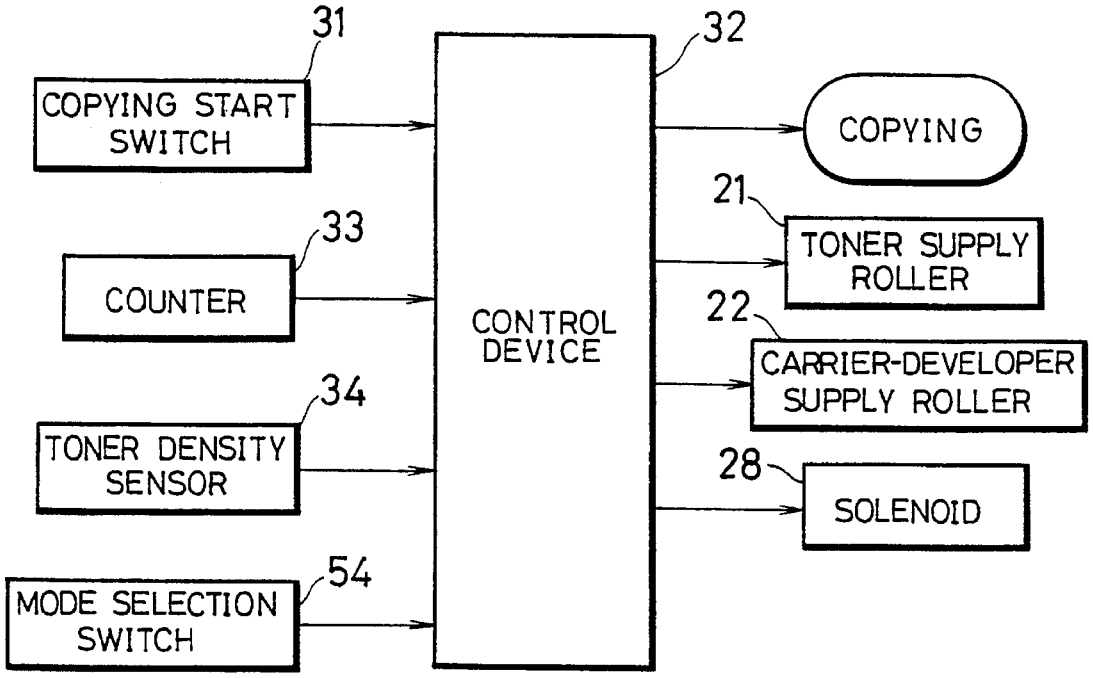
FIG. 33 is a block diagram of a control system of a copying machine according to still another embodiment of the present invention.
Figure 34:
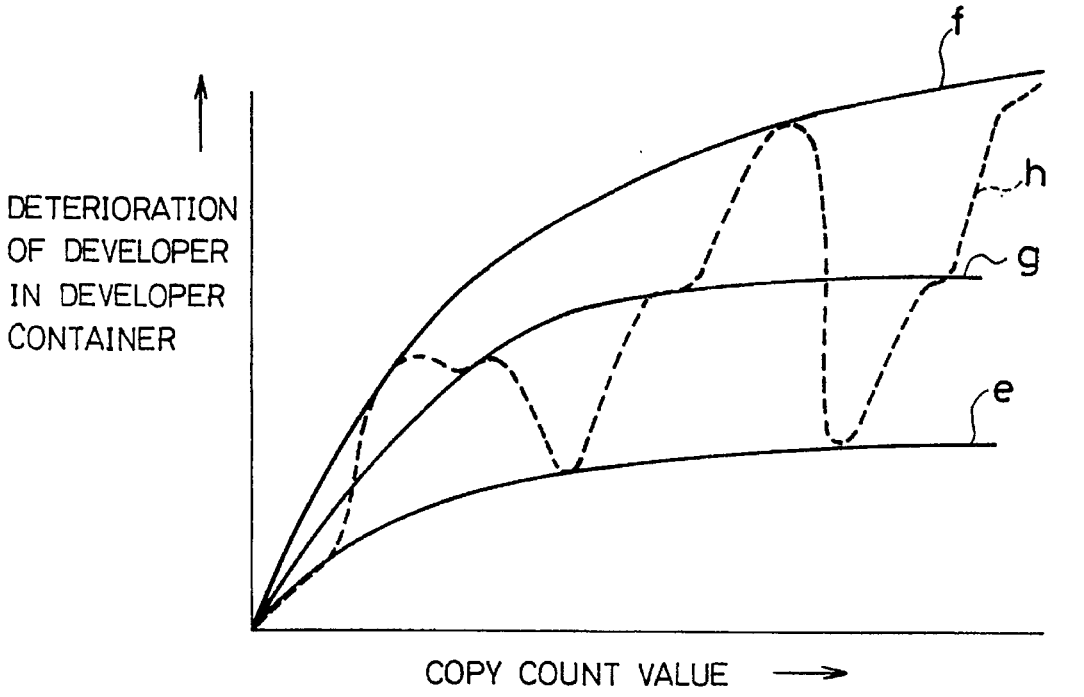
FIG. 34 is a graph showing the relationship between the copy count and the deterioration of developer in the developer container in an improved image-quality mode (curved line e), a developer saving mode (curved line f) and in a normal mode (curved line g) of the copying machine.

The following description discusses a twelfth embodiment of the present invention with reference to FIGS. 33 and 34. The members having the same function as in the first through third embodiments will be designated by the same code and their description will be omitted.

In the developing device of this embodiment, the amount of the carrier developer to be supplied to the developer container 16 from the carrier-developer storage **20*b* and the amount of the developer to be discharged from the developer container 16**, i.e., the amount of the developer to be replaced by a single replacement operation are selectable. More specifically, in this developing device, it is possible to select a mode from a developer saving mode, an improved image-quality mode, and a normal mode. In the improved image-quality mode, improving the image quality has priority over economical efficiency, and a relatively large amount of developer is replaced by a single replacement operation. In the developer saving mode, on the other hand, economical efficiency has priority over the improvement of image quality, and a relatively small amount of developer is replaced in a single replacement operation. In the normal mode, the amount of developer to be replaced in a single replacement operation is set between the replacement amount in the improved image-quality mode and that in the developer saving mode.

The control panel, not shown, of the copying machine has a mode selection switch 54 as mode selecting means for selecting a mode as shown in FIG. 33. The control device 32 controls the carrier-developer supply roller 22 and the solenoid 28, shown in FIGS. 1(*a*) and 1(*b*), FIGS. 8 or 10, to be activated so that the developer in the developer container 16 is replaced according to a mode selected through the mode selection switch 54.

With this structure, for example, the supply of carrier developer to the developer container 16 and the discharge of developer from the developer container 16 are performed through the processes shown in FIG. 6 of the first embodiment. In the improved image-quality mode, the discharge time $t_{XC}$ and the supply time $t_{YC}$ are set relatively longer compared to those set in the other modes. Namely, a relatively large amount of carrier developer and of developer are supplied/discharged, i.e., a relatively large amount of developer in the developer container 16 is replaced. On the other hand, when the developer saving mode is selected, the discharge time $t_{XC}$ and the supply time $t_{YC}$ are relatively shorter compared to those set in the other modes, and a relatively small amount of developer in the developer container 16 is replaced. In the normal mode, the discharge time $t_{XC}$ and the supply time $t_{YC}$ are set between those set in the improved image-quality mode and the developer saving mode, and an amount of the developer between those of the other two modes is replaced.

With this control, the relationship between the deterioration of developer in the developer container 16 and the copy count becomes as shown by the curved line e of FIG. 34 in the improved image-quality mode. In the developer saving mode the relationship becomes as shown by the curved line f, and in the normal mode it becomes as shown by the curved line g. When modes are suitably switched, the relationship varies as shown by the curved line h. The availability to switch from one mode to another is limited to a minimum of 100 copying cycles, although the figure may change depending on the replacement interval of developer or the replacement ratio. In terms of the image quality of copies, as seen from FIG. 34, the best image quality is obtained in the improved image-quality mode as the deterioration of the developer in the developer container 16 is the lowest. The second best image quality is obtained in the normal mode and the third is in the developer saving mode. As for the consumption of developer, the lowest amount of developer is consumed in the developer saving mode, while the highest amount of developer is consumed in the improved image-quality mode. Therefore, from economical view point, the most desirable mode is the developer saving mode, followed by the normal mode and the improved image-quality mode.

With the structure of this embodiment, by selecting a mode among the improved image-quality mode, the developer saving mode and the normal mode, a desired operation is selected according to the user's choice: priority for image quality; priority for economical efficiency; or a combination of both.

In this embodiment, according to a mode selected, the discharge time $t_{XC}$ and the supply time $t_{YC}$ are changed. However, it is also possible to change the discharge cycle $X_C$ and supply cycle $Y_C$, or change both the discharge time $t_{XC}$ and supply time $t_{YC}$ and the discharge cycle $X_C$ and supply cycle $Y_C$. Namely, the amount of developer in the developer container 16 to be replaced per copy count is needed to be changed according to the mode selected.

In this embodiment, it is desirable to place the discharge opening 24 in the bottom wall of the developer container 16 in order to force the developer out of the developer container 16. However, this is not the only structure, and the discharge opening 24 can be formed in any location if the developer is discharged from the developer container 16 by opening the slidable cover 26.

[EMBODIMENT 13]

Figure 35:
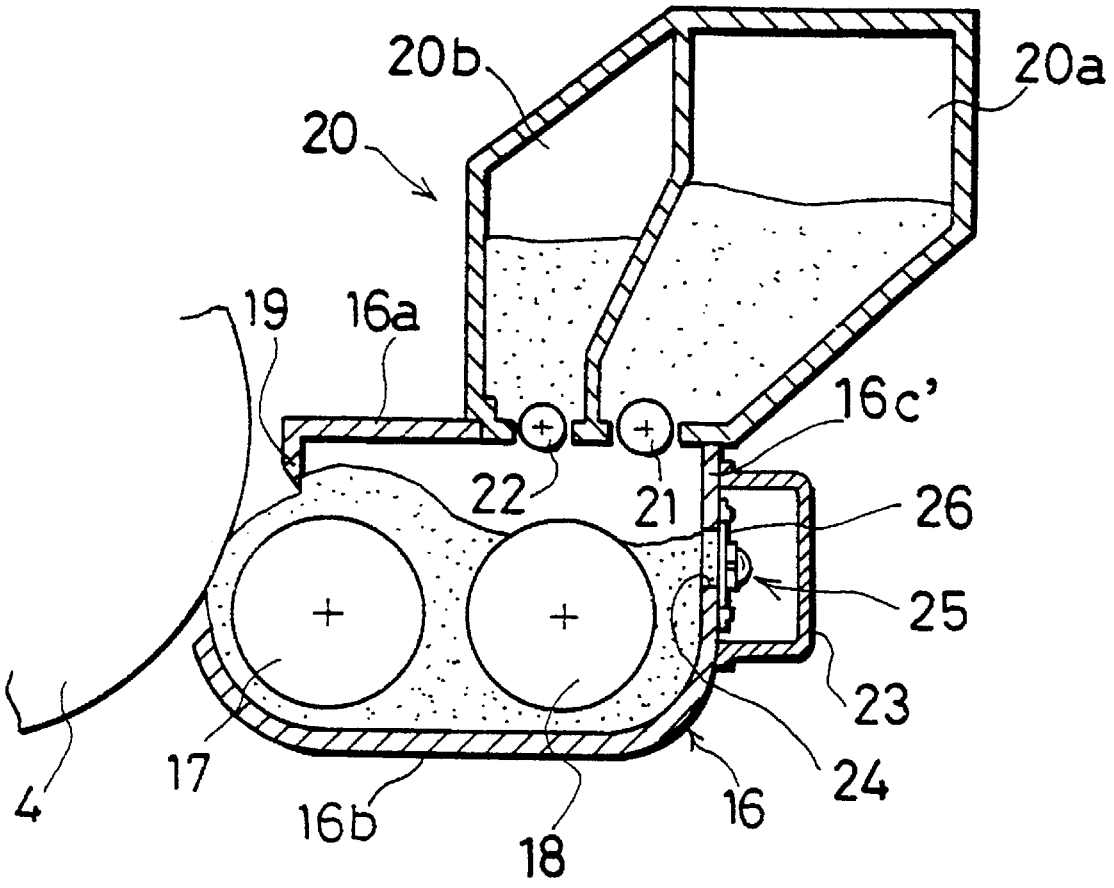
FIG. 35 is a cross section of a developing device according to still another embodiment of the present invention.
Figure 36:
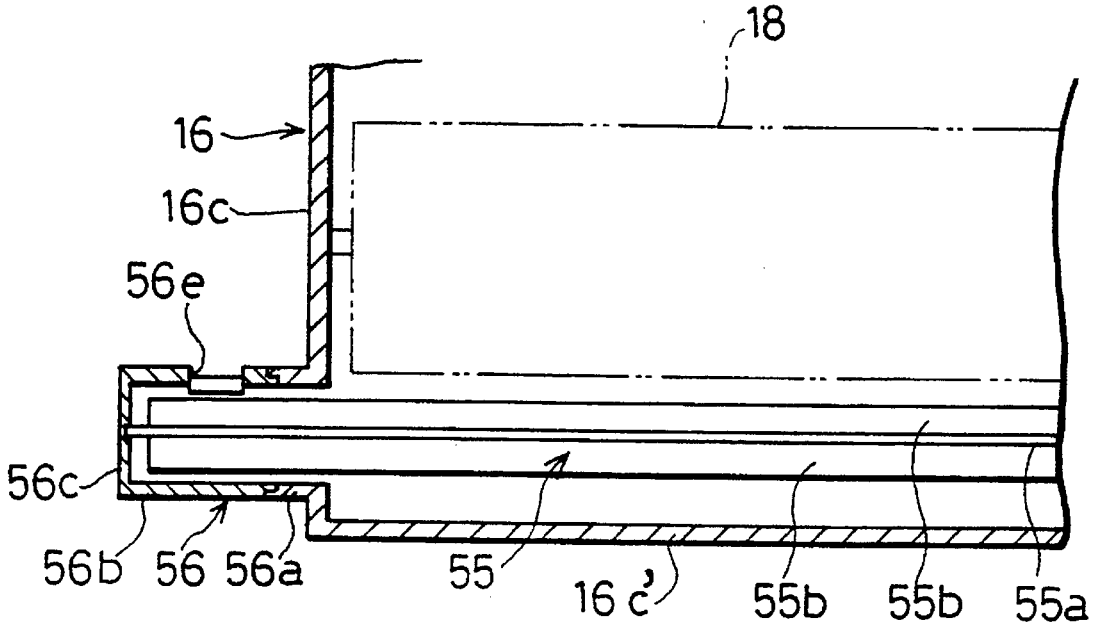
FIG. 36 is a cross section of a developing device according to still another embodiment of the present invention, which is cut across the 36—36 line in FIG. 40.
Figure 37:
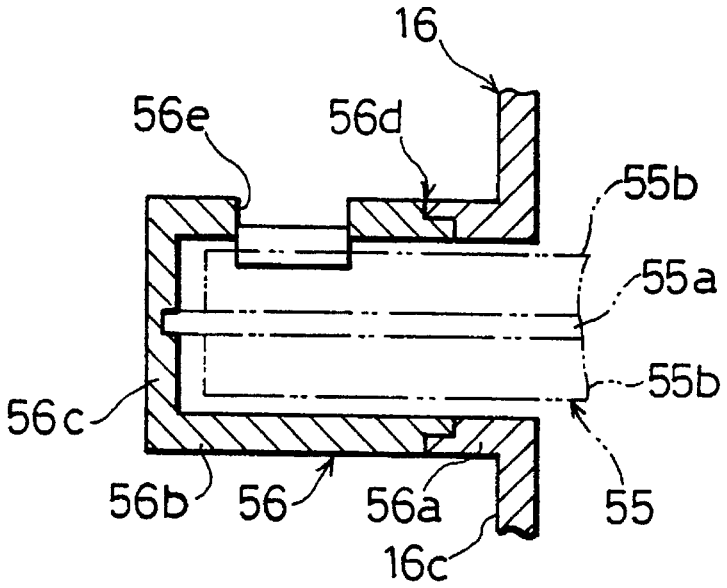
FIG. 37 is an enlarged transverse cross section of a protruding section shown in FIG. 36.
Figure 38:
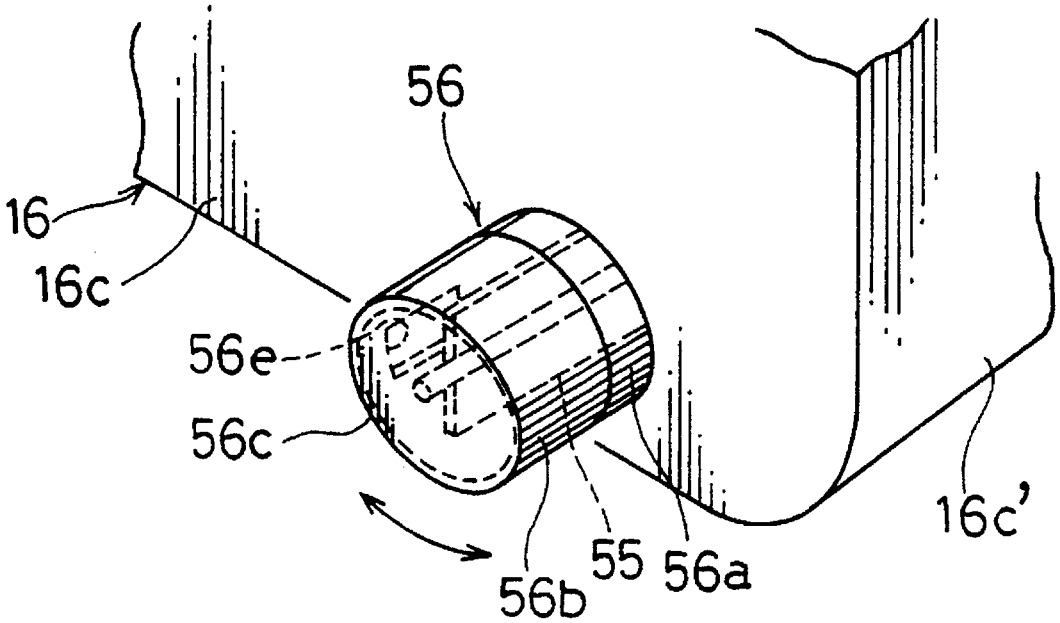
FIG. 38 is a perspective view showing the vicinity of the protruding section.

The following description discusses a thirteenth embodiment of the present invention with reference to FIG. 35. The members having the same function as in the first through third embodiments will be designated by the same code and their description will be omitted.

In the developing device of this embodiment, the discharge opening 24 is placed in a location of the developer container 16 where the deteriorated developer tends to stay. More specifically, the developer discharge opening 24 is placed in a location where the magnetic force of the developing roller 17 hardly reaches and the rotation of the agitating roller 18 hardly causes the developer to flow. In the developer container 16 shown in FIG. 35, the developer discharge opening 24 is placed either in the bottom wall **16*b* located below the agitating roller 18, a side wall 16*c*' extending along the axis of the agitating roller 18, or the side walls 16*c*' facing the ends of the agitating roller 18**.

In this embodiment, the discharge opening 24 is placed in a portion of the side wall **16*c*' with which the top layer of the developer comes into contact. The shutter mechanism 25 is mounted on a portion of the side wall 16*c*' corresponding to the discharge opening 24. Moreover, the collecting container 23 having an open side is attached to the side wall 16*c*' to cover the discharge opening 24. The collecting container 23** is freely attachable to and detachable from the side wall 16*c*'. The control of the slidable cover 26 by the shutter mechanism 25 is achieved by the structure described in the above-mentioned embodiments.

In the developing device of this embodiment, when the slidable cover 26 opens the discharge opening 24, the developer which has deteriorated and is useless for development is discharged and efficiently replaced by newly supplied developer from the developer supply unit 20. With this structure, the developer in the developer container 16 is effectively used, and favorable charge of the developer and good image quality are maintained.

[EMBODIMENT 14]

The following description discusses a fourteenth embodiment of the present invention with reference to FIGS. 36 through 44. The members having the same function as in the first through third embodiments will be designated by the same code and their description will be omitted.

Figure 40:
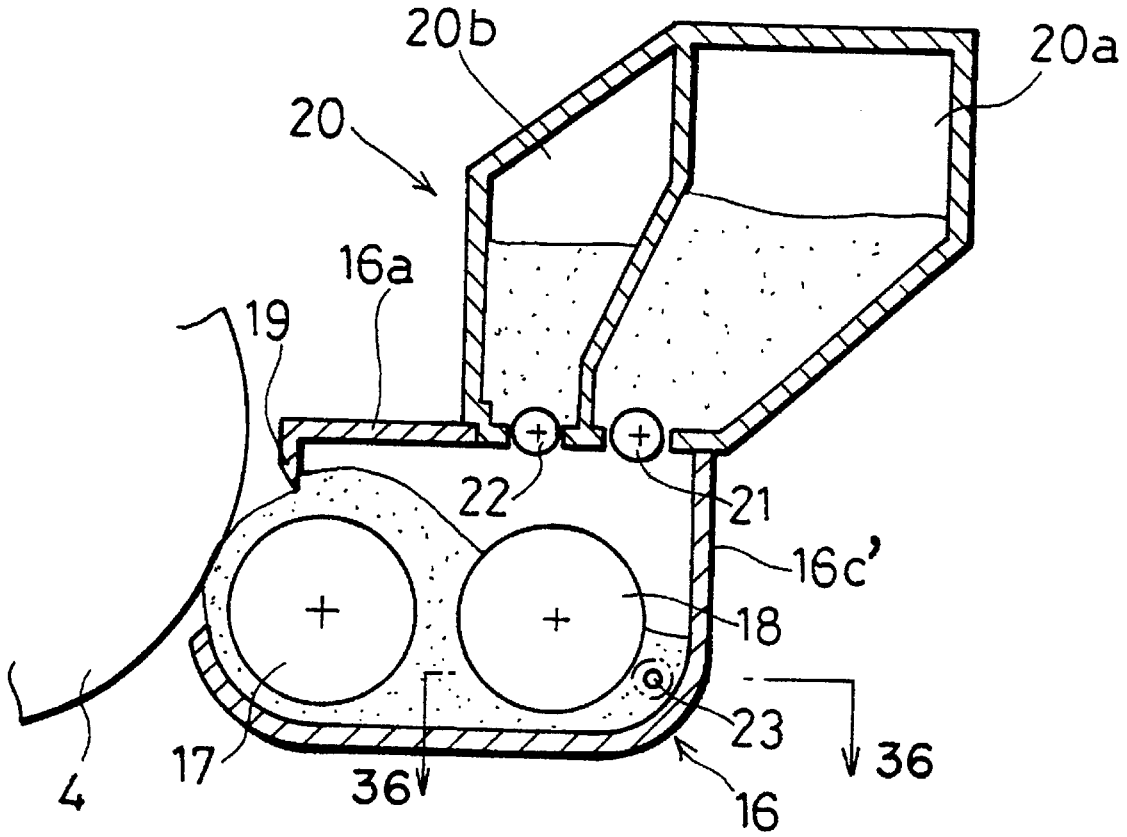
FIG. 40 is an enlarged vertical section the developing device of FIG. 36.

As illustrated in FIG. 40, like the developing device 8 shown in FIG. 3, the developing device of this embodiment includes the developer container 16. The developing roller 17 formed by a magnet roller and the agitating roller 18 as a developing member for agitating the entire developer in the developer container 16 are disposed rotatably inside the developing container 16.

Moreover, a discharging agitator 55 as discharging means is disposed in parallel with the agitating roller 18 at a lower portion of the developer container 16 between the side wall 16*c*' and the agitating roller 18. As illustrated FIGS. 36 through 38, a protruding section 56 in the shape of a cylindrical container enclosing the discharging agitator 55 is located on the side wall 16*c* facing one of the ends of the discharging agitator 55. One of the ends of the discharging agitator 55 is located inside the protruding section 56. Namely, one of the ends of the discharging agitator 55 is supported by a side wall 56*c* of the protruding section 56, while the other end is rotatably supported by a side wall, not shown, facing the side wall 16*c*. The discharging agitator 55 is formed by two pieces of agitating blades 55*b* which extend in the axis direction of the rotation axis 55*a* and are attached to the rotation axis 55*a* at an interval of 180 degree. The rotation of the discharging agitator 55 should not interfere with the rotation of the agitating roller 18 for agitating the developer. The discharging agitator 55 is driven by transmitting a driving force which is applied to the agitating roller 18 to the discharging agitator 55 by gears or by a driving force source which is used exclusively for the discharging agitator 55.

Figure 39:
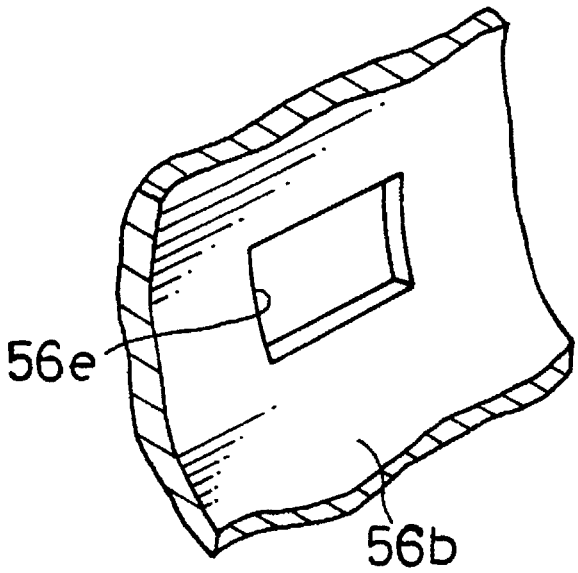
FIG. 39 is an enlarged perspective view showing the vicinity of a discharge opening shown in FIG. 38.

The protruding section 56 has a stationary portion 56*a*, a container-like movable portion 56*b* and a fitting portion 56*d*. The stationary portion 56*a* and the side wall 16*c* are formed as a single piece. The movable portion 56*b* rotatably fits into the fitting portion 56*d*. As illustrated in FIG. 39, a discharge opening 56*e* is formed in the wall of the movable portion 56*b*. Therefore, the level of the discharge opening 56*e* is varied by rotating the movable portion 56*b*. As the discharging agitator 55 rotates, the developer in the protruding section 56 is discharged through the discharge opening 56*e* by the agitating blades 55*b*. In order to collect the developer discharged through the discharge opening 56*e*, the developer container 16 has an attachable and detachable collecting container, not shown.

The copying operation of the copying machine having such a structure is discussed below.

When the power switch, not shown, is turned on, the copying machine is warmed up. Then, when the copying start switch 31, to be described later, is turned on, the lump 3 in the exposure optical system 2, shown in FIG. 2, scans the document on the document platen 1. The reflected light from the document is projected through the reflecting mirrors 5 and the lens unit 6 onto the photoreceptor 4, and an electrostatic latent image is formed on the surface of the photoreceptor 4 which is charged to a predetermined potential by the charger 7. Next, the electrostatic latent image is developed with toner supplied by the developing device 8. The toner image formed on the surface of the photoreceptor 4 is transferred by the transfer charger 9 to a sheet supplied by the paper cassette 13 and is fused to the sheet by the fixing device 15. Consequently, a copy of the image on the document is produced on the sheet.

Figure 41:
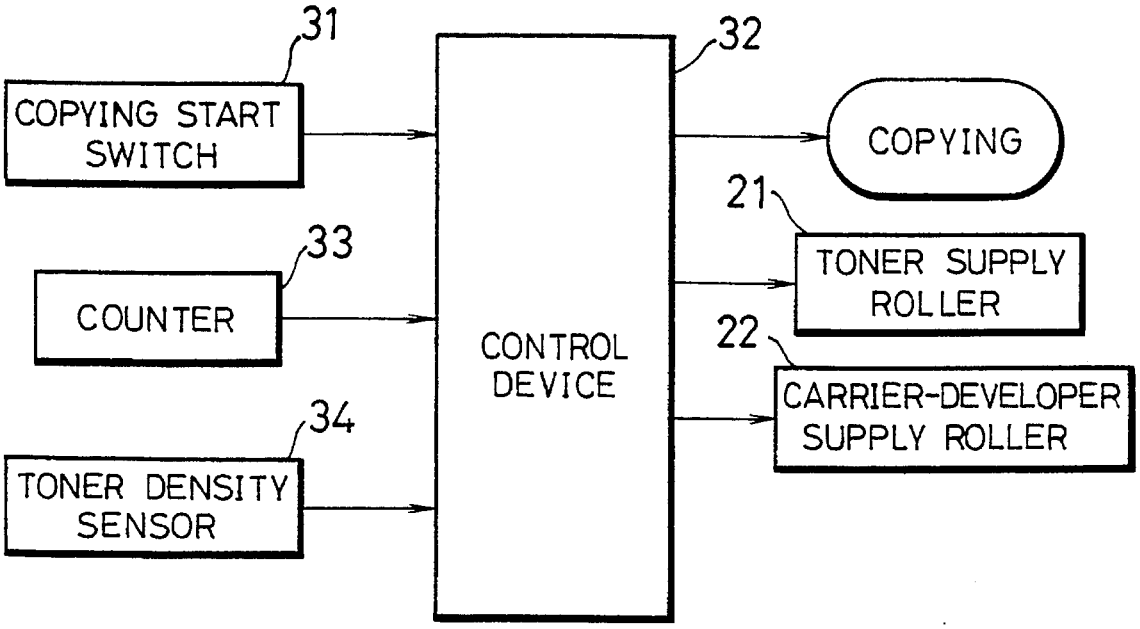
FIG. 41 is a block diagram of a control system in the copying machine incorporating the developing device shown in FIG. 40.
Figure 42:
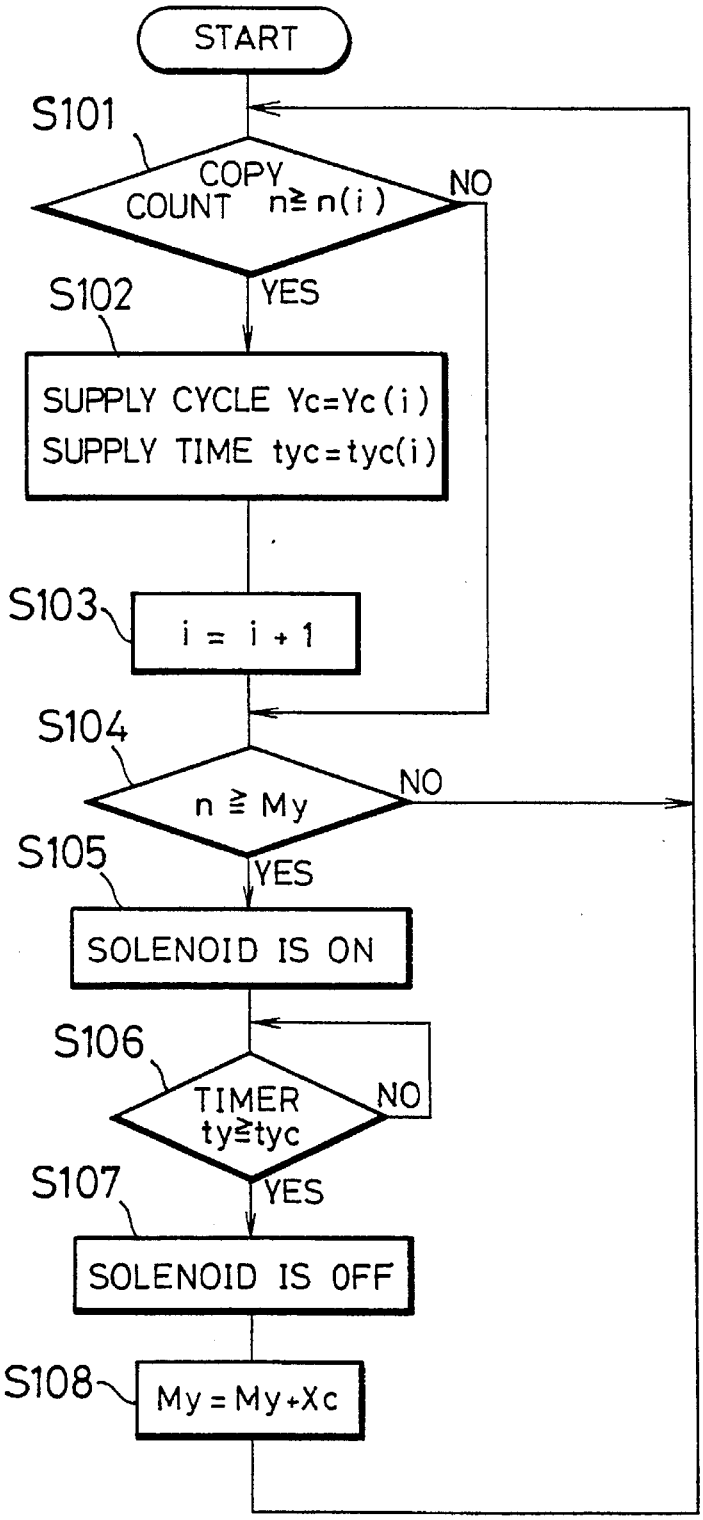
FIG. 42 is a flow chart of the process of controlling the supply of developer in the developing device of the copying machine.

In order to control such a series of copying processes, as illustrated in FIG. 41, the copying machine has the control device 32 formed by a microcomputer. A signal for turning on the copying start switch 31 is designed to be input to the control device 32. The copying machine has also the counter 33 for counting the total number of copies produced, and a copy count n is input to the control device 32.

When such a copying operation is repeatedly performed, the toner in the developer held in the developer container 16 is gradually consumed, and the ratio of the toner to the carrier, i.e., the toner density is lowered. The toner-density sensor 34 for detecting a change in the toner density is disposed in the developer container 16. Under the control of the control device 32 the toner supply roller 21 is driven by an output of the toner-density sensor 34. More specifically, when the detection signal of the toner-density sensor 34 reaches the lower limit in a density range required for development, the toner supply roller 21 is driven. As a result, the toner is supplied from the toner storage 20*a* to the developer container 16, and the toner density in the developer container 16 increases. On the other hand, when the toner density is increased to the higher limit in the density range, the toner supply roller 21 is stopped. Such a control enables the toner density in the developer container 16 to be maintained within the proper density range.

The toner supplied in such a manner is mixed with the developer in the developer container 16, controlled to be charged to a predetermined level, supplied to the photoreceptor 4, and used for development. Meanwhile, the carrier in the developer does not decrease, and is repeatedly used. Therefore, as the carrier is agitated by the developer roller 17 and the agitating roller 18 and as it makes contact with the photoreceptor 4, it gradually deteriorates. The deterioration of the carrier prevents the toner from being charged to a predetermined level, degrading the image quality. A decrease in the charge of developer is diminished by supplying new carrier to the developer container 16 to replace the deteriorating carrier. The control device 32 also controls the supply of the carrier developer from the carrier-developer storage 20*b*. With reference to the flow chart of FIG. 42, the control processes are explained.

Every time a copy is produced, the copy count n of the counter 33 is compared with a set-value changing figure n(i) (Step 101). The figure n(i) is determined by calculating in advance totals of the number of copies produced at which values set for supply cycle $Y_C$, supply time $t_{YC}$ are to be changed. A plurality of values n(1), n(2), . . . are recorded in the memory section in the control device 32, and they are sequentially read out according to a parameter i during Step 101. In the memory section, supply cycle $Y_C$(i) and supply time $t_{YC}$(i) are stored as a data table so as to correspond to the set-value changing figure n(i) (where i is equal to 1, 2, . . . ).

In Step 101, when the copy count n reaches the set-value changing figure n(i), $Y_C$(i) and $t_{YC}$(i) corresponding to n(i)

are set as $Y_C$ and $t_{YC}$ (Step 102). Then, 1 is added to the parameter i (Step 103).

After performing Steps 101 to 103 for changing the set values, the copy count n is compared with supply timing value $M_Y$ (Step 104). If n does not reach $M_Y$, the control device returns to Step 101. On the other hand, if n reaches $M_Y$, the carrier developer supply roller 22 is turned on (Step 105). Consequently, the supply of the carrier developer from the carrier-developer storage **20*b* to the developer container 16 is started. This causes the supply-time supervising timer to start measuring time. The supply of the carrier developer continues until the measured time $t_Y$ reaches the supply time $t_{YC}$ (Step 106**).

When $t_Y$ reaches $t_{YC}$, the carrier-developer supply roller 22 is turned off (Step 107) to stop the supply of the carrier developer. Then, the supply cycle $Y_C$ is added to the supply timing value $M_Y$ (Step 108) and the control device 32 goes back to Step 101. Consequently, the supply timing value $M_Y$ is updated to a value represented by a total number of produced copies at which the next supply is to be performed.

With the repetition of the above-mentioned control operation, every time copying is performed $Y_C$ times, the carrier-developer supply roller 22 is driven for the time $t_{YC}$, and an amount of carrier developer corresponding to the drive time is supplied to the developer container 16.

When the developer is supplied to the developer container 16 in the above-mentioned manner, an amount of developer corresponding to the supplied amount is little by little discharged into the collecting container through the discharge opening **56*e* formed in the protruding section 56 of the developer container 16. The developer springs out of the discharge opening 56*e* as the agitating blades 55*b* of the discharging agitator 55 rotate. Or the developer flows out of the discharge opening 56*e* in the state where the discharging agitator 55** is stopped.

In this developing device, by performing the supply and discharge of the developer in the above-mentioned manner, the developer in the developer container 16 is consecutively replaced with new developer. With this arrangement, since it is possible to maintain a substantially uniform charge of developer, copies of good image quality continue to be produced. The replacement of deteriorated developer with new developer is performed with accuracy particularly when the discharge of developer is performed by the rotation of the discharging agitator 55.

The discharge opening **56*e* is placed in the protruding section 56 so that the developer that has flown into the protruding section 56 is discharged through the discharge opening 56*e*. With this structure, even when the developer container is displaced and tilted, a great amount of developer is never discharged from the developer container 16**. It is thus possible to prevent the amount of developer from becoming greatly lower than a proper amount and the charge of developer from being lowered. Therefore, copies of good image quality continues to be produced.

The amount of developer discharged from the discharge opening **56*e*, i.e., the amount of developer in the developer container 16 varies depending on the level of the discharge opening 56*e*, irrespective of the discharge of developer by the rotation of the discharging agitator 55 and of the discharge of developer by the overflow structure. Moreover, the suitable level of the discharge opening 56*e* varies depending on the types of the discharge of developer, and on the rotating direction and speed of the discharging agitator 55 in the case when discharging developer is performed by the rotation of discharging agitator 55. In this developing device, the level of the discharge opening 56*e* is varied by rotating the movable portion 56*b* of the protruding section 56. Namely, the discharge opening 56 is placed at a suitable level according to the types of discharging. Accordingly, a suitable amount of developer is maintained in the developer container 16** and copies of good image quality are obtained.

Figure 43:
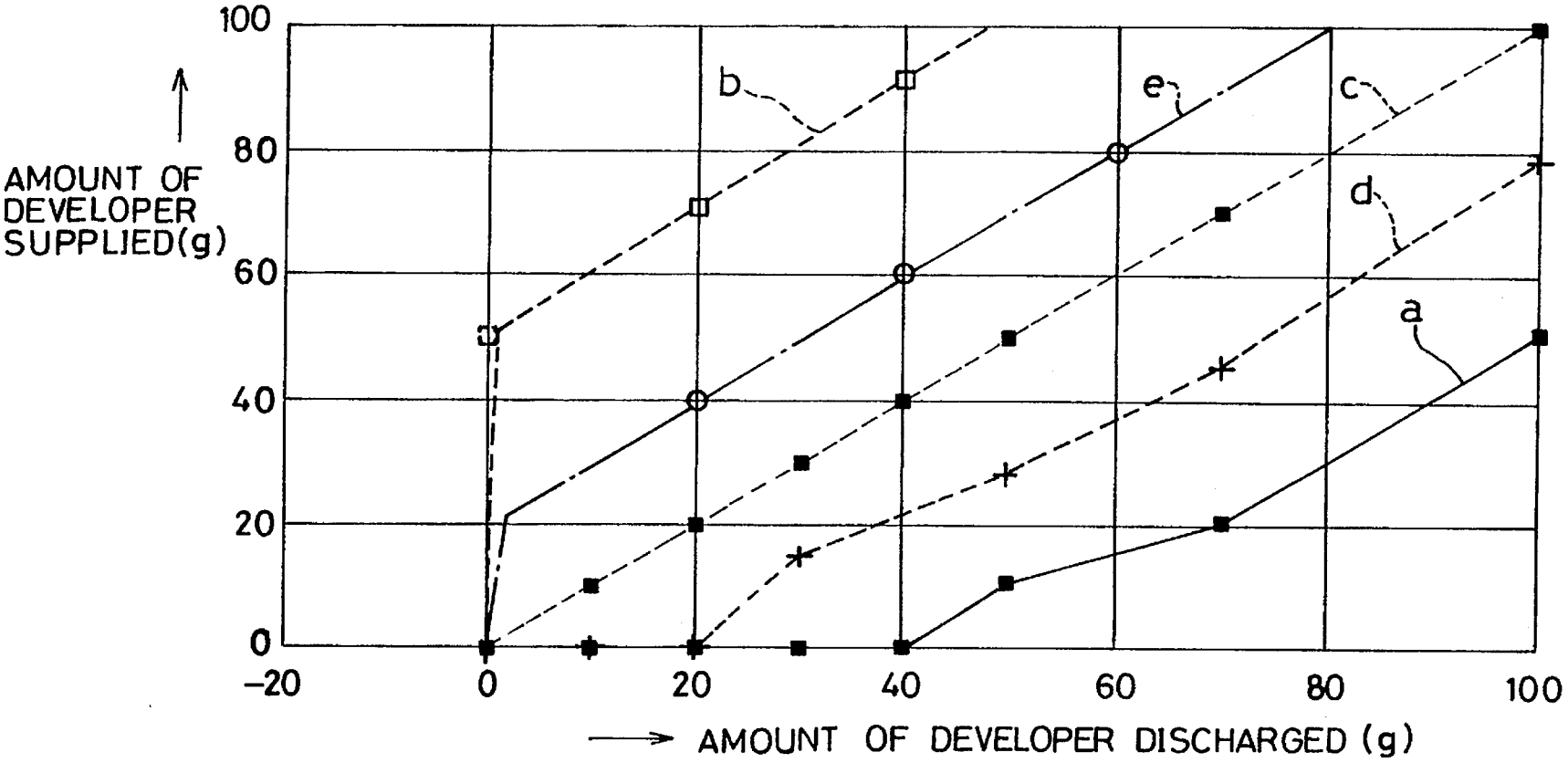
FIG. 43 is a graph showing the relationship between an amount of developer supplied and an amount of developer discharged when the discharge opening is formed at a level shown in FIG. 36.
Figure 44:
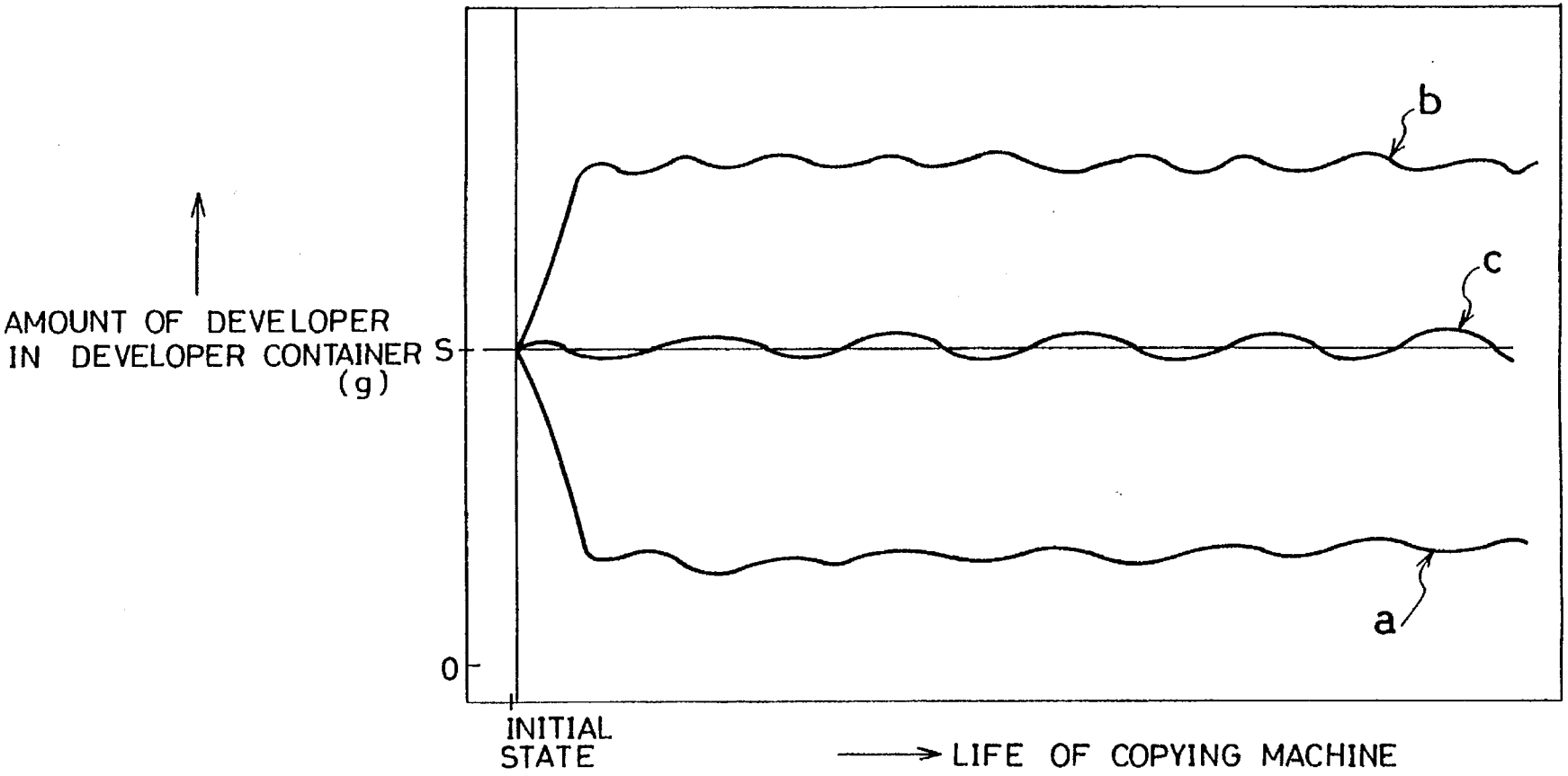
FIG. 44 is a graph showing a change in the amount of developer in the developer container when the discharge opening shown in FIG. 36 is formed at different levels.

More specifically, assuming that the toner density of developer supplied and the toner density of developer discharged are the same, when the discharge opening **56*e* is placed at a proper height, the ratio of the supplied developer to the discharged developer becomes 1 to 1 as shown by the straight line c of FIG. 43 in the early copying operations after the installation of the copying machine. In this case, a proper amount of developer is maintained in the developer container 16**.

The curved line d indicates the relationship between the supplied developer and the discharged developer when the discharge opening **56*e* is placed at the lowest level within an acceptable height range. The curved line e indicates the relationship between the supplied developer and the discharged developer when the discharge opening 56*e* is at the highest level within the acceptable height range. The acceptable height range is a range of levels at which the discharge opening 56*e* is needed to be placed so as to keep the developer within the acceptable range. If the developer discharge opening 56*e*** is placed at a level within the acceptable range, the relationship between the supplied developer and the discharged developer should be indicated in an area between the curved line d and the curved line e.

If the developer discharge opening **56*e* is placed at a level lower than the acceptable range, a greater amount of developer is discharged in the early copying operations performed after the installation of the copying machine as shown by the curved line a. As a result, the amount of developer in the developer container 16** becomes lower than an essential amount of developer, causing the density of copied image to be uneven.

On the other hand, if the developer discharge opening **56*e* is formed at a level higher than the acceptable range, the developer is not discharged until the developer reaches the level of the discharge opening 56*e* in the early copying operations performed after the installation of the copying machine as shown by the curved line b. Since discharging of the developer starts when the developer has deteriorated considerably, the deterioration of developer in the developer container 16 becomes very high on average, causing the image quality of copies to be degraded. Moreover, since the amount of developer in the developer container 16 becomes much higher than a proper amount, the load of driving motors such as the developing roller 17, the agitating roller 18 and the discharging agitator 55** becomes excessively high. This may prevent the motors from rotating.

In this embodiment, the relationship between the location of the discharge opening **56*e* and the image quality of copies is explained with reference to the relationship between the supplied developer and the discharged developer. However, it is also possible to explain the relationship between the location of the discharge opening 56*e* and the image quality of copies with reference to the relationship between the amount of developer in the developer container 16 and the life of the copying machine. More specifically, in the case when the discharge opening 56*e* is placed within the acceptable height range, the amount of developer in the developer container 16 slightly changes within a predetermined range after the installation of the copying machine as illustrated by the curved line c of FIG. 44. On the other hand, if the discharge opening 56*e* is placed at a height outside of the acceptable range, the amount of developer in the developer container 16** becomes greatly different from the proper amount as shown by the curved lines a and b.

In this embodiment, the discharging agitator 55 having the agitating blades 55*b* is formed in the shape of a flat plate. However, this is only an example, and the discharge agitator 55 may be formed in the shape of a cylindrical roller.

If the developing device is constructed to discharge only the developer through the discharge opening 56*e* by the overflow structure, it is possible to omit the discharging agitator 55.

Furthermore, in the above-mentioned embodiments 1 through 14, the toner storage 20*a* and the carrier-developer storage 20*b* are provided in the developer supply unit 20, and the supply of the carrier developer and the supply of the toner are separately controlled. However, it is also possible to provide only the carrier-developer storage for holding in the developer supply unit 20 carrier developer which is mixed with toner at a predetermined high density so that the carrier is supplied together with the toner according to a density detecting signal of the toner-density detecting sensor 34. In this case, when the total amount of the carrier developer which is consecutively supplied according to the density detecting signal reaches a predetermined value, opening and closing of the slidable cover 26 is controlled so that an amount of developer corresponding to the amount of carrier in the total amount of the carrier developer is consecutively discharged.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A developing device comprising:

a developer container comprising side walls and a bottom wall for storing developer having toner and carrier;

a discharge opening formed in said developer container for discharging the developer from said developer container;

a developing roller, mounted rotatably in said developer container, for supplying to a photoreceptor the developer so as to develop an electrostatic latent image formed on a photoreceptor surface into a toner image:

an agitating member, mounted rotatably in said developer container, for agitating the developer to charge said toner by friction;

developer supply means for supplying developer;

shutter means for opening and closing said discharge opening so as to control a discharge of deteriorated developer from said developer container, and supply and discharge control means for controlling said developer supply means to add unused carrier to developer according to a degree of deterioration of carrier in the developer, and controlling said shutter means to discharge the deteriorated developer.

2. The developing device according to claim 1, wherein said discharge opening is formed in the bottom wall of said developer container facing said agitating member.

3. The developing device according to claim 1, wherein said developer supply means is disposed above said developer container, and includes a carrier-developer storage and a carrier-developer supply roller for supplying carrier developer downwardly into said developer container from said carrier-developer storage, an amount of the carrier developer supplied corresponding to a rotation drive time of said carrier-developer supply roller.

4. The developing device according to claim 1, wherein said shutter means includes a cover which is movable to open and close said discharge opening, and driving means for generating a driving force to move said cover.

5. The developing device according to claim 1, further comprising a collecting container, attached outside of said discharge opening, for collecting deteriorated developer discharged from said discharge opening, said collecting container being attachable to and detachable from said discharge opening.

6. The developing device according to claim 1, further comprising a copy counter for accumulating the number of times copying is performed and controlling said supply and discharge control means according to a copy count.

7. The developing device according to claim 6, wherein said supply and discharge control means includes:

a discharge control section for controlling said shutter means according to a copy count of said copy counter;

a supply control section for controlling said developer supply means according to a detection signal; and a supervisory control section for supervising said discharge control section and supply control section by communicating with both of said sections.

8. The developing device according to claim 1, further comprising toner-density sensor for detecting a toner density of developer stored in said developer container and providing a detection signal corresponding to the toner density and controlling said supply and discharge control means according to a detection signal.

9. The developing device according to claim 1, wherein said supply and discharge control means controls said shutter means so that deteriorated developer is discharged from said discharge opening as said agitating member rotates.

10. The developing device according to claim 1, wherein said supply and discharge control means controls said developer supply means and said shutter means so that an amount of developer replaced in a single replacement operation increases according to a number of times a replacement operation has been performed, the replacement of developer being performed by supplying carrier from said developer supply means and discharging deteriorated developer from said discharge opening.

11. The developing device according to claim 1, wherein said supply and discharge control means controls said developer supply means and said shutter means to prohibit the supply of carrier developer by said developer supply means and the discharge of deteriorated developer from discharge opening from being performed simultaneously and, to delay supplying operation until discharging operation is complete when a supply start signal and a discharge start signal are generated substantially simultaneously.

12. The developing device according to claim 1, wherein said supply and discharge control means controls said developer supply means and said shutter means so that the developer in said developer container is gradually replaced according to an accumulated drive time of a rotary driving body including said developing roller and said agitating member, replacement of developer being performed by supplying carrier developer by said developer supply means and discharging deteriorated developer from said discharge opening.

13. The developing device according to claim 1, wherein said supply and discharge control means controls said developer supply means and said shutter means so that the supply of carrier developer is performed by said developer supply means after discharging deteriorated developer from said discharge opening.

14. The developing device according to claim 1, wherein said supply and discharge control means controls said developer supply means and said shutter means so that the discharge of deteriorated developer from said discharge opening is performed by a rotation of said agitating member during pre-rotation of said photoreceptor before an image is formed on said photoreceptor or during a post-rotation after the image is formed on said photoreceptor.

15. The developing device according to claim 1, wherein said supply and discharge control means controls said developer supply means and said shutter means so that an amount of developer greater than $M \times P/A_L$ is supplied to and discharged from said developer container, M being an amount of developer in said developer container, P being a developer replacement interval, $A_L$ being a useful life of the developer.

16. The developing device according to claim 1, wherein said developer supply means supplies carrier developer whose life expectancy is shorter than that of developer stored in said developer container to said developer container, and wherein said supply and discharge control means controls said developer supply means and said shutter means so that the supply of the carrier developer to said developer container and the discharge of the deteriorated developer from said developer container are performed according to the life expectancy of the carrier developer supplied from said developer supply means.

17. The developing device according to claim 1, further comprising mode selection means for selecting a mode at least from an improved image-quality mode and a developer saving mode, wherein said supply and discharge control means controls said developer supply means and said shutter means so that a relatively large amount of carrier developer is supplied to said developer container and a relatively large amount of deteriorated developer is discharged from said developer container in a single cycle of supplying and discharging operations when the improved image-quality mode is selected and that a relatively small amount of carrier developer is supplied to said developer container and a relatively small amount of deteriorated developer is discharged from said developer container in a single cycle of supplying and discharging operations when the developer saving mode is selected.

18. The developing device according to claim 1 wherein the supply and discharge control means controls the developer supply means to add unused carrier to the developer every time a predetermined number of copies are produced.

19. A developing device comprising:

a developer container comprising side walls and a bottom wall for storing developer having toner and carrier;

a discharge opening formed in said developer container for discharging the developer from said developer container;

a developing roller, mounted rotatably in said developer container, for supplying to a photoreceptor the developer so as to develop an electrostatic latent image formed on a photoreceptor surface into a toner image;

an agitating member, mounted rotatably in said developer container, for agitating the developer to charge said toner by friction, said agitating member rotates around an axis and is driven on one end, and wherein said developer container includes a protruding section which protrudes in the axis direction of said agitating member and is mounted at the non-driving side of said agitating member, and wherein said discharge opening is formed in said protruding section;

developer supply means for supplying developer and shutter means for opening and closing said discharge opening so as to control a discharge of deteriorated developer from said developer container.

20. A developing device comprising:

a developer container comprising side walls and a bottom wall for storing developer having toner and carrier;

a discharge opening formed in said developer container for discharging the developer from said developer container;

a developing roller, mounted rotatably in said developer container, for supplying to a photoreceptor the developer so as to develop an electrostatic latent image formed on a photoreceptor surface into a toner image;

an agitating member, mounted rotatably in said developer container, for agitating the developer to charge said toner by friction, said agitating member comprises an agitating screw having a longitudinal axis and a spiral agitating blade around its axis, wherein said agitating screw transports the developer toward one end of said axis with a rotation of said agitating member, and wherein said discharge opening is formed in a side wall of said developer container facing one end of said axis along which said agitating screw transports said developer;

developer supply means for supplying developer; and shutter means for opening and closing said discharge opening so as to control a discharge of deteriorated developer from said developer container.

21. A developing device comprising:

a developer container comprising side walls and a bottom wall for storing developer having toner and carrier;

a discharge opening formed in said developer container for discharging the developer from said developer container;

a developing roller, mounted rotatably in said developer container, for supplying to a photoreceptor the developer so as to develop an electrostatic latent image formed on a photoreceptor surface into a toner image;

an agitating member, mounted rotatably in said developer container, for agitating the developer to charge said toner by friction said agitating member is formed by a puddle roller having an axis and a plurality of blades, wherein said developer container includes a protruding section which protrudes in the axis direction of said puddle roller at which non-driving side of said puddle roller is mounted; and wherein said discharge opening is formed in the protruding section;

developer supply means for supplying developer; and shutter means for opening and closing said discharge opening so as to control a discharge of deteriorated developer from said developer container.

22. A developing device comprising:

a developer container comprising side walls and a bottom wall for storing developer having toner and carrier;

a discharge opening formed in said developer container for discharging the developer from said developer container;

a side wall of said developer container has an opening into said developer container, a protruding section to which deteriorated developer in said developer container flows, and said discharge opening is formed in a wall of said protruding section;

a developing roller, mounted rotatably in said developer container, for supplying to a photoreceptor the developer so as to develop an electrostatic latent image formed on a photoreceptor surface into a toner image;

an agitating member, mounted rotatably in said developer container, for agitating the developer to change said toner by friction;

developer supply means for supplying developer; and shutter means for opening and closing said discharge opening so as to control a discharge of deteriorated developer from said developer container.

23. The developing device according to claim 22, wherein said protruding section includes discharging means for discharging the deteriorated developer in said protruding section from said discharge opening by a rotary movement.

24. The developing device according to claim 22, wherein said protruding section is placed so that a level of said discharge opening is adjustable.

25. A developing device comprising:

a developer container comprising side walls and a bottom wall for storing developer having toner and carrier;

a discharge opening formed in said developer container for discharging the developer from said developer container;

a developing roller, mounted rotatably in said developing container, for supplying to a photoreceptor the developer so as to develop an electrostatic latent image formed on a photoreceptor surface into a toner image;

an agitating member, mounted rotatably in said developer container, for agitating the developer to charge said toner by friction;

developer supply means for supplying developer;

shutter means for opening and closing said discharge opening so as to control a discharge of deteriorated developer from said developer container;

wherein said shutter means includes a cover which is movable to open and close said discharge opening, and driving means for generating a driving force to move said cover, and wherein said cover is slidable over a wall surface of said developer container and said driving means comprises a solenoid having a plunger whose end is connected to said cover.

26. A developing device comprising:

a developer container having side walls and a bottom wall for storing developer having toner and carrier;

a first discharge opening formed in said developer container for discharging the developer in said developer container;

a developing roller, mounted rotatably in said developing container, for supplying to a photoreceptor the developer so as to develop an electrostatic latent image formed on a photoreceptor surface into a toner image;

an agitating member, mounted rotatably in said developer container, for agitating the developer to charge the toner by friction;

developer supply means for supplying developer;

developer accumulating means for accumulating a predetermined amount of deteriorated developer discharged from said first discharge opening; and switching means for switching said developer accumulating means between accumulating the deteriorated developer and discharging the deteriorated developer.

27. The developing device according to claim 26, wherein said agitating member includes a spiral agitating blade positioned around a rotation axis of said agitating member and an agitating screw for transporting the developer in a direction along the axis by a rotary movement, and said first discharge opening is formed in a side wall of said developer container facing an end of said axis.

28. The developing device according to claim 26, wherein said developer accumulating means includes a discharged-developer storage section formed in said developer container to cover said first discharge opening and a second discharge opening formed in a bottom wall of said developer accumulating means, and wherein said switching means is formed by shutter means for opening and closing said second discharge opening so as to control a discharge of deteriorated developer from said discharged-developer storage section.

29. The developing device according to claim 28, further comprising shutter means includes a cover which is movable to open and close said first discharge opening to control a discharge of deteriorated developer from said developer container, and driving means for generating a driving force to move said cover.

30. The developing device according to claim 29, wherein said cover is slidable over a wall surface of said developer container, and said driving means is formed by a solenoid having a plunger whose end is connected to said cover.

31. The developing device according to claim 26, wherein said switching means includes:

a cylindrical rotating body mounted to cover said first discharge opening from outside;

a rotating-body driving motor for generating a driving force to rotate said cylindrical rotating body; and driving control means for controlling the driving of said rotating-body driving motor, and wherein said developer accumulating means is formed by a discharged-developer storage section formed in an outer surface of said cylindrical rotating body, said discharged-developer storage section being connected to or disconnected from said first discharge opening by a rotation of said cylindrical rotating body.

32. The developing device according to claim 31, wherein said driving control means includes a position detecting sensor for detecting a developer accumulating position when said discharged developer storage section is connected to said first discharge opening.

33. A method of controlling supply and discharge of developer by supply and discharge control means comprising the steps of:

comparing a copy count accumulated by a copy counter every time a copy is produced with predetermined set-values that indicate a changing figure to determine by number of copies produced, the time at which a discharge cycle, a discharge time, a supply cycle and a supply time are to be conducted;

changing the set values when the copy count reaches the set-values changing figure;

comparing the copy count with a set value for a discharge timing and a set value for a discharge cycle;

discharging deteriorated developer from a developer container by controlling shutter means based on the set values for the discharge cycle and the discharge time;

comparing the copy count with a set value for a supply timing and a set value for a supply cycle; and supplying carrier developer to said developer container by controlling developer to said developer container by controlling developer supply means based on the set values for the supply cycle and the supply time when the copy count reaches the set value for the supply timing.

34. The control method according to claim 33, further comprising the steps of:

detecting whether a discharge of deteriorated developer is complete; and comparing the copy count with the set value for supply timing only when the discharge of deteriorated developer is complete.

35. The control method according to claim 33, further comprising the steps of:

detecting if a developing roller performs a pre-rotation before an imaging operation or performs a post-rotation after the imaging operation when the copy count reaches the set value for discharge timing; and discharging deteriorated developer from said developer container during the pre-rotation or post rotation.

36. The control method according to claim 33, further comprising the steps of:

detecting if a pre-rotation of a developing roller before an imaging operation is performed when the copy count reaches the set value for discharge timing; and discharging deteriorated developer from said developer container only when the pre-rotation is performed;

when the copy count does not reach the set value for discharge timing, comparing a copy count obtained by accumulating the number of copies to be produced in a next copying cycle with the set value for discharge timing; and only when the copy count after the next copying cycle reaches the set value for discharge timing, comparing the copy count with the set value for supply timing.

37. The control method according to claim 36, further comprising the steps of:

when the copy count does not reach the set value for discharge timing, detecting if a difference between the set value for discharge timing and the copy count is smaller than a difference between a copy count after the next copying cycle and the set value for discharge timing;

when the difference between the set value for discharge timing and the copy count is smaller than the difference between the set value for discharge timing and the copy count after the next copy cycle, discharging deteriorated developer during the pre-rotation of said developing roller at a present copy count.

38. The control method according to claim 37, further comprising the steps of:

when the difference between the set value for discharge timing and the copy count is greater than the difference between the set value for discharge timing and the copy count after the next copy cycle, discharging deteriorated developer during post-rotation of said developing roller after a copying operation.

39. A method of controlling discharge of deteriorated developer by supply and discharge control means comprising the steps of:

comparing a copy count indicated in a copy counter with a discharge timing by a discharge control section of said supply and discharge control means and detecting whether it is time for discharging the deteriorated developer;

transmitting a discharge start signal from said discharge control section to a supervisory control section of said supply and discharge control means; and discharging the deteriorated developer upon receiving a discharge enabling signal from said supervisory control section.

40. A method of controlling supply of carrier developer by supply and discharge control means comprising the steps of:

providing a detection signal from a toner-density sensor for detecting a toner density of developer stored in a developer container;

providing said supply and discharge control means comprising a supply control section, a discharge control section for controlling discharge of developer from a discharge opening independently of supply of developer, and a supervisory control section for controlling supplying and discharging to be not performed simultaneously;

detecting if it is time for supplying the carrier developer by said supply control section according to the detection signal from the toner-density sensor;

transmitting a supply start signal from said supply control section to said supervisory control section of said supply and discharge control means;

transmitting a supply enabling signal from said supervisory control section when discharging the developer from said discharge opening is not performed; and supplying the carrier developer when said supply control section receives the supply enabling signal from said supervisory control section.

41. The control method according to claim 40, whether a supply start signal has been generated by said supply control section;

setting a supply timing flag to 1 when the supply start signal has been generated or setting the supply timing flag to 0 when the supply start signal has not been generated;

providing a discharge control section having means for generating a discharge start signal;

detecting whether a discharge start signal has been generated by said discharge control section;

transmitting a discharge enabling signal to said discharge control section when the discharge start signal is generated so as to execute discharging;

detecting whether the supply timing flag is 1 or 0 after discharging deteriorated developer; and transmitting a supply enabling signal to said supply control section when the supply timing flag is 1 so as to execute supplying of the carrier developer.

42. A method of controlling discharge of deteriorated developer by supply and discharge control means comprising the steps of:

comparing a total drive time of a rotary driving body including a developing roller or an agitating member with a set discharge cycle; and discharging deteriorated developer from a developer container by controlling shutter means according to a set value for a discharge time when the total drive time reaches the set discharge cycle.

* * * * *